US011299831B2

(12) United States Patent
Hiraoka et al.

(10) Patent No.: US 11,299,831 B2
(45) Date of Patent: Apr. 12, 2022

(54) SEWING SYSTEM

(71) Applicant: JUKI CORPORATION, Tama (JP)

(72) Inventors: Koji Hiraoka, Tama (JP); Takeshi Asami, Tama (JP)

(73) Assignee: JUKI CORPORATION, Tama (JP)

( * ) Notice: Subject to any disclaimer, the term of this patent is extended or adjusted under 35 U.S.C. 154(b) by 48 days.

(21) Appl. No.: 16/431,889

(22) Filed: Jun. 5, 2019

(65) Prior Publication Data

US 2019/0376217 A1 Dec. 12, 2019

(30) Foreign Application Priority Data

Jun. 6, 2018 (JP) ..... JP2018-108889

(51) Int. Cl.

| | |
|---|---|
| ***D05B 19/16*** | (2006.01) |
| ***D05B 33/00*** | (2006.01) |
| ***D05B 35/10*** | (2006.01) |
| ***B65H 7/20*** | (2006.01) |

(52) U.S. Cl.

CPC ..... *D05B 19/16* (2013.01); *D05B 33/00* (2013.01); *D05B 35/102* (2013.01); *B65H 7/20* (2013.01)

(58) Field of Classification Search

CPC ..... D05B 21/00; D05B 19/16; D05B 33/00; D05B 33/02; D05B 33/04; D05B 35/102; B65H 7/00

See application file for complete search history.

(56) References Cited

U.S. PATENT DOCUMENTS 3,945,632 A 3/1976 Gray
4,425,858 A * 1/1984 Hargett ..... D05B 35/102 112/470.04
4,498,404 A * 2/1985 Sadeh ..... D05B 21/00 112/308

(Continued)

FOREIGN PATENT DOCUMENTS

CN 106087277 A 11/2016
JP H03-58270 U 6/1991

(Continued)

OTHER PUBLICATIONS

Periphery, Cambridge Dictionary, https://dictionary.cambridge.org/us/dictionary/english/periphery (last visited Dec. 23, 2020) (Year: 2020).*

(Continued)

*Primary Examiner* — Alissa L Hoey
*Assistant Examiner* — Patrick J. Lynch
(74) *Attorney, Agent, or Firm* — Faegre Drinker Biddle & Reath LLP

(57) ABSTRACT

A sewing system which includes a detector for detecting an edge of a cloth installed on an installation table, a cloth conveyor for conveying the cloth from the installation table to a sewing machine, and a controller, wherein the cloth conveyor includes a holding member that holds the cloth, and the controller includes a holding position decision portion that determines a holding position of the cloth based on detection data of the detector, and a conveyance control portion that controls the cloth conveyor such that the holding member holds the holding position. In the sewing system according to the above, it is possible to prevent deterioration in productivity of sewn products.

7 Claims, 23 Drawing Sheets

(56) References Cited

U.S. PATENT DOCUMENTS

| | | | | |
|---|---|---|---|---|
| 4,917,030 | A * | 4/1990 | Bisson | A41H 42/00 112/320 |
| 5,205,232 | A * | 4/1993 | Sadeh | A43D 119/00 112/475.03 |
| 5,443,024 | A * | 8/1995 | Wethington | D05B 33/02 112/130 |
| 5,537,946 | A * | 7/1996 | Sadeh | D05B 19/08 112/470.07 |
| 5,664,512 | A | 9/1997 | Foster et al. | |
| 5,669,320 | A | 9/1997 | Stewart et al. | |
| 5,765,495 | A * | 6/1998 | Adamski, Jr. | D05B 33/02 112/475.03 |
| 5,908,004 | A * | 6/1999 | Porter | D05B 21/00 112/150 |
| 5,915,319 | A | 6/1999 | Price et al. | |
| 7,984,681 | B1 * | 7/2011 | Oxley | D05B 35/10 112/2.1 |
| 2005/0045081 | A1 * | 3/2005 | Price | D05B 35/06 112/2.1 |
| 2018/0002852 | A1 * | 1/2018 | Yamazaki | D05B 23/00 |

FOREIGN PATENT DOCUMENTS

| | | | |
|---|---|---|---|
| JP | 10118375 | A | 5/1998 |
| JP | 10251961 | A | 9/1998 |
| JP | 2000-197783 | A | 7/2000 |
| JP | 2016-131614 | A | 7/2016 |

OTHER PUBLICATIONS

Extended European Search Report dated Nov. 19, 2019 in corresponding European patent application 19178633.4 (8 pages).

First Office Action dated Dec. 13, 2021 in Chinese Patent Application No. 201910492127.2 (10 pages) with an English translation (9 pages).

* cited by examiner

SEWING SYSTEM

CROSS-REFERENCE TO RELATED APPLICATIONS

The present application claims the benefit of priority of Japanese Patent Application No. 2018-108889, filed on Jun. 6, 2018, the content of which is incorporated herein by reference.

TECHNICAL FIELD

The present invention relates to a sewing system.

BACKGROUND ART

A sewing system including a sewing machine is used in a manufacturing process of sewn products. As an example of such a sewing system, a label sewing device disclosed in Japanese Unexamined Patent Application Publication No. 2016-131614 is known.

In order to prevent deterioration in productivity of sewn products, a technology is required which can quickly and accurately feed cloth to a sewing machine.

SUMMARY OF THE INVENTION

An aspect of the present invention is to prevent deterioration in productivity of sewn products.

An aspect of the present invention is a sewing system which includes a detector for detecting an edge of a cloth installed on an installation table, a cloth conveyor for conveying the cloth from the installation table to a sewing machine, and a controller, wherein the cloth conveyor includes a holding member that holds the cloth, and the controller includes a holding position decision portion that determines a holding position of the cloth based on detection data of the detector, and a conveyance control portion that controls the cloth conveyor such that the holding member holds the holding position.

In the sewing system according to an aspect of the present invention, it is possible to prevent deterioration in productivity of sewn products.

DETAILED DESCRIPTION

Hereinafter, an embodiment of the present invention will be described with reference to the drawings, but the present invention is not limited thereto. Configuration elements of the embodiment which will be described hereinafter can be appropriately combined with each other. There is also a case where some configuration elements are not used.

In the following description, an XYZ orthogonal coordinate system is set, and the positional relation of each part will be described with reference to the XYZ orthogonal coordinate system. A direction parallel to an X-axis in a predetermined plane is defined as an X-axis direction, a direction parallel to a Y-axis in the predetermined plane orthogonal to the X-axis is defined as a Y-axis direction, and a direction parallel to the Z-axis orthogonal to the predetermined plane is defined as Z-axis direction. A rotation direction or an inclination direction around the X-axis is defined as a θX direction, the rotation direction or the inclination direction around the Y-axis is a θY direction, and the rotation direction or the inclination direction around the Z-axis is the θZ direction. In the following description, the predetermined plane is appropriately referred to as an XY plane. In the embodiment, the XY plane and the horizontal plane are parallel to each other.

Sewing System

Figure 1:
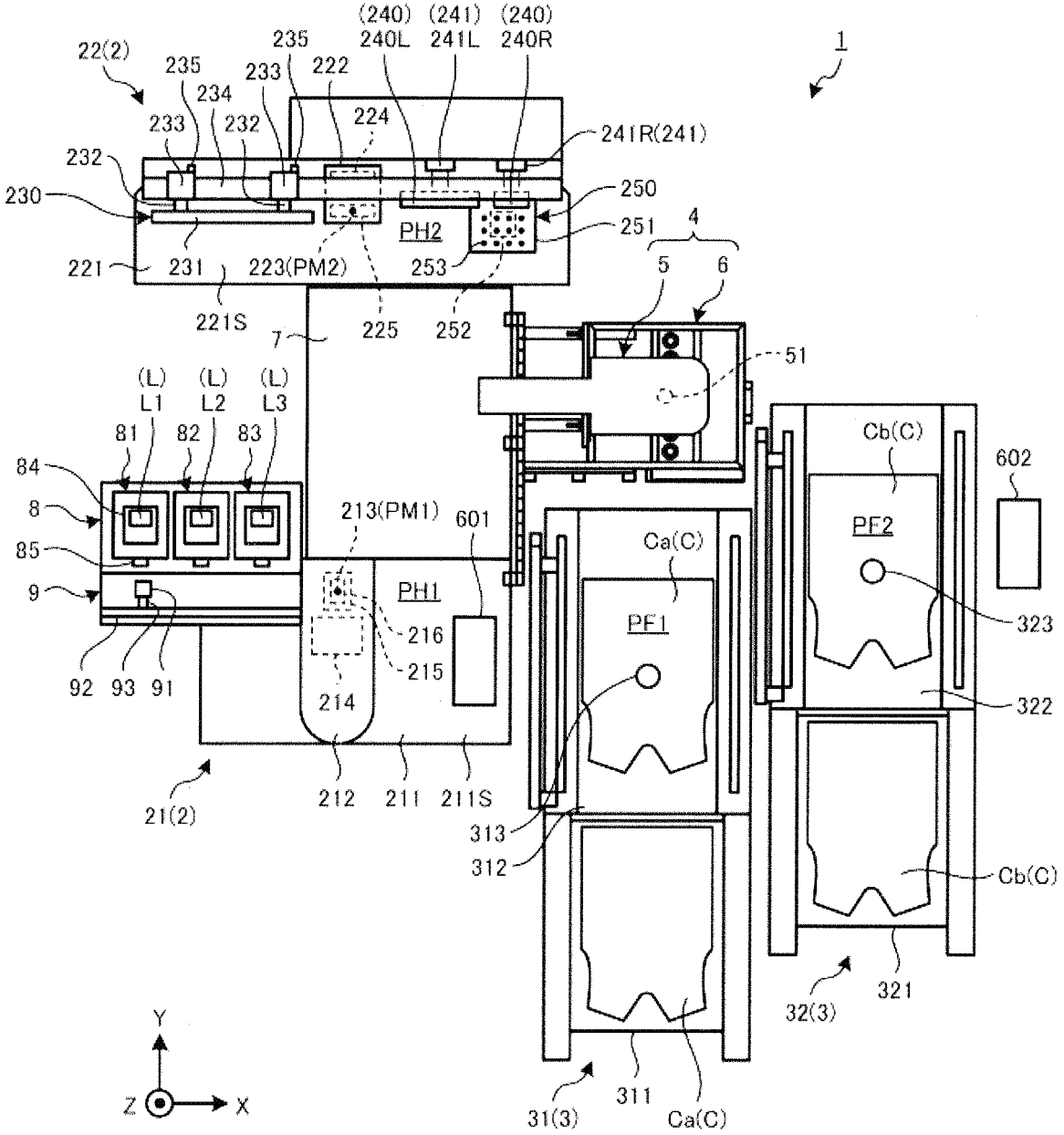
FIG. 1 is a plan view schematically illustrating a sewing system according to an embodiment.

FIG. 1 is a plan view schematically illustrating a sewing system 1 according to the embodiment. The sewing system 1 stitches cloth to manufacture sewn products. In the embodiment, the sewn product is clothing. The cloth is a concept including at least one of cloth, fabric, nonwoven fabric, and leather. The cloth may be a concept including a label which will be described later. As illustrated in FIG. 1, the sewing system 1 includes a sewing machine 2, a cloth feeder 3, and a cloth conveyor 4 that holds cloth C fed from the cloth feeder 3 and conveys the cloth C to the sewing machine 2.

The cloth conveyor 4 includes a robot 5, and a conveying member 6 held by the robot 5. The robot 5 is movable on a base member 7. In the XY plane, the base member 7 is disposed between the sewing machine 2 and the cloth feeder 3. The conveying member 6 holds the cloth C.

The sewing machine 2 includes a first sewing machine 21 and a second sewing machine 22. The cloth feeder 3 includes a first cloth feeder 31 and a second cloth feeder 32. The cloth C includes first cloth Ca and second cloth Cb. The first cloth feeder 31 feeds the first cloth Ca. The second cloth feeder 32 feeds the second cloth Cb.

The sewing system 1 manufactures a T-shirt as clothing. The first cloth Ca is a front body part of the T-shirt. The second cloth Cb is a rear body part of the T shirt. In the following description, the first cloth Ca is appropriately referred to as the front body part Ca, and the second cloth Cb is appropriately referred to as the rear body part Cb.

First Sewing Machine

The first sewing machine 21 is a label sewing machine that stitches up the rear body part Cb and a label L. The label L is a piece of the cloth. Information on clothing, such as size of clothing and type of fiber, or precautionary note on handling, is described on the label L. The label L is fed from a label feeder 8 to the first sewing machine 21 via a label conveyor 9.

The label feeder 8 feeds the label L. The label feeder 8 includes: a label accommodation member 84 in which a plurality of stacked labels L are accommodated; and a label transfer mechanism 85 for transferring the label L accommodated in the label accommodation member 84 to the label conveyor 9.

The label L includes a first label L1, a second label L2, and a third label L3. The label feeder 8 includes: a first label feeder 81 that feeds the first label L1; a second label feeder 82 that feeds the second label L2; and a third label feeder 83 that feeds the third label L3. The first label feeder 81, the second label feeder 82, and the third label feeder 83 are disposed in the X-axis direction.

The label conveyor 9 conveys the label L fed from the label feeder 8 to the first sewing machine 21. The label conveyor 9 includes: a clamp mechanism 91 that holds the label L; a guide mechanism 92 that guides the clamp mechanism 91 in the X-axis direction; and an actuator 93 that generates power for moving the clamp mechanism 91 in the X-axis direction. The clamp mechanism 91 sequentially receives the first label L1, the second label L2, and the third label L3 from each of the first label feeder 81, the second label feeder 82, and the third label feeder 83, and holds the labels. The clamp mechanism 91 holds the first label L1, the second label L2, and the third label L3 in a stacked state. The actuator 93 generates power for moving the clamp mechanism 91 that holds the first label L1, the second label L2, and the third label L3 in the X-axis direction. The clamp mechanism 91 is moved to the first sewing machine 21 while being guided by the guide mechanism 92 based on the power generated by the actuator 93. Accordingly, the first label L1, the second label L2, and the third label L3 are conveyed to the first sewing machine 21 in a stacked state.

The rear body part Cb is conveyed from the second cloth feeder 32 to the first sewing machine 21 by the cloth conveyor 4. The label L is conveyed from the label feeder 8 to first sewing machine 21 by the label conveyor 9. The first sewing machine 21 stitches up the rear body part Cb fed from the second cloth feeder 32 and the label L fed from the label feeder 8. The first sewing machine 21 stitches the label L to a target part RP of the rear body part Cb.

The first sewing machine 21 includes: a table 211 including an installation surface 211S on which the rear body part Cb is installed; and a head 212 that stitches up the rear body part Cb installed on the table 211 and the label L. The installation surface 211S includes an upper surface of the table 211. The installation surface 211S is substantially parallel to the XY plane. The cloth conveyor 4 conveys the rear body part Cb to the table 211.

The head 212 includes: a driving mechanism 214 that moves a needle 213 in a vertical direction; a first pressing member 215 that presses the rear body part Cb installed on the table 211 from above; and a second pressing member 216 that presses the label L from above. In a state where the rear body part Cb is pressed by the first pressing member 215 and the label L installed on the rear body part Cb is pressed by the second pressing member 216, as the needle 213 is moved in the vertical direction, the rear body part Cb and the label L are stitched up. In the following description, the position where the stitching is performed by the needle 213 will be appropriately referred to as a first stitch position PM1. The first stitch position PM1 includes a stitch point position where the needle 213 is lowered.

Second Sewing Machine

The second sewing machine 22 stitches up the front body part Ca and the rear body part Cb. The second sewing machine 22 is a shoulder matching sewing machine that stitches up a shoulder part K of the front body part Ca and a shoulder part K of the rear body part Cb.

The front body part Ca is conveyed from the first cloth feeder 31 to the second sewing machine 22 by the cloth conveyor 4. The rear body part Cb is conveyed from the first sewing machine 21 to the second sewing machine 22 by the cloth conveyor 4. The rear body part Cb is conveyed from the first sewing machine 21 to the second sewing machine 22 in a state where the label L is stitched. The second sewing machine 22 stitches up the front body part Ca fed from the first cloth feeder 31 and the rear body part Cb after being fed from the second sewing machine 22.

The second sewing machine 22 includes: a table 221 including an installation surface 221S on which the front body part Ca and the rear body part Cb are installed; and a head 222 that stitches up the front body part Ca and the rear body part Cb which are installed on the table 211. The installation surface 221S includes an upper surface of the table 221. The installation surface 221S is substantially parallel to the XY plane. The cloth conveyor 4 conveys each of the front body part Ca and the rear body part Cb to the table 221.

The head 222 includes: a driving mechanism 224 that moves a needle 223 in the vertical direction; and a pressing member 225 that presses the front body part Ca and the rear body part Cb which are installed on the table 221 from above. In a state where the front body part Ca and the rear body part Cb are pressed by the pressing member 225, the needle 223 moves in the vertical direction, and accordingly, the front body part Ca and the rear body part Cb are stitched up. In the following description, the position where the stitching is performed by the needle 223 will be appropriately referred to as a second stitch position PM2. The second stitch position PM2 includes a stitch point position where the needle 223 is lowered.

The second sewing machine 22 includes: a cloth pressing conveyor 230 that conveys the front body part Ca and the rear body part Cb on the table 221; a cloth pressing member 240 that presses and fixes the front body part Ca and the rear body part Cb which are installed on the table 221 from above; and a cloth position adjustment device 250 that adjusts the position of the front body part Ca installed on the table 221.

The cloth pressing conveyor 230 includes: a cloth pressing member 231 that presses the front body part Ca and the rear body part Cb which are installed on the table 221 from above; a slider 233 connected to the cloth pressing member 231 via an arm member 232; a guide member 234 that guides the slider 233 in the X-axis direction; and an actuator 235 that generates power for moving the slider 233 in the X-axis direction.

The cloth pressing member 240 includes a first cloth pressing member 240L and a second cloth pressing member 240R. The first cloth pressing member 240L and the second cloth pressing member 240R are disposed in the X-axis direction. The first cloth pressing member 240L is disposed to be closer to the head 222 side than the second cloth pressing member 240R.

The cloth pressing member 240 is supported on the table 221 via a supporter 241. The supporter 241 includes an actuator, such as an air cylinder, and supports the cloth pressing member 240 so as to be movable at least in the Z-axis direction. The supporter 241 may support the cloth pressing member 240 to be movable in at least one of the X-axis direction, the Y-axis direction, the θX direction, the θY direction, and the θZ direction. The supporter 241 includes a first supporter 241L that supports the first cloth pressing member 240L to be movable and a second supporter 241R that supports the second cloth pressing member 240R to be movable. The supporter 241 including the first supporter 241L and the second supporter 241R can move the first cloth pressing member 240L and the second cloth pressing member 240R, separately.

Figure 2:
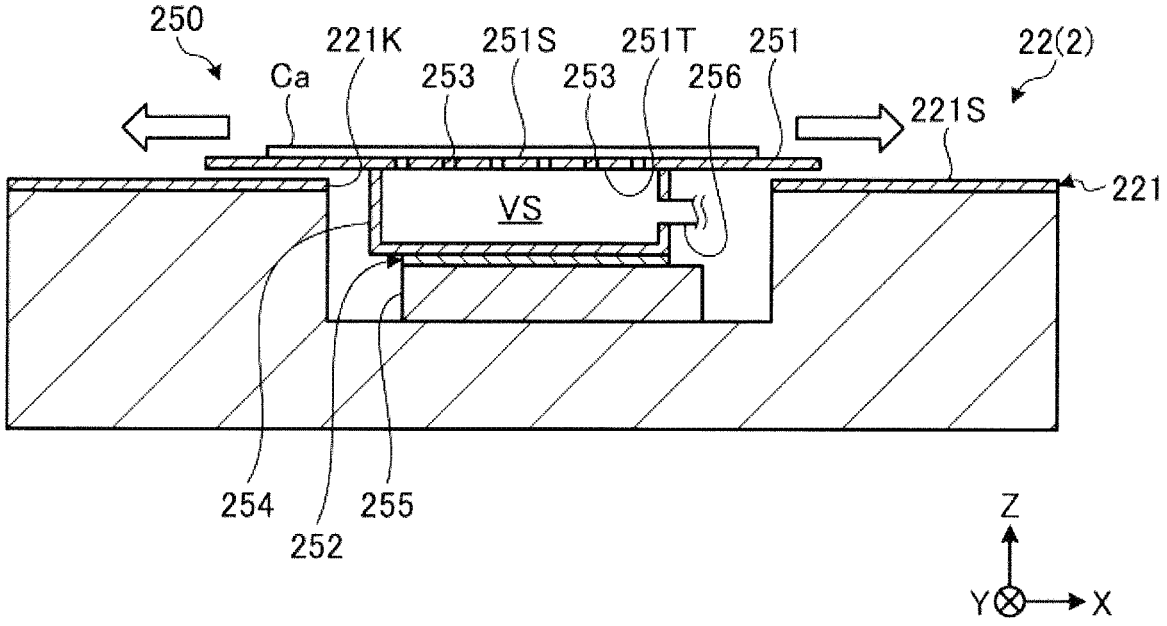
FIG. 2 is a side sectional view schematically illustrating a cloth position adjustment device according to the embodiment.
Figure 3:
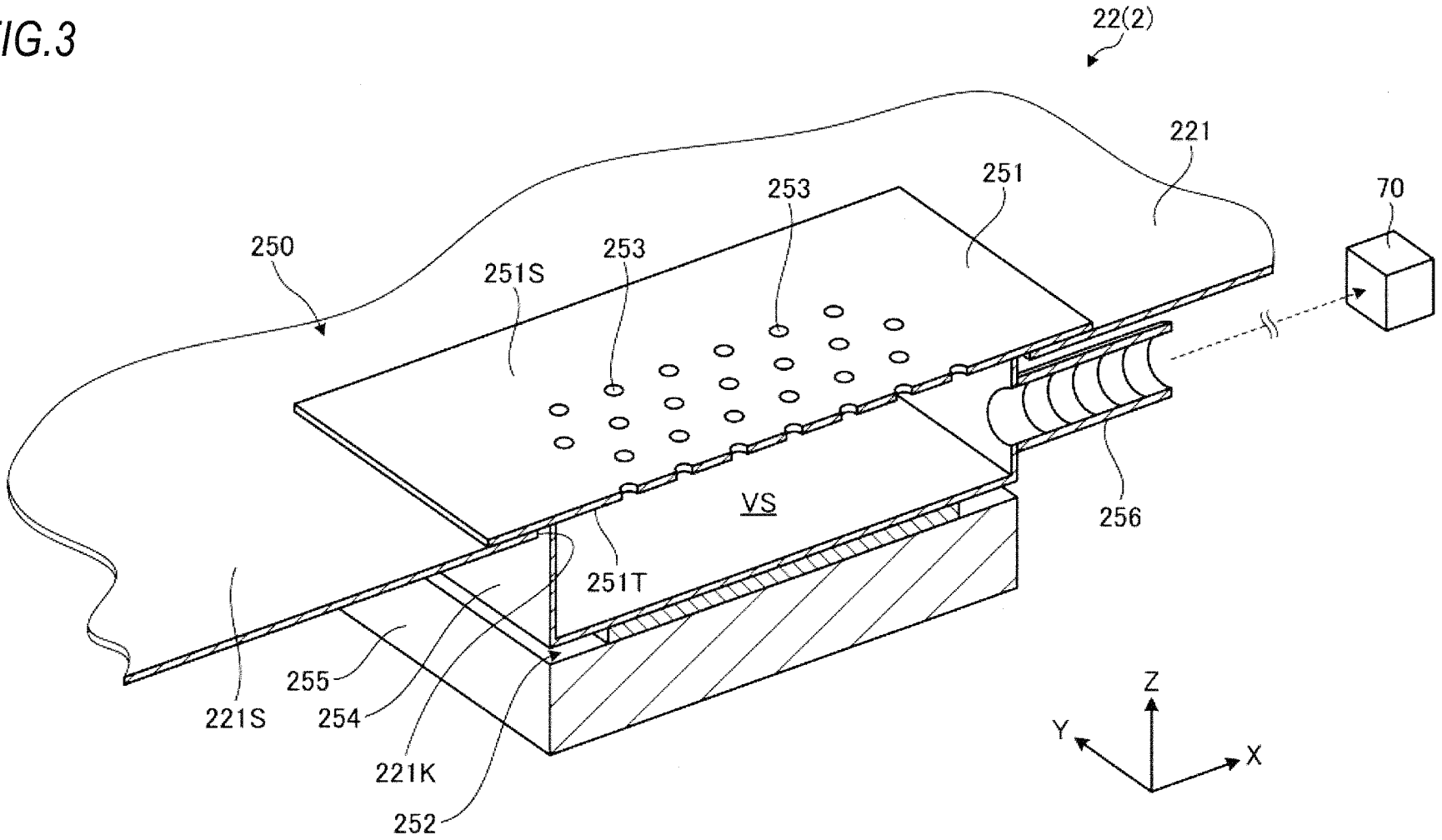
FIG. 3 is a perspective view in which a part of the cloth position adjustment device according to the embodiment is broken.

FIG. 2 is a side sectional view schematically illustrating the cloth position adjustment device 250 according to the embodiment. FIG. 3 is a perspective view in which a part of the cloth position adjustment device 250 according to the embodiment is broken. The table 221 of the second sewing machine 22 includes the installation surface 221S on which the cloth C is installed. The installation surface 221S includes an upper surface of the table 221. The installation surface 221S is substantially parallel to the XY plane.

The cloth position adjustment device 250 adjusts the position of at least a part of the front body part Ca installed on the table 221. The cloth position adjustment device 250 adjusts the position of a part of the front body part Ca in the XY plane.

The cloth position adjustment device 250 includes: a plate member 251 that is provided on the installation surface 221S of the table 221 and includes a holding surface 251S for holding the front body part Ca; and an actuator 252 that is provided on the inside of the table 221, moves the plate member 251 in a direction parallel to the installation surface 221S, and adjusts the position of the front body part Ca held on the plate member 251.

The holding surface 251S includes an upper surface of the plate member 251. The holding surface 251S is substantially parallel to the XY plane. The plate member 251 includes the holding surface 251S, a lower surface 251T that faces in a direction opposite to the holding surface 251S, and a suction hole 253 that penetrates the holding surface 251S and the lower surface 251T. In the direction parallel to the holding surface 251S, a plurality of suction holes 253 are provided on the plate member 251 with intervals therebetween. The holding surface 251S and the installation surface 221S are substantially parallel to each other.

The installation surface 221S of the table 221 includes an opening 221K. The plate member 251 is disposed so as to cover the opening 221K of the installation surface 221S. The installation surface 221S is disposed on the periphery of the holding surface 251S. An outer edge region of the lower surface 251T of the plate member 251 and a part of the installation surface 221S on the periphery of the opening 221K face each other.

The cloth position adjustment device 250 includes a supporting member 254 that supports the plate member 251. At least a part of the supporting member 254 is fixed to the lower surface 251T of the plate member 251. The supporting member 254 is supported by a base member 255. The supporting member 254 and the base member 255 are installed in an internal space of the table 221.

The base member 255 is fixed to at least a part of the table 221 in the internal space of the table 221. The base member 255 supports the supporting member 254 to be movable. The supporting member 254 is supported by the base member 255 to be movable in the XY plane. The supporting member 254 is supported on the base member 255 via a sliding mechanism including, for example, a ball or a roller. When the supporting member 254 is movable in the XY plane, the sliding mechanism may not include a ball or a roller. The actuator 252 generates power for moving the plate member 251. The actuator 252 is disposed between the supporting member 254 and the base member 255, for example. When the supporting member 254 is movable regarding the base member 255, the actuator 252 may not be disposed between the supporting member 254 and the base member 255. The actuator 252 moves the plate member 251 via the supporting member 254. By moving the supporting member 254, the actuator 252 moves the plate member 251 fixed to the supporting member 254 in the XY plane. The base member 255 functions as a stator, and the supporting member 254 functions as a mover. By the operation of the actuator 252, the plate member 251 moves in the XY plane parallel to the installation surface 221S.

The supporting member 254 forms a space VS with the lower surface 251T of the plate member 251. The space VS between the plate member 251 and the supporting member 254 is connected to a vacuum system 70 including a vacuum pump and a control valve. An opening formed at a part of the supporting member 254 and a tube member 256 are connected to each other. The tube member 256 is flexible. The vacuum system 70 and the space VS are connected to each other via the tube member 256.

When the space VS becomes a negative pressure by the operation of the vacuum system 70, at least a part of the gas on the holding surface 251S side of the plate member 251 is suctioned into the space VS via the suction hole 253. As illustrated in FIG. 2, as the vacuum system 70 is operated in a state where the front body part Ca is installed on the holding surface 251S, the front body part Ca is suctioned and held on the holding surface 251S.

The plate member 251 suctions and holds at least a part of the front body part Ca on the holding surface 251S. In a state where the front body part Ca is suctioned and held on the holding surface 251S, the actuator 252 is operated, and the position of the front body part Ca held on the plate member 251 is adjusted by the movement of the plate member 251. The cloth position adjustment device 250 adjusts the position of at least a part of the front body part Ca installed on the table 221. The cloth position adjustment device 250 adjusts the position of a part of the front body part Ca in the XY plane.

Cloth Feeder

The first cloth feeder 31 feeds the front body part Ca. As illustrated in FIG. 1, the first cloth feeder 31 includes: an accommodator 311 that accommodates the plurality of front body parts Ca therein; an installation table 312 on which the front body part Ca is installed; and a first pickup that holds one front body part Ca among the plurality of front body parts Ca accommodated in the accommodator 311 and installs the front body part Ca on the installation table 312. The plurality of front body parts Ca are stacked in the accommodator 311. The first pickup holds one front body part Ca disposed at the top among the plurality of stacked front body parts Ca, and conveys the front body part Ca to the installation table 312. The first pickup installs one front body part Ca on the installation table 312.

The second cloth feeder 32 feeds the rear body part Cb. As illustrated in FIG. 1, the second cloth feeder 32 includes: an accommodator 321 that accommodates the plurality of rear body parts Cb therein; an installation table 322 on which the rear body part Cb is installed; and a second pickup that holds one rear body part Cb among the plurality of rear body parts Cb accommodated in the accommodator 321 and installs the rear body part Cb on the installation table 312. The plurality of rear body parts Cb are stacked in the accommodator 321. The second pickup holds one rear body part Cb disposed at the top among the plurality of stacked rear body parts Cb, and conveys the rear body part Cb to the installation table 322. The second pickup installs one rear body part Cb on the installation table 322.

Figure 4:
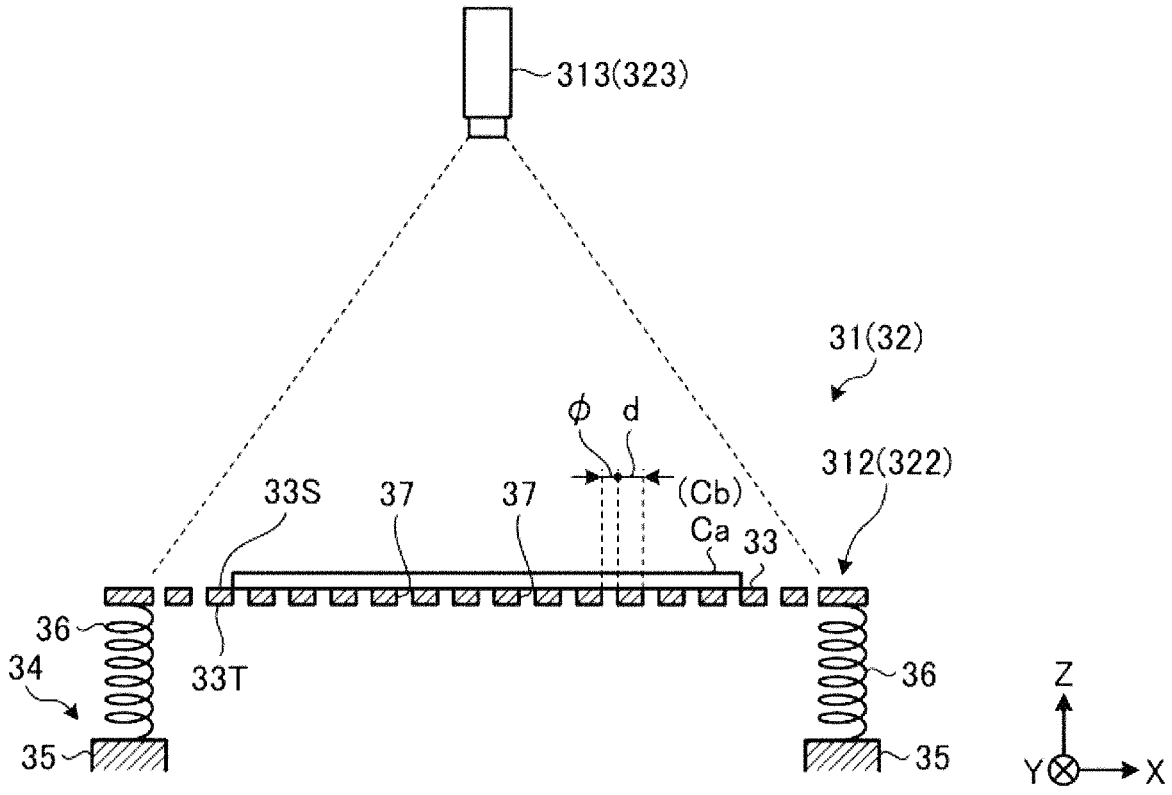
FIG. 4 is a side sectional view schematically illustrating the cloth position adjustment device according to the embodiment.

FIG. 4 is a side sectional view schematically illustrating the first cloth feeder 31 according to the embodiment. As illustrated in FIG. 4, the first cloth feeder 31 includes the installation table 312 on which the front body part Ca is installed. One front body part Ca is installed on the installation table 312. The installation table 312 includes: a plate member 33; and a supporter 34 that supports the plate member 33.

The plate member 33 includes: an upper surface 33S on which the front body part Ca is installed; a lower surface 33T that faces in the direction opposite to the upper surface 33S; and a hole 37 that penetrates the upper surface 33S and the lower surface 33T. The upper surface 33S and the lower surface 33T are parallel to each other. In the direction parallel to the upper surface 33S, the plurality of holes 37 are provided on the plate member 33 with intervals therebetween.

A diameter ϕ of the hole 37 is smaller than a distance d between the adjacent holes 37. The diameter of the hole 37 is determined to be equal to or less than 2 mm.

The supporter 34 supports the plate member 33 such that the upper surface 33S and the XY plane are parallel to each other. The supporter 34 supports the plate member 33 to be movable in at least one of the θX direction, the θY direction, and the Z-axis direction.

The supporter 34 includes a base member 35 and a spring 36 disposed between the base member 35 and the plate member 33. The upper end portion of the spring 36 is connected to the plate member 33. The lower end portion of the spring 36 is connected to the base member 35. In the XY plane, a plurality of springs 36 are disposed.

In a case where no external force acts on the plate member 33, the upper surface 33S of the plate member 33 and the XY plane are substantially parallel to each other. In a case where an external force acts on the plate member 33, the upper surface 33S of the plate member 33 moves in at least one of the θX direction, the θY direction, and the Z-axis direction.

In other words, the supporter 34 including the spring 36 has a floating function of supporting the plate member 33 to be capable of swinging. In a case where no external force acts on the plate member 33, the supporter 34 supports the plate member 33 such that the upper surface 33S of the plate member 33 and the XY plane are substantially parallel to each other. In a case where an external force acts on the plate member 33, the supporter 34 supports the plate member 33 such that the upper surface 33S of the plate member 33 moves in at least one of the θX direction, the θY direction, and the Z-axis direction.

The first cloth feeder 31 includes a detector 313 that detects an edge of the front body part Ca installed on the plate member 33 of the installation table 312. The detector 313 detects the position of the edge of the front body part Ca in the XY plane.

The detector 313 includes an imaging device that acquires an optical image of the front body part Ca as image data. The detector 313 includes an optical system and an image sensor that receives light that passed through the optical system. The image sensor includes a couple charged device (CCD) image sensor or a complementary metal oxide semiconductor (CMOS) image sensor. The detector 313 is provided on the installation table 312. The detector 313 acquires the image data of the front body part Ca installed on the installation table 312, from above the front body part Ca.

The entire front body part Ca is disposed in an imaging region of the detector 313. The imaging region of the detector 313 includes a field of view region of the optical system of the detector 313. The imaging region of the detector 313 is sufficiently large to fit the entire front body part Ca. The detector 313 can collectively acquire the image data of the entire front body part Ca.

The second cloth feeder 32 includes the installation table 322 on which the rear body part Cb is installed and a detector 323 that detects an edge of the rear body part Cb installed on the installation table 312. The structure of the installation table 213 of the first cloth feeder 31 and the structure of the installation table 322 of the second cloth feeder 32 are substantially the same as each other. The description of the installation table 322 will be omitted.

The detector 323 of the second cloth feeder 32 detects the edge of the rear body part Cb installed on the plate member 33 of the installation table 322. The detector 323 detects the position of the edge of the rear body part Cb in the XY plane.

The detector 323 includes an imaging device that acquires an optical image of the rear body part Cb as image data. The detector 323 includes an optical system and an image sensor that receives light that passed through the optical system. The image sensor includes a couple charged device (CCD) image sensor or a complementary metal oxide semiconductor (CMOS) image sensor. The detector 323 is provided on the installation table 322. The detector 323 acquires the image data of the rear body part Cb installed on the installation table 322, from above the rear body part Cb.

The entire rear body part Cb is disposed in an imaging region of the detector 323. The imaging region of the detector 323 includes a field of view region of the optical system of the detector 323. The imaging region of the detector 323 is sufficiently large to fit the entire rear body part Cb. The detector 323 can collectively acquire the image data of the entire rear body part Cb.

Cloth Conveyor

As illustrated in FIG. 1, the cloth conveyor 4 includes the robot 5 supported by the base member 7 to be movable and the conveying member 6 held by the robot 5. The robot 5 is a horizontal articulated robot (selective compliance assembly robot arm (SCARA)). The robot 5 includes an arm 51 that holds the conveying member 6. The robot 5 is movable in four directions of the X-axis direction, the Y-axis direction, the Z-axis direction, and the θZ-axis direction. The conveying member 6 is movable in four directions of the X-axis direction, the Y-axis direction, the Z-axis direction, and the θZ-axis direction in a state of being held by the arm 51 of the robot 5.

The cloth conveyor 4 suctions and holds the cloth C from above using the conveying member 6. The conveying member 6 is connected to the vacuum system 70, and suctions and holds the cloth C from above.

The robot 5 is movable on the base member 7. The robot 5 can move the conveying member 6 to a first feeding position PF1 that faces the installation table 312 of the first cloth feeder 31, a second feeding position PF2 that faces the installation table 322 of the second cloth feeder 32, a first sewing machine position PH1 that faces the table 211 of the first sewing machine 21, and a second sewing machine position PH2 that faces the table 221 of the second sewing machine 22, respectively. The first feeding position PF1, the second feeding position PF2, the first sewing machine position PH1 and the second sewing machine position PH2 are positions different from each other in the XY plane. The conveying member 6 is movable on the installation table 312, on the installation table 322, on the table 211, and on the table 221, respectively.

The cloth conveyor 4 conveys the front body part Ca from the installation table 312 to the second sewing machine 22. The cloth conveyor 4 conveys the rear body part Cb from the installation table 322 to the second sewing machine 21. The cloth conveyor 4 conveys the rear body part Cb from the first sewing machine 21 to the second sewing machine 22.

Figure 5:
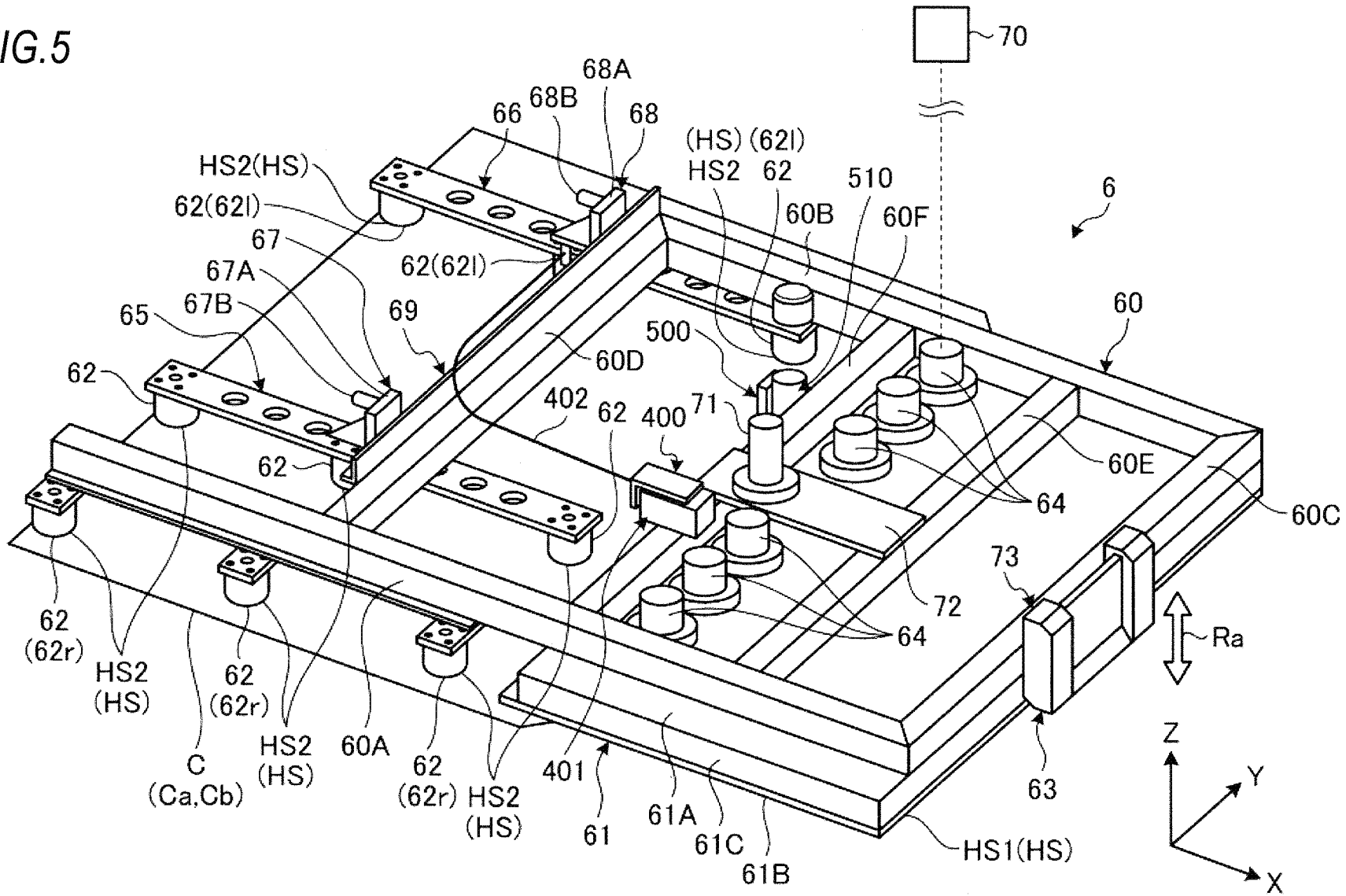
FIG. 5 is a perspective view illustrating a conveying member according to the embodiment.
Figure 6:
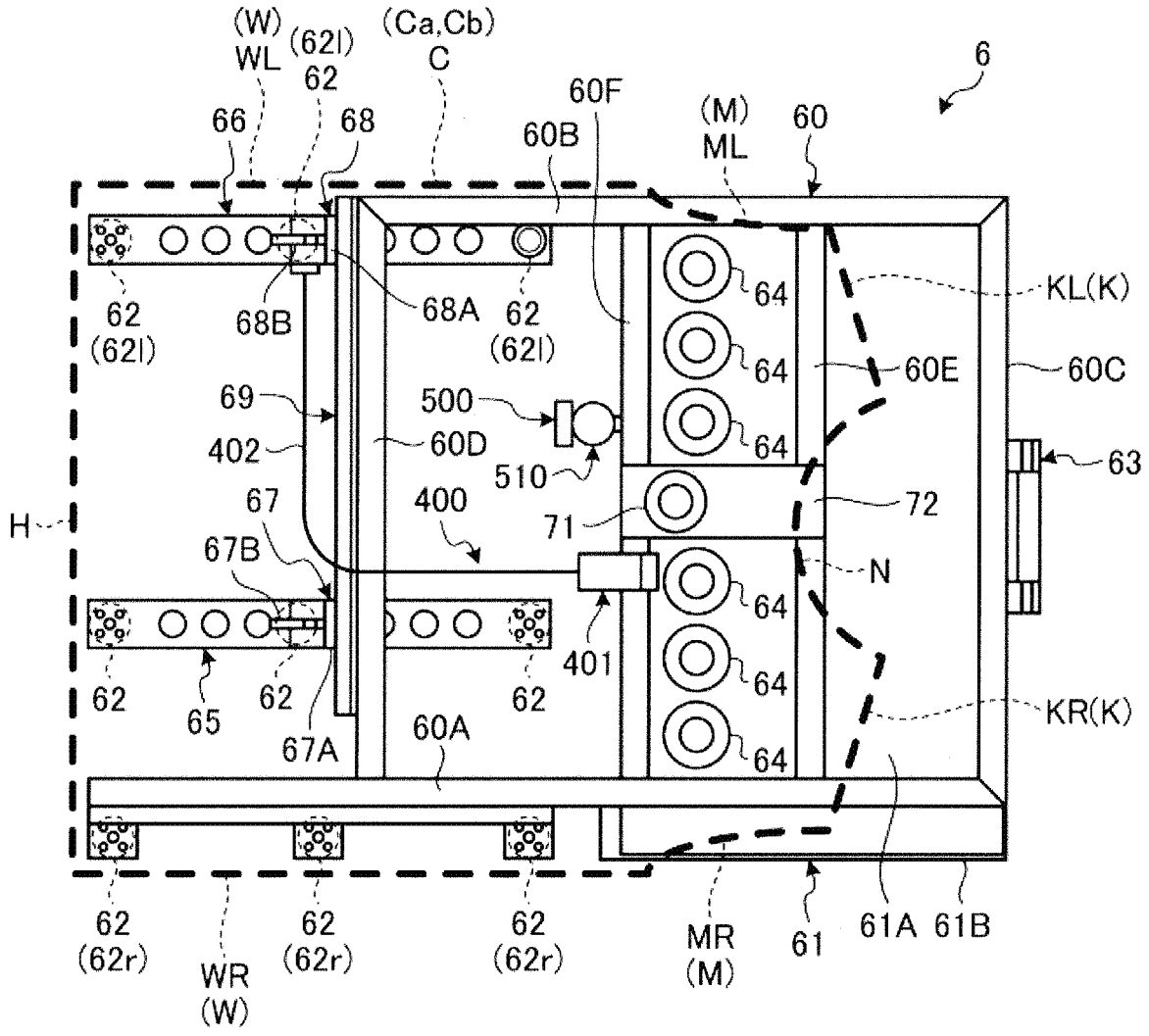
FIG. 6 is a plan view illustrating the conveying member according to the embodiment.

FIG. 5 is a perspective view illustrating the conveying member 6 according to the embodiment. FIG. 6 is a plan view illustrating the conveying member 6 according to the embodiment.

As illustrated in FIGS. 5 and 6, the conveying member 6 includes a main body member 60, a connecting member 71 connected to the robot 5, and a holding member 61 and a holding member 62 that hold the cloth C.

The conveying member 6 includes a plurality of suction surfaces HS for suctioning and holding the cloth C from above. The suction surface HS includes the lower surface of the conveying member 6. The suction surface HS is substantially parallel to the XY plane.

The holding member 61 suctions and holds the cloth C from above. The holding member 62 suctions and holds the cloth C from above. The suction surface HS includes a suction surface HS1 provided in the holding member 61 and a suction surface HS2 provided in the holding member 62.

The suction surface HS includes the lower surface of the holding member 6. The suction surface HS1 is substantially parallel to the XY plane. In the XY plane, the outer shape of the suction surface HS1 is a quadrilateral shape. The suction surface HS2 includes the lower surface of the holding member 6. The suction surface HS2 is substantially parallel to the XY plane. In the XY plane, the outer shape of the suction surface HS2 is a circular shape. The suction surface HS1 and the suction surface HS2 are disposed in the same plane. The suction surface HS1 of the holding member 61 is greater than the suction surface HS2 of the holding member 62.

The main body member 60 supports the holding member 61 and the holding member 62. The main body member 60 is a frame-like member. The main body member 60 includes a first member 60A, a second member 60B, a third member 60C, and a fourth member 60D. Each of the first member 60A, the second member 60B, the third member 60C, and the fourth member 60D is a bar-like member. The first member 60A and the second member 60B are disposed to be substantially parallel to each other. The third member 60C and the fourth member 60D are disposed to be substantially parallel to each other.

The first member 60A is longer than the second member 60B. The third member 60C is connected to each of one end portion of the first member 60A and one end portion of the second member 60B. The fourth member 60D is connected to each of an intermediate portion of the first member 60A and the other end portion of the second member 60B. The third member 60C is orthogonal to each of the first member 60A and the second member 60B. The fourth member 60D is orthogonal to each of the first member 60A and the second member 60B.

The main body member 60 includes a fifth member 60E and a sixth member 60F. Each of the fifth member 60E and the sixth member 60F is a bar-like member.

The fifth member 60E and the sixth member 60F are disposed between the third member 60C and the fourth member 60D. The third member 60C, the fourth member 60D, the fifth member 60E and the sixth member 60F are disposed to be substantially parallel to each other. One end portion of the fifth member 60E is connected to the first member 60A. The other end portion of the fifth member 60E is connected to the second member 60B. One end portion of the sixth member 60F is connected to the first member 60A. The other end portion of the sixth member 60F is connected to the second member 60B. The fifth member 60E is disposed at a position closer to the third member 60C than the sixth member 60F.

The connecting member 71 is supported by a plate member 72 fixed to the fifth member 60E and the sixth member 60F. The main body member 60 is connected to the robot 5 via the connecting member 71 and the plate member 72. The robot 5 moves the main body member 60. The connecting member 71 is a columnar member. In the longitudinal direction of the fifth member 60E and the sixth member 60F, the connecting member 71 is fixed to the center portion of the fifth member 60E and the central portion of the sixth member 60F.

The holding member 61 is a box-like member including an internal space. The holding member 61 includes an upper plate 61A, a lower plate 61B, and a side plate 61C disposed between the upper plate 61A and the lower plate 61B.

The upper plate 61A is connected to a part of the first member 60A, a part of the second member 60B, the third member 60C, the fifth member 60E, and the sixth member 60F, respectively. The lower plate 61B includes the suction surface HS1 that can face the cloth C. The suction surface HS1 is the lower surface of the lower plate 61B. The side plate 61C is a frame-like plate member and is connected to each of the upper plate 61A and the lower plate 61B. The internal space of the holding member 61 is defined by the upper plate 61A, the lower plate 61B, and the side plate 61C.

The lower plate 61B includes a plurality of suction ports. The suction port includes a through-hole that penetrates the suction surface HS1 and the upper surface of the lower plate 61B. In other words, the lower plate 61B is a perforated plate. The through-hole connects the internal space and the external space of the holding member 61 to each other. A plurality of suction ports are disposed with a certain interval on the lower surface of the lower plate 61B.

The conveying member 6 includes a connector 64 connected to the vacuum system 70. A plurality of connectors 64 are provided on the upper plate 61A. The connector 64 is connected to the internal space of the holding member 61. When the vacuum system 70 operates, the gas in the internal space of the holding member 61 is suctioned into the vacuum system 70 via the connector 64. As the vacuum system 70 operates in a state where the suction surface HS1 of the lower plate 61B is in contact with the cloth C, the holding member 61 can suction and hold the cloth C from above on the suction surface HS1.

A plurality of holding members 62 are provided. Each of the plurality of holding members 62 includes a suction surface HS2 that can face the cloth C.

The holding member 62 includes a suction port provided on the suction surface HS2. The suction port of the holding member 62 is connected to the vacuum system 70. As the vacuum system 70 operates in a state where the suction surface HS2 of the holding member 62 is in contact with the cloth C, the holding member 62 can suction and hold the cloth C from above on the suction surface HS2.

A part of the first member 60A protrudes from the fourth member 60D. The conveying member 6 includes a first supporting member 65 and a second supporting member 66 that are supported by the fourth member 60D. Each of the first supporting member 65 and the second supporting member 66 is a bar-like member. The first member 60A, the first supporting member 65, and the second supporting member 66 are disposed to be substantially parallel to each other. The main body member 60 movably supports each of the first supporting member 65 and the second supporting member 66.

The first member 60A that protrudes from the fourth member 60D supports the plurality of holding members 62. The first supporting member 65 supports the plurality of holding members 62. The second supporting member 66 supports the plurality of holding members 62. Three holding members 62 are provided with intervals in the longitudinal direction of the first member 60A. Three holding members 62 are provided with intervals in the longitudinal direction of the first supporting member 65. Three holding members 62 are provided with intervals in the longitudinal direction of the second supporting member 65. In other words, nine holding members 62 are provided.

As illustrated in FIG. 6, the cloth C including the front body part Ca and the rear body part Cb includes two shoulder parts K, two side parts W, two sleeve parts M, one hem part H, and one neck parts N. The shoulder part K includes a right shoulder part KR and a left shoulder part KL. The side part W includes a right side part WR and a left side part WL. The sleeve part M includes a right sleeve part MR and a left sleeve part ML.

The upper portion of the cloth C including the shoulder part K, the neck part N, and the sleeve part M is suctioned and held by the holding member 61. The suction surface HS1 of the holding member 61 is sufficiently large, and it is possible to integrally suction and hold the entire shoulder part K. The conveying member 6 can stably hold the upper portion of the cloth C while reducing the positional deviation of the shoulder part K using the holding member 61.

The lower portion of the cloth C including the side part W and the hem part H is suctioned and held by the holding member 62. The weight of the holding member 62 is sufficiently smaller than the weight of the holding member 61. Each of the first member 60A, the first supporting member 65, and the second supporting member 66 that hold the holding member 62 is a bar-like member and is lightweight. Accordingly, weight reduction of the conveying member 6 is achieved.

The cloth conveyor 4 includes a rough movement mechanism 67 that connects the first supporting member 65 and the main body member 60 to each other; and a rough movement mechanism 68 that connects the second supporting member 66 and the main body member 60 to each other via at least a part of a fine movement device 400.

The rough movement mechanism 67 is movable regarding the main body member 60. The rough movement mechanism 67 is connected to the first supporting member 65. The rough movement mechanism 67 includes a sliding member 67A guided by a guide mechanism 69 provided in the fourth member 60D and a fixing pin 67B for fixing the sliding member 67A to the fourth member 60D. The guide mechanism 69 guides the sliding member 67A in the longitudinal direction of the fourth member 60D. The first supporting member 65 is connected to the sliding member 67A. As the sliding member 67A moves while being guided by the guide mechanism 69, the first supporting member 65 moves in the longitudinal direction of the fourth member 60D together with the sliding member 67A.

The fourth member 60D includes a plurality of fixing holes. A plurality of fixing holes are provided with intervals in the longitudinal direction of the fourth member 60D. The sliding member 67A includes an insertion hole into which the fixing pin 67B is inserted. By inserting the fixing pin 67B into the insertion hole of the sliding member 67A and the fixing hole of the fourth member 60D, the sliding member 67A and the fourth member 60D are fixed. When the sliding member 67A and the fourth member 60D are fixed, the position of the first supporting member 65 in the longitudinal direction of the fourth member 60D is fixed. By removing the fixing pin 67B from the insertion hole of the sliding member 67A and the fixing hole of the fourth member 60D, the fixed state of the sliding member 67A and the fourth member 60D is released. When the fixed state of the sliding member 67A and the fourth member 60D is released, the first supporting member 65 is movable in the longitudinal direction of the fourth member 60D while being guided by the guide mechanism 69. An operator can position the first supporting member 65 in the longitudinal direction of the fourth member 60D by operating the rough movement mechanism 67.

The rough movement mechanism 68 is movable regarding the main body member 60. The rough movement mechanism 68 is connected to the second supporting member 66 via at least a part of the fine movement device 400. The rough movement mechanism 68 includes a sliding member 68A guided by a guide mechanism 69 provided in the fourth member 60D and a fixing pin 68B for fixing the sliding member 68A to the fourth member 60D. The guide mechanism 69 guides the sliding member 68A in the longitudinal direction of the fourth member 60D. The second supporting member 66 is connected to the sliding member 68A via at least a part of the fine movement device 400. As the sliding member 68A moves while being guided by the guide mechanism 69, the second supporting member 66 moves in the longitudinal direction of the fourth member 60D together with the sliding member 68A.

The sliding member 68A includes an insertion hole into which the fixing pin 68B is inserted. By inserting the fixing pin 68B into the insertion hole of the sliding member 68A and the fixing hole of the fourth member 60D, the sliding member 68A and the fourth member 60D are fixed. When the sliding member 68A and the fourth member 60D are fixed, the position of the second supporting member 66 in the longitudinal direction of the fourth member 60D is fixed. By removing the fixing pin 68B from the insertion hole of the sliding member 68A and the fixing hole of the fourth member 60D, the fixed state of the sliding member 68A and the fourth member 60D is released. When the fixed state of the sliding member 68A and the fourth member 60D is released, the second supporting member 66 is movable in the longitudinal direction of the fourth member 60D while being guided by the guide mechanism 69. An operator can position the second supporting member 66 in the longitudinal direction of the fourth member 60D by operating the rough movement mechanism 68.

As the first supporting member 65 is moved in the longitudinal direction of the fourth member 60D, the position of the holding member 62 supported by the first supporting member 65 is adjusted. The holding member 62 supported by the first supporting member 65 is movable regarding the main body member 60.

As the second supporting member 66 is moved in the longitudinal direction of the fourth member 60D, the position of the holding member 62 supported by the second supporting member 66 is adjusted. The holding member 62 supported by the second supporting member 66 is movable regarding the main body member 60.

The relative position between the holding member 62 supported by the first member 60A and the main body member 60 is fixed. The relative position between the holding member 62 supported by the first supporting member 65 and the main body member 60 is changeable. The relative position between the holding member 62 supported by the second supporting member 66 and the main body member 60 is changeable. The plurality of holding members 62 supported by the first member 60A move together with the main body member 60. The main body member 60 movably supports the first supporting member 65 that supports the holding member 62 and movably supports the second supporting member 66 that supports the holding member 62. For example, as the first supporting member 65 and the second supporting member 66 move according to the size of the cloth C, a holding position HP2 of the cloth C by the holding member 62 is adjusted.

Figure 7:
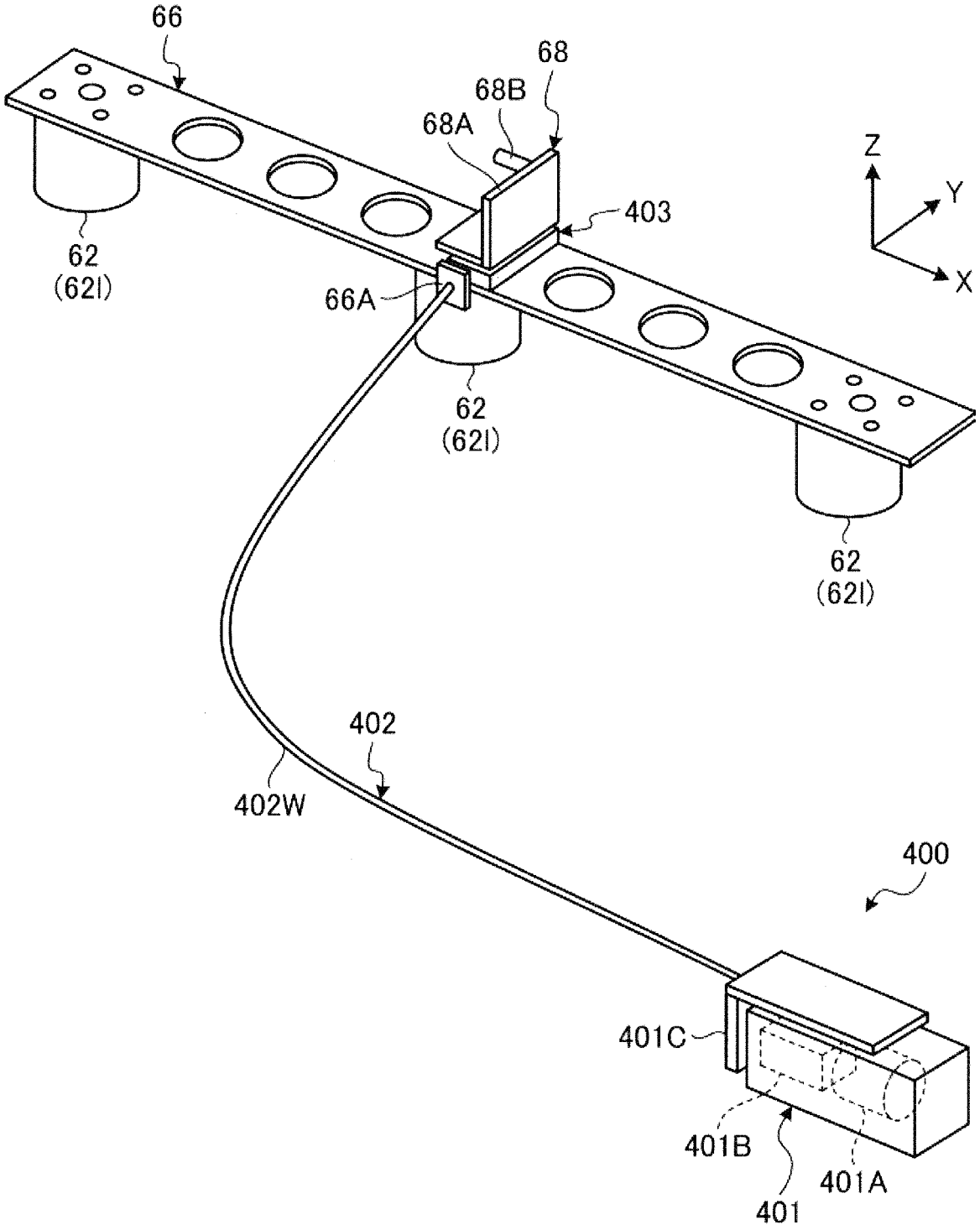
FIG. 7 is a perspective view illustrating a fine movement device according to the embodiment.

FIG. 7 is a perspective view illustrating the fine movement device 400 according to the embodiment. The fine movement device 400 moves the second supporting member 66 in the longitudinal direction of the fourth member 60D with a resolution higher than that of the rough movement mechanism 68. At least a part of the fine movement device 400 is disposed between the second supporting member 66 and the sliding member 68A. The fine movement device 400 moves the second supporting member 66 regarding the sliding member 68A.

As illustrated in FIGS. 5, 6, and 7, the fine movement device 400 includes a power generator 401 that generates power for moving the second supporting member 66 regarding the sliding member 68A and a power transmission mechanism 402 that transmits the power generated by the power generator 401 to the second supporting member 66.

The power generator 401 is supported by the main body member 60. The power generator 401 is supported by the sixth member 60. The power generator 401 is disposed in the vicinity of the connecting member 71. In the XY plane, the distance between the connecting member 71 and the power generator 401 is shorter than the distance between the connecting member 71 and the holding member 62.

The power generator 401 includes: a motor 401A; a ball screw mechanism 401B operated by rotation of the motor 401A; and a movable member 401C that is movable by the operation of the ball screw mechanism 401B.

The power transmission mechanism 402 includes: a wire member 402W that connects the power generator 401 and the second supporting member 66 to each other. One end portion of the wire member 402W is fixed to the movable member 401C. The other end portion of the wire member 402W is fixed to the second supporting member 66. A bracket 66A is fixed to the second supporting member 66. The other end portion of the wire member 402W is fixed to the bracket 66A.

The second supporting member 66 is connected to the sliding member 68A via a sliding mechanism 403. By the sliding mechanism 403, the second supporting member 66 can finely move in the longitudinal direction of the fourth member 40D regarding the sliding member 68A. The sliding mechanism 403 includes a spring that generates a force for moving the second supporting member 66 in the +Y direction. The movable distance of the second supporting member 66 relative to the sliding member 68A is approximately 50 mm.

In FIG. 7, as the motor 401A is driven, the movable member 401C moves in one of the +X direction and the −X direction. When the movable member 401C moves in the +X direction and pulls the wire member 402W, the second supporting member 66 moves in the −Y direction regarding the sliding member 68A. When the movable member 401C moves in the −X direction, the second supporting member 66 moves in the +Y direction regarding the sliding member 68A by the action of the spring of the sliding mechanism 403. When the second supporting member 66 moves in the Y-axis direction regarding the sliding member 68A, the holding member 62 supported by the second supporting member 66 moves in the Y-axis direction regarding the main body member 60. In this manner, the power generator 401 generates power for moving the holding member 62 supported by the second supporting member 66 regarding the main body member 60. The power transmission mechanism 402 transmits the power generated by the power generator 401 to the holding member 62 via the second supporting member 66.

As illustrated in FIGS. 5 and 6, the cloth conveyor 4 includes a movable member 63 that is movable regarding the conveying member 6. The movable member 63 is supported to be movable by the conveying member 6. The movable member 63 is supported to be movable by the third member 60C. In the longitudinal direction of the third member 60C, the dimension of the movable member 63 is smaller than the dimension of the third member 60C. As indicated by the arrow Ra in FIG. 5, the movable member 63 is movable in the vertical direction orthogonal to the suction surface HS. The movable member 63 is movable regarding the suction surface HS of the conveying member 6.

The conveying member 6 includes an actuator 73 that generates power for moving the movable member 63 in the vertical direction. The actuator 73 includes, for example, an air cylinder. The movable member 63 is movable in the vertical direction by the operation of the actuator 73.

Figure 8A:
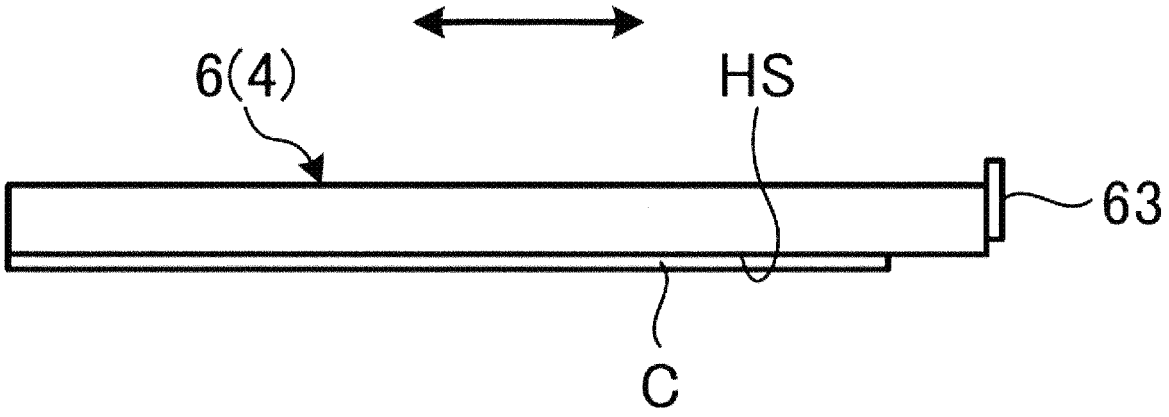
FIGS. 8A and 8B are views schematically illustrating an operation of a movable member according to the embodiment.
Figure 8B:
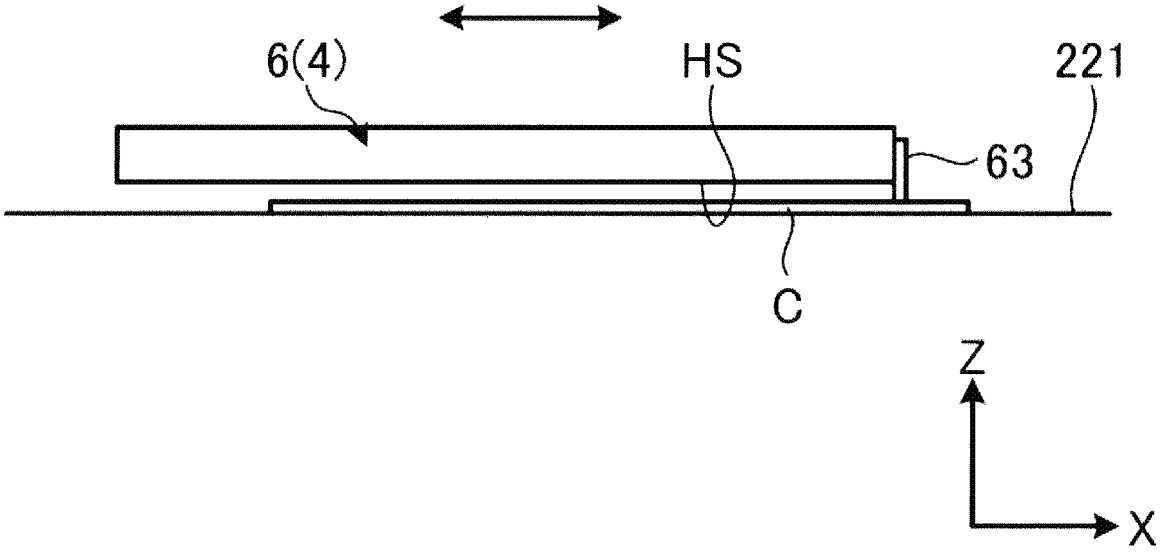

FIGS. 8A and 8B are views schematically illustrating an operation of the movable member 63 according to the embodiment. As illustrated in FIG. 8A, when the movable member 63 is disposed in the upper end portion of the movable range of the movable member 63 in the vertical direction, the lower end portion of the movable member 63 is disposed above the suction surface HS of the conveying member 6. In other words, when the movable member 63 is disposed in the upper end portion of the movable range, the lower end portion of the movable member 63 does not protrude downward from the suction surface HS of the conveying member 6.

As illustrated in FIG. 8B, in the movable range of the movable member 63 in the vertical direction, when the movable member 63 is disposed in the lower end portion of the movable range, the lower end portion of the movable member 63 is disposed below the suction surface HS of the conveying member 6. In other words, when the movable member 63 is disposed in the lower end portion of the movable range, the lower end portion of the movable member 63 protrudes downward from the suction surface HS of the conveying member 6.

As illustrated in FIG. 8A, when the cloth C is suctioned and held by the suction surface HS, the lower end portion of the movable member 63 is disposed above the suction surface HS of the conveying member 6. As illustrated in FIG. 8B, in a state where the cloth C is suctioned and held on the suction surface HS, the lower end portion of the movable member 63 disposed below the suction surface HS of the conveying member 6 can come into contact with the cloth C.

As illustrated in FIG. 5 and FIG. 6, the cloth conveyor 4 includes a gripper 500 that pinches the cloth C. The gripper 500 is movable in the Z-axis direction orthogonal to the upper surface of the installation table 312 and the upper surface of the installation table 322 on which the cloth C is installed. As described with reference to FIG. 4, the upper surface of the installation table 312 and the upper surface of the installation table 322 include the upper surface 33S of the plate member 33.

Figure 9:
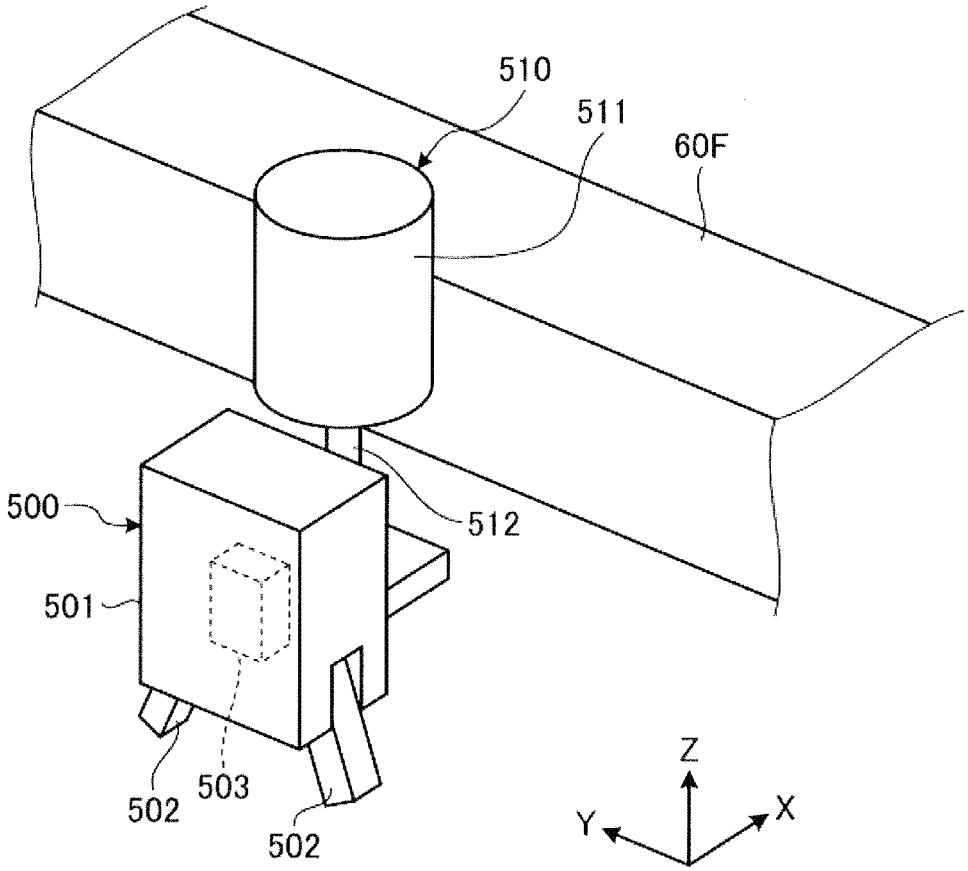
FIG. 9 is a perspective view illustrating a gripper according to the embodiment.
Figure 10:
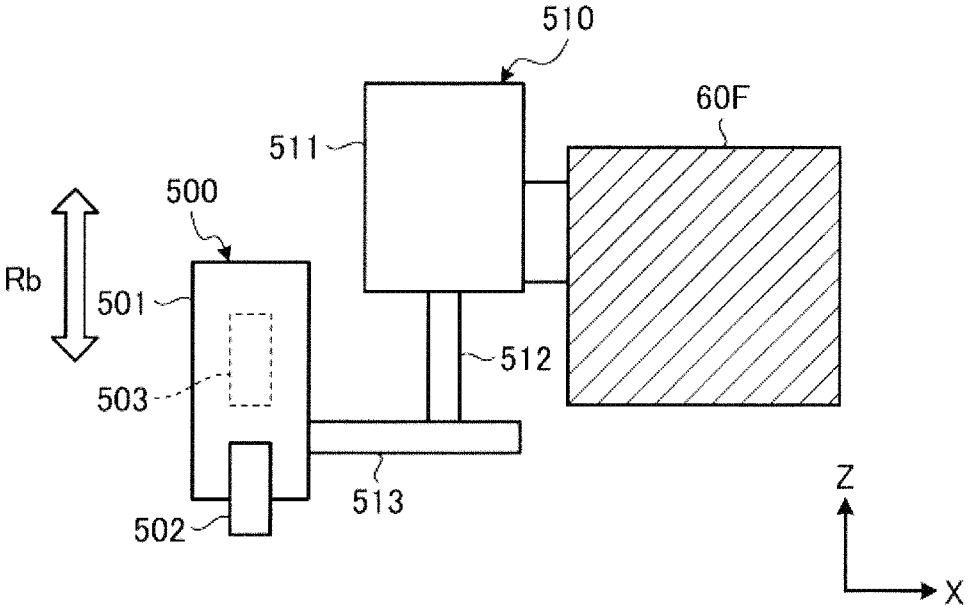
FIG. 10 is a side view illustrating the gripper according to the embodiment.

FIG. 9 is a perspective view illustrating the gripper 500 according to the embodiment. FIG. 10 is a side view illustrating the gripper 500 according to the embodiment. The gripper 500 includes: a main body member 501; a pair of gripping members 502 movably supported by the main body member 501; and an actuator 503 that is disposed inside the main body member 501, and generates power for moving the gripping member 502.

The actuator 503 can move the gripping member 502 such that the lower end portions of the pair of gripping members 502 approach to or are separated from each other.

The cloth conveyor 4 includes an actuator 510 that moves the main body member 501 in the vertical direction. The actuator 510 includes, for example, an air cylinder, and can move the main body member 501 in the vertical direction. A stator 511 of the actuator 510 is fixed to the sixth member 60F. A mover 512 of the actuator 510 is connected to the main body member 501 via a connecting member 513. By the operation of the actuator 510, as indicated by the arrow Rb in FIG. 10, the gripper 500 can move in the vertical direction orthogonal to the upper surface of the installation table 312 and the upper surface of the installation table 322. The gripper 500 is movable regarding the suction surface HS of the conveying member 6.

Figure 11A:
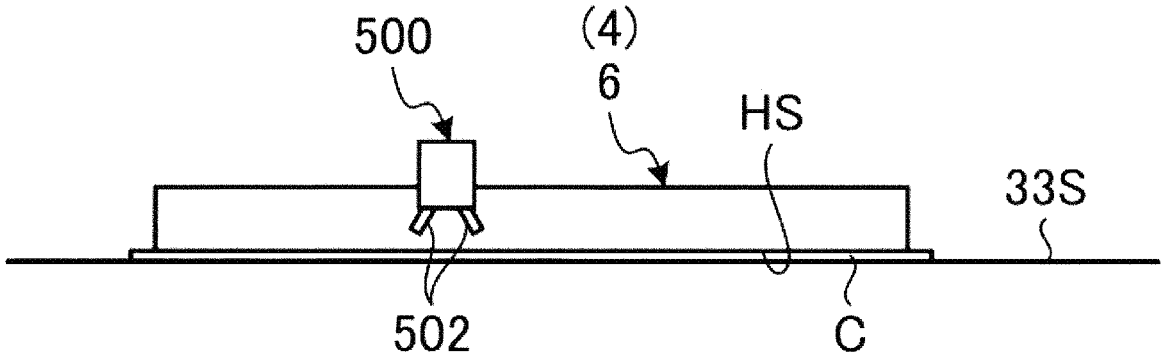
FIGS. 11A and 11B are views schematically illustrating an operation of the gripper according to the embodiment.
Figure 11B:
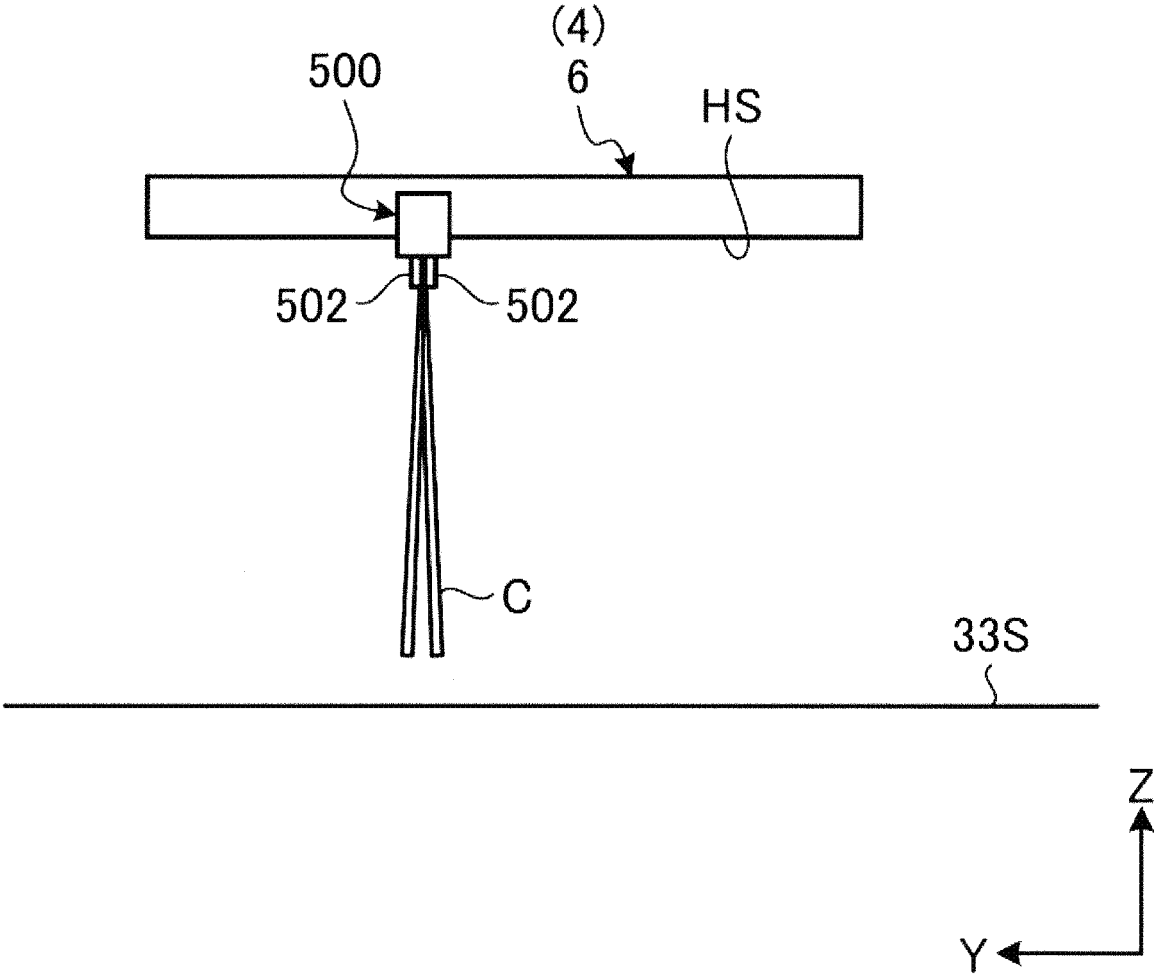

FIGS. 11A and 11B are side views schematically illustrating an operation of the gripper 500 according to the embodiment. As illustrated in FIG. 11A, in the movable range of the gripper 500 in the vertical direction, when the gripper 500 is disposed in the upper end portion of the movable range, the lower end portion of the gripper 500 is disposed above the suction surface HS of the conveying member 6. In other words, when the gripper 500 is disposed in the upper end portion of the movable range, the lower end portion of the gripping member 502 does not protrude downward from the suction surface HS of the conveying member 6.

As illustrated in FIG. 11B, in the movable range of the gripper 500 in the vertical direction, when the gripper 500 is disposed in the lower end portion of the movable range, the lower end portion of the gripper 500 is disposed below the suction surface HS of the conveying member 6. In other words, when the gripper 500 is disposed in the lower end portion of the movable range, the lower end portion of the gripping member 502 protrudes downward from the suction surface HS of the conveying member 6.

As illustrated in FIG. 11A, when the cloth C is suctioned and held by the suction surface HS, the lower end portion of the gripping member 502 is disposed above the suction surface HS of the conveying member 6. In a state where the cloth C is not suctioned and held on the suction surface HS, the lower end portion of the gripping member 502 disposed below the suction surface HS of the conveying member 6 can come into contact the cloth C. As illustrated in FIG. 11B, the gripper 500 can pinch a part of the cloth C installed on the upper surface 33S of the plate member 33 using the gripping member 502. The cloth conveyor 4 can convey the cloth C in a state where the cloth C is pinched by the gripper 500.

Controller

Figure 12:
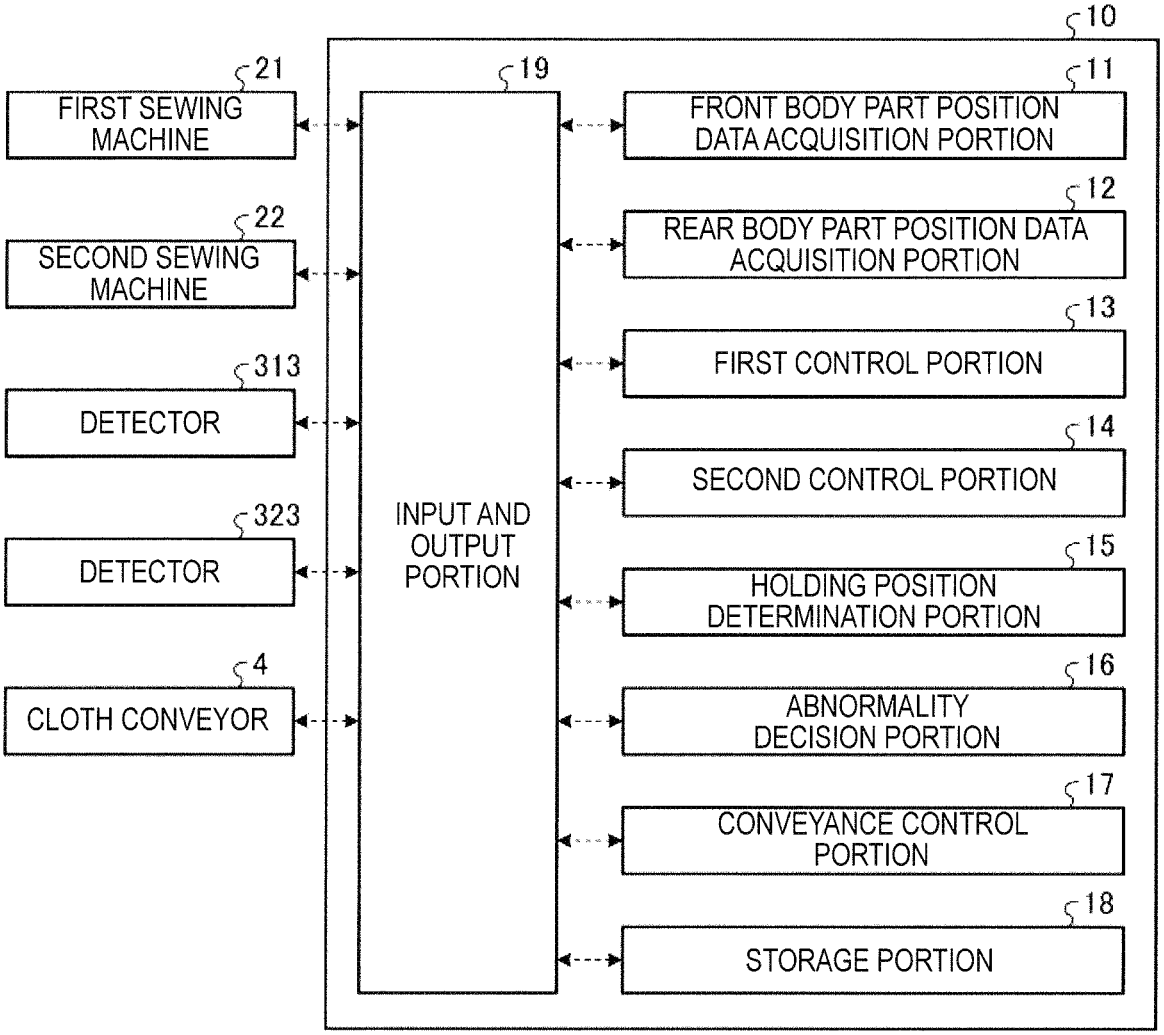
FIG. 12 is a functional block diagram illustrating a controller of the sewing system according to the embodiment.

FIG. 12 is a functional block diagram illustrating a controller 10 of the sewing system 1 according to the embodiment. The sewing system 1 includes the controller 10. The controller 10 includes a computer system and controls the sewing system 1. The controller 10 includes an arithmetic processing unit including a processor, such as a central processing unit (CPU) and a storage device including a memory, such as a read only memory (ROM) or a random access memory (RAM) and a storage. The arithmetic processing unit performs arithmetic processing according to a computer program stored in the storage device.

As illustrated in FIG. 12, the controller 10 is connected to each of the first sewing machine 21, the second sewing machine 22, the detector 313 disposed in the first cloth feeder 31, the detector 323 disposed in the second cloth feeder 32, and the cloth conveyor 4.

The controller 10 includes: a front body part position data acquisition portion 11 that acquires position data of the front body part Ca; a rear body part position data acquisition portion 12 that acquires position data of the rear body part Cb; a first control portion 13 that outputs a control signal for controlling the first sewing machine 21; a second control portion 14 that outputs a control signal for controlling the second sewing machine 22; a holding position decision portion 15 that determines the holding position of the cloth C by the holding member 61 and the holding member 62; an abnormality decision portion 16 that determines whether the cloth C installed on the installation table 312 and the installation table 322 is abnormal; a conveyance control portion 17 that outputs a control signal for controlling the cloth conveyor 4; a storage portion 18; and an input and output portion 19.

The front body part position data acquisition portion 11 acquires the position data of the edge of the front body part Ca based on the detection data of the detector 313 disposed in the first cloth feeder 31. The front body part position data acquisition portion 11 acquires the position data of the edge of the front body part Ca in the XY plane. The detector 313 acquires the image data of the front body part Ca installed on the installation table 312 as the detection data. The detector 313 acquires the image data including the edge of the entire front body part Ca. The detector 313 acquires the image data of the front body part Ca together with the image data of a reference mark provided on the installation table 312. The reference mark may be provided in the optical system of the detector 313. The front body part position data acquisition portion 11 acquires the image data of the front body part Ca and the image data of the reference mark from the detector 313. The front body part position data acquisition portion 11 performs image processing regarding the image data of the front body part Ca and the image data of the reference mark. The front body part position data acquisition portion 11 performs image processing regarding the image data of the front body part Ca and the image data of the reference mark, and calculates the relative position between the reference mark and the edge of the front body part Ca. The position data of the reference mark in the XY plane is known data, and is stored in the storage portion 18. The front body part position data acquisition portion 11 calculates the position data of the edge of the front body part Ca in the XY plane, based on the position data of the reference mark stored in the storage portion 18 and the relative position between the reference mark and the edge of the front body part Ca which are calculated based on the detection data of the detector 313.

The rear body part position data acquisition portion 12 acquires the position data of the edge of the rear body part Cb based on the detection data of the detector 323 disposed in the second cloth feeder 31. The rear body part position data acquisition portion 12 acquires the position data of the edge of the rear body part Cb in the XY plane. Similar to the detector 313, the detector 323 acquires the image data including the edge of the entire rear body part Cb together with the image data of the reference mark provided on the installation table 322. The reference mark may be provided in the optical system of the detector 323. The rear body part position data acquisition portion 12 calculates the position data of the edge of the rear body part Cb in the XY plane, based on the position data of the reference mark stored in the storage portion 18 and the relative position between the reference mark and the edge of the rear body part Cb which are calculated based on the detection data of the detector 323.

The first control portion 13 controls each of the label feeder 8, the label conveyor 9, and the head 212.

The second control portion 14 controls each of the supporter 241, the cloth position adjustment device 250, and the head 222.

The holding position decision portion 15 determines a holding position HP of the front body part Ca installed on the installation table 312 based on the detection data of the detector 313. The holding position decision portion 15 determines a holding position HP of the rear body part Cb installed on the installation table 322 based on the detection data of the detector 323.

The abnormality decision portion 16 determines whether the front body part Ca installed on the installation table 312 is abnormal based on the detection data of the detector 313. The reference data related to the front body part Ca is stored in the storage portion 18. The reference data related to the front body part Ca indicates correct data indicating a correct value of the dimension of the front body part Ca. The reference data related to the front body part Ca is known data defined in advance, and is stored in the storage portion 18. The abnormality decision portion 16 determines whether the dimension of the front body part Ca installed on the installation table 312 is abnormal by collating the detection data of the detector 313 indicating the position of the edge of the front body part Ca installed on the installation table 312 with the reference data indicating the correct value of the dimension of the front body part Ca stored in the storage portion 18.

Similarly, the abnormality decision portion 16 determines whether the dimension of the rear body part Cb installed on the installation table 322 is abnormal by collating the detection data of the detector 323 that detects the rear body part Cb installed on the installation table 322 with the reference data related to the rear body part Cb stored in the storage portion 18.

For example, due to a cutting error or the like, there is a possibility that the front body part Ca having a dimension different from that of the front body part Ca to be originally sewn is accommodated in the accommodator 311 or installed on the installation table 312. The reference data related to the front body part Ca stored in the storage portion 18 indicates the dimension of the front body part Ca to be originally sewn. The abnormality decision portion 16 determines whether the front body part Ca installed on the installation table 312 is abnormal, that is, whether the front body part Ca is the front body part Ca to be originally sewn, by collating the detection data of the detector 313 with the reference data related to the front body part Ca stored in the storage portion 18. Similarly, the abnormality decision portion 16 determines whether the rear body part Cb installed on the installation table 322 is abnormal, that is, whether the rear body part Cb is the rear body part Cb to be originally sewn, by collating the detection data of the detector 323 with the reference data related to the rear body part Cb stored in the storage portion 18.

The conveyance control portion 17 controls the cloth conveyor 4 based on the position data of the front body part Ca acquired by the front body part position data acquisition portion 11. The conveyance control portion 17 moves the robot 5 in the XYZ orthogonal coordinate system defined in the sewing system 1. A movement amount of the robot 5 is detected by a movement amount sensor, such as an encoder provided in the robot 5. The conveyance control portion 17 can convey the front body part Ca to a target position in the XY plane by controlling the movement amount of the robot 5 that holds the front body part Ca via the conveying member 6 with reference to the position data of the front body part Ca when being installed on the installation table 312. Similarly, the conveyance control portion 17 can convey the rear body part Cb to the target position in the XY plane by controlling the cloth conveyor 4 based on the position data of the rear body part Cb acquired by the rear body part position data acquisition portion 12.

The conveyance control portion 17 controls the cloth conveyor 4 such that the holding member 61 and the holding member 62 hold the holding position HP of the front body part Ca determined by the holding position decision portion 15 when the cloth conveyor 4 holds the front body part Ca installed on the installation table 312. The conveyance control portion 17 controls the robot 5 and the power generator 401 of the fine movement device 400 such that the holding member 61 holds the holding position HP1 of the front body part Ca determined by the holding position decision portion 15 and the holding member 62 holds the holding position HP2 of the front body part Ca determined by the holding position decision portion 15. Similarly, the conveyance control portion 17 controls the cloth conveyor 4 such that the holding member 61 and the holding member 62 hold the holding position HP of the rear body part Cb determined by the holding position decision portion 15 when the cloth conveyor 4 holds the rear body part Cb installed on the installation table 322.

Operation

Next, an example of the operation of the sewing system 1 according to the embodiment will be described.

Conveyance Route of Front Body Part

Figure 13:
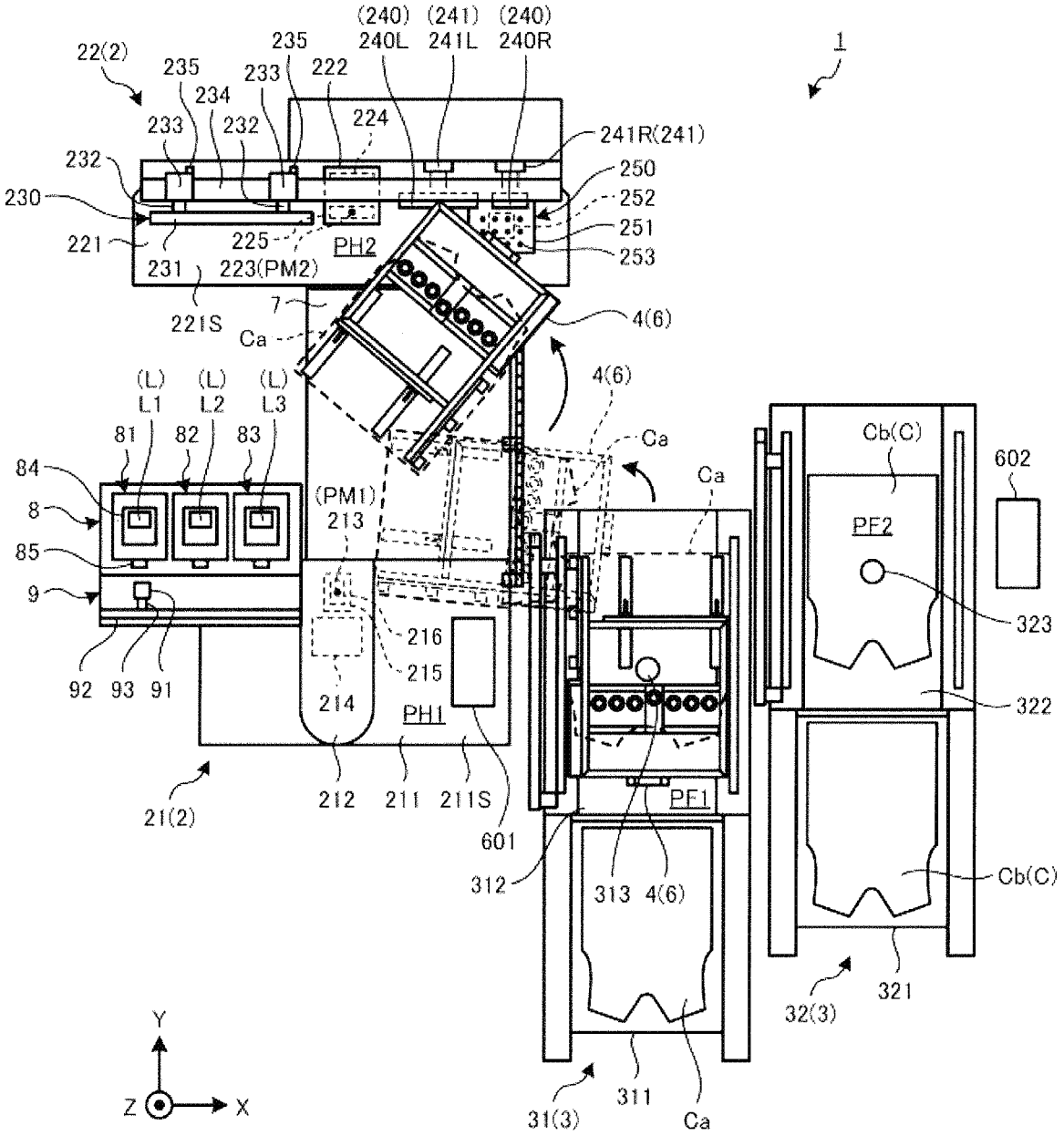
FIG. 13 is a plan view schematically illustrating an operation of a cloth conveyor that conveys a front body part according to the embodiment.

FIG. 13 is a plan view schematically illustrating an operation of the cloth conveyor 4 that conveys the front body part Ca according to the embodiment. The cloth conveyor 4 holds the front body part Ca fed from the first cloth feeder 31, and conveys the front body part Ca to the second sewing machine 22. In the first cloth feeder 31, one front body part Ca is installed on the installation table 312 by the first pickup. The conveyance control portion 17 controls the cloth conveyor 4 and moves the cloth conveyor 4 to the first feeding position PF1 that faces the front body part Ca installed on the installation table 312.

The cloth conveyor 4 holds the front body part Ca installed on the installation table 312 from above. The conveyance control portion 17 controls the cloth conveyor 4 such that the holding member 61 and the holding member 62 hold the holding position HP of the front body part Ca determined by the holding position decision portion 15 based on the detection data of the detector 313. The conveyance control portion 17 moves the cloth conveyor 4 that holds the front body part Ca to the second sewing machine 22. In the first cloth feeder 31, the cloth conveyor 4 that holds the front body part Ca conveys the front body part Ca to the second sewing machine 22. The cloth conveyor 4 conveys the front body parts Ca one by one from the installation table 312.

The cloth conveyor 4 adjusts the position of the front body part Ca based on the detection data of the detector 313. The conveyance control portion 17 controls the movement amount of the robot 5 based on the position data of the front body part Ca acquired by the front body part position data acquisition portion 11. As illustrated in FIG. 13, the conveyance control portion 17 controls the robot 5, and moves the conveying member 6 that holds the front body part Ca to the second sewing machine position PH2 that faces the table 221 of the second sewing machine 22.

The cloth conveyor 4 adjusts the position of the front body part Ca in the second sewing machine 22 based on the detection data of the detector 313. The conveyance control portion 17 adjusts the position of the cloth conveyor 4 such that the front body part Ca is disposed at the target position of the front body part Ca defined in the second sewing machine 22. After the front body part Ca is disposed at the target position of the front body part Ca defined in the second sewing machine 22, the cloth conveyor 4 releases the suctioned and held state of the front body part Ca by the suction surface HS. Accordingly, the front body part Ca passes the second sewing machine 22 and is installed on the table 221.

Conveyance Route of Rear Body Part

Figure 14:
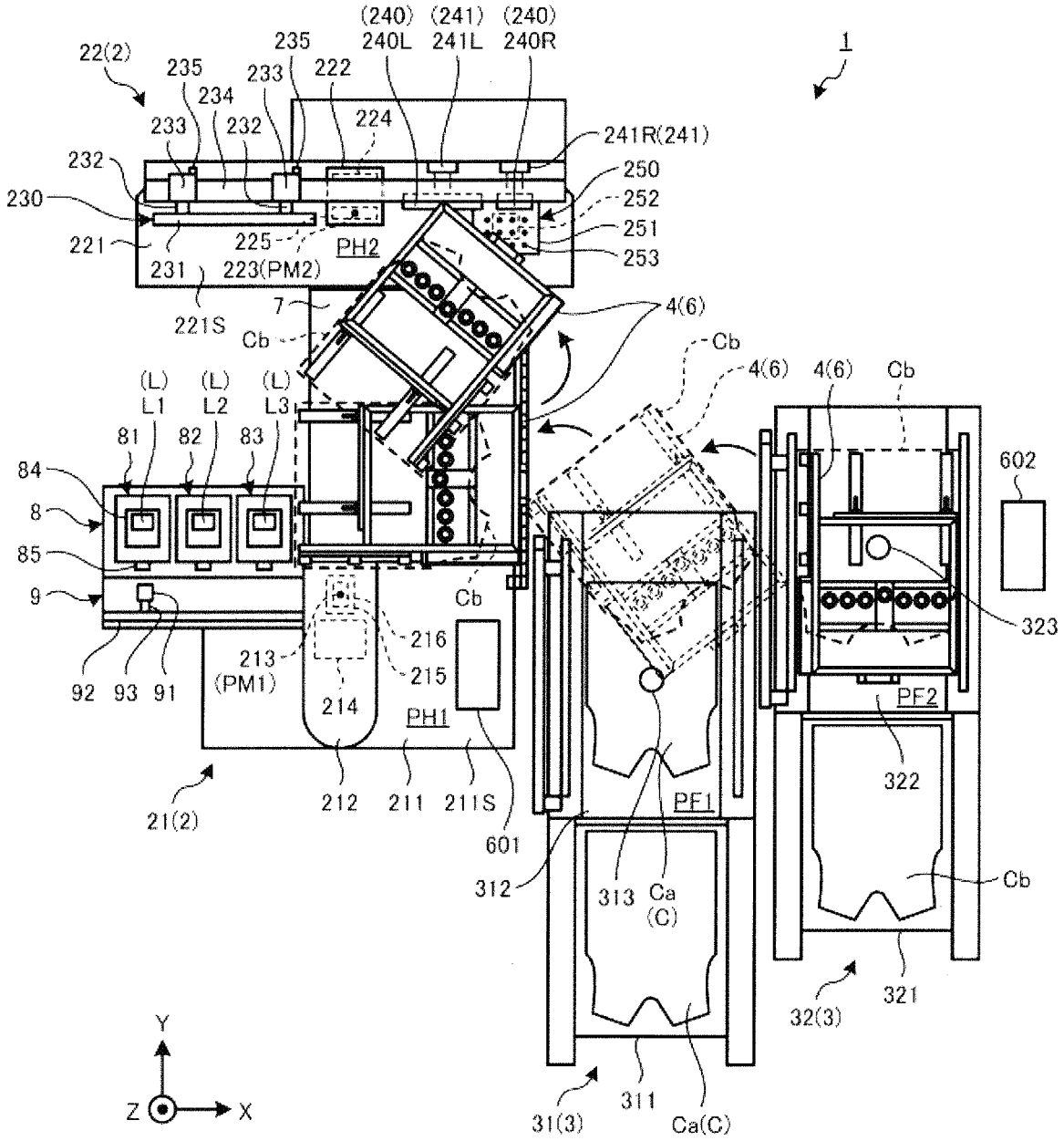
FIG. 14 is a plan view schematically illustrating an operation of the cloth conveyor that conveys a rear body part according to the embodiment.

FIG. 14 is a plan view schematically illustrating the operation of the cloth conveyor 4 that conveys the rear body part Cb according to the embodiment. The cloth conveyor 4 holds the rear body part Cb fed from the second cloth feeder 32 and conveys the rear body part Cb to the first sewing machine 21. In the second cloth feeder 32, one rear body part Cb is installed on the installation table 322 by the second pickup. The conveyance control portion 17 controls the cloth conveyor 4 and moves the cloth conveyor 4 to the second feeding position PF2 that faces the rear body part Cb installed on the installation table 322.

The cloth conveyor 4 holds the rear body part Cb installed on the installation table 312 from above. The conveyance control portion 17 controls the cloth conveyor 4 such that the holding member 61 and the holding member 62 hold the holding position HP of the rear body part Cb determined by the holding position decision portion 15 based on the detection data of the detector 323. The conveyance control portion 17 moves the cloth conveyor 4 that holds the rear body part Cb to the first sewing machine 21. In the second cloth feeder 32, the cloth conveyor 4 that holds the rear body part Cb conveys the rear body part Cb to the first sewing machine 21. The cloth conveyor 4 conveys the rear body parts Cb one by one from the installation table 322.

The cloth conveyor 4 adjusts the position of the rear body part Cb based on the detection data of the detector 323. The conveyance control portion 17 controls the movement amount of the robot 5 based on the position data of the rear body part Cb acquired by the rear body part position data acquisition portion 12. As illustrated in FIG. 14, the conveyance control portion 17 controls the robot 5 and moves the conveying member 6 that holds the rear body part Cb to the first sewing machine position PH1 that faces the table 211 of the first sewing machine 21.

The cloth conveyor 4 adjusts the position of the rear body part Cb in the first sewing machine 21 based on the detection data of the detector 323. The conveyance control portion 17 adjusts the position of the cloth conveyor 4 such that the rear body part Cb is disposed at the target position of the rear body part Cb defined in the first sewing machine 21.

In the embodiment, the cloth conveyor 4 holds the rear body part Cb in the stitching of the label L by the head 212 of the first sewing machine 21. In other words, in the stitching of the rear body part Cb and the label L in the first sewing machine 21, the cloth conveyor 4 continues to hold the rear body part Cb. The rear body part Cb is stitched with the label L in the first sewing machine 21 in a state of being held by the cloth conveyor 4.

The cloth conveyor 4 conveys the rear body part Cb to which the stitching with the label L is completed, from the first sewing machine 21 to the second sewing machine 22. As illustrated in FIG. 14, the conveyance control portion 17 controls the robot 5 and moves the conveying member 6 that holds the rear body part Cb to the second sewing machine position PH2 that faces the table 221 of the second sewing machine 22.

The cloth conveyor 4 adjusts the position of the rear body part Cb in the second sewing machine 22 based on the detection data of the detector 323. The conveyance control portion 17 controls the position of the cloth conveyor 4 such that the rear body part Cb is disposed at the target position of the rear body part Cb defined in the second sewing machine 22. After the rear body part Cb is disposed at the target position of the rear body part Cb defined in the second sewing machine 22, the cloth conveyor 4 releases the suctioned and held state of the rear body part Cb by the suction surface HS. Accordingly, the rear body part Cb passes the second sewing machine 22 and is installed on the table 221.

In this manner, the cloth conveyor 4 continues to hold the rear body part Cb in conveyance of the rear body part Cb from the second cloth feeder 32 to the first sewing machine 21, stitching of the first sewing machine 21, and conveyance of the rear body part Cb from the first sewing machine 21 to the second sewing machine 22.

When conveying the front body part Ca and the rear body part Cb fed from the cloth feeder 3 to the second sewing machine 22 using the integrated robot 5 and the conveying member 6, the conveying route of the front body part Ca and the conveying route of the rear body part Cb are different from each other. The front body part Ca is directly conveyed from the first cloth feeder 31 to the table 221 of the second sewing machine 22. The rear body part Cb is conveyed from the second cloth feeder 32 to the table 221 of the second sewing machine 22 via the first sewing machine 21.

Conveying Out Cloth from Cloth Feeder

Figure 15A:
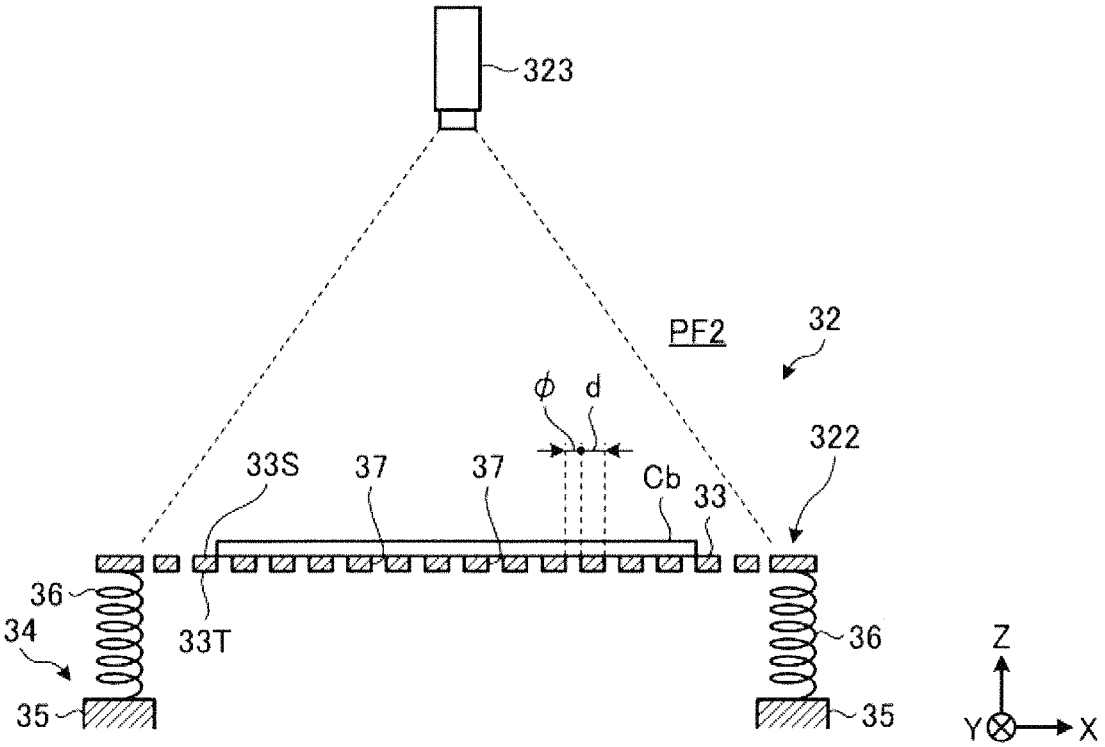
FIGS. 15A and 15B are side views schematically illustrating an operation of the cloth conveyor in a cloth feeder according to the embodiment.
Figure 15B:
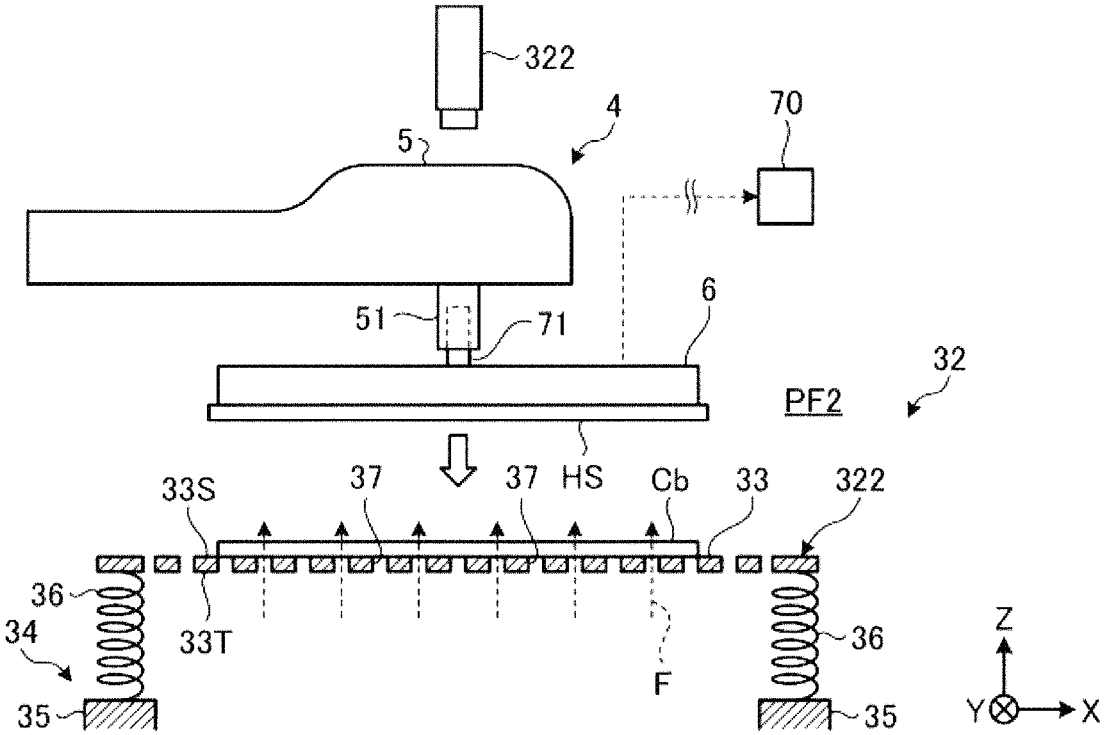

FIGS. 15A and 15B are side views schematically illustrating the operation of the cloth conveyor 4 in the cloth feeder 3 according to the embodiment. FIG. 15A is a view schematically illustrating the operation when the detector 323 detects the rear body part Cb installed on the installation table 322 of the second cloth feeder 32. FIG. 15B is a view schematically illustrating the operation when the cloth conveyor 4 conveys out the rear body part Cb from the installation table 322 of the second cloth feeder 32.

When the rear body part Cb is installed on the installation table 322, the detector 323 acquires the image data of the rear body part Cb installed on the installation table 322. The imaging region of the detector 323 is sufficiently large, and the detector 323 can collectively acquire the image data of the entire rear body part Cb. The image data of the rear body part Cb detected by the detector 323 is output to the controller 10.

The hole 37 of the plate member 33 is minute. In the embodiment, the diameter $\phi$ of the hole 37 of the plate member 33 is equal to or less than 2 mm. Therefore, even when the hole 37 is reflected in the image data of the rear body part Cb acquired by the detector 323, the influence on the image processing in the rear body part position data acquisition portion 12 is reduced.

The rear body part position data acquisition portion 12 acquires the image data of the rear body part Cb acquired by the detector 323. The rear body part position data acquisition portion 12 calculates the position data of the edge of the rear body part Cb in the XY plane based on the image data of the rear body part Cb acquired by the detector 313. The rear body part position data acquisition portion 12 calculates the position data of the left shoulder part KL of the rear body part Cb, the position data of the right shoulder part KR of the rear body part Cb, the position data of the left side part WL of the rear body part Cb, the position data of the right side part WR of the rear body part Cb, and the position data of the hem part H of the rear body part Cb.

Figure 16:
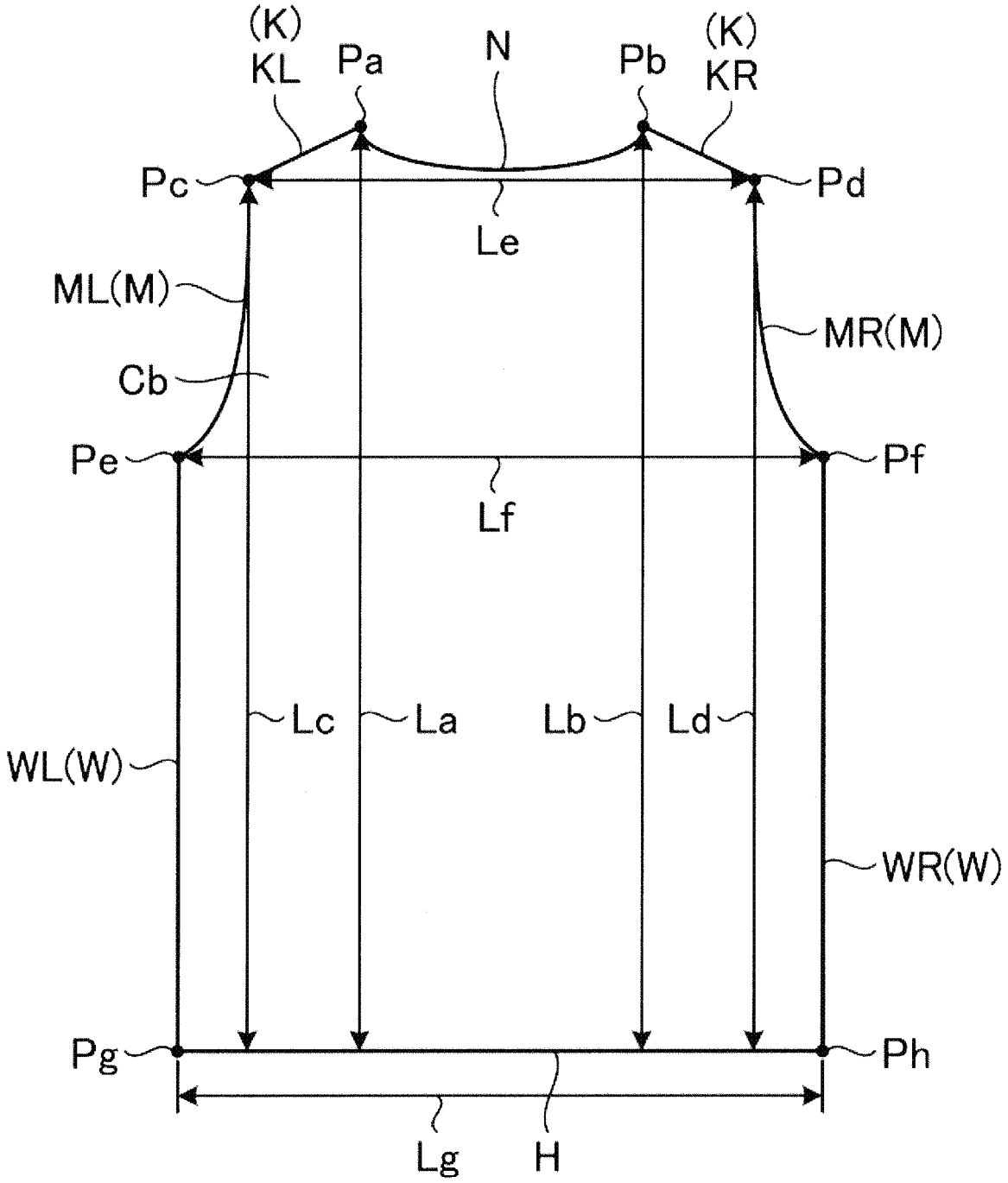
FIG. 16 is a view schematically illustrating image data of the rear body part acquired by a detector according to the embodiment.

FIG. 16 is a view schematically illustrating the image data of the rear body part Cb acquired by the detector 323 according to the embodiment. As illustrated in FIG. 16, as the position data of the edge of the rear body part Cb, the rear body part position data acquisition portion 12 calculates the position of an intersection Pa between the left shoulder part KL and the neck part N, the position of an intersection Pb between the right shoulder part KR and the neck part N, the position of an intersection Pc between the left shoulder part KL and the left sleeve part ML, the position of an intersection Pd between the right shoulder part KR and the right sleeve part MR, the position of an intersection Pe between the left sleeve part ML and the left side part WL, the position of an intersection Pf between the right sleeve part MR and the right side part WR, the position of an intersection Pg between the left side part WL and the hem part H, and the position of an intersection Ph between the right side part WR and the hem part H. The rear body part position data acquisition portion 12 may, for example, calculate the position data of the center of the rear body part Cb based on an intersection between a first virtual line that connects the intersection Pc and the intersection Ph to each other and a second virtual line that connects the intersection Pd and the intersection Pg to each other.

The rear body part position data acquisition portion 12 calculates dimension data of the rear body part Cb based on the position data of the edge of the rear body part Cb. As the dimension data of the rear body part Cb, the rear body part position data acquisition portion 12 calculates a dimension La between the intersection Pa and the hem part H, a dimension Lb between the intersection Pb and the hem part H, a dimension Lc between the intersection Pc and the hem part H, a dimension Ld between the intersection Pd and the hem part H, a dimension Le between the intersection Pc and the intersection Pd, a dimension Lf between the intersection Pe and the intersection Pf, and a dimension Lg between the intersection Pg and the intersection Ph. The dimension La, the dimension Lb, the dimension Lc, and the dimension Ld are dimensions in a direction orthogonal to the hem part H. The dimension Le, the dimension Lf, and the dimension Lg are dimensions in a direction parallel to the hem part H.

The abnormality decision portion 16 determines whether the rear body part Cb installed on the installation table 322 is abnormal by collating the detection data of the detector 323 with the reference data related to the rear body part Cb stored in the storage portion 18. The reference data related to the rear body part Cb stored in the storage portion 18 includes a target dimension Lar indicating the correct data related to the dimension La, a target dimension Lbr indicating the correct data related to the dimension Lb, a target dimension Lcr indicating the correct data related to the dimension Lc, a target dimension Ldr indicating the correct data related to the dimension Ld, a target dimension Ler indicating the correct data related to the dimension Le, a target dimension Lfr indicating the correct data related to the dimension Lf, and a target dimension Lgr indicating the correct data related to the dimension Lg. The abnormality decision portion 16 determines whether a difference $\Delta La$ between the dimension La calculated from the detection data of the detector 323 and the target dimension Lar is equal to or greater than a predetermined threshold value LR. Similarly, the abnormality decision portion 16 determines whether each of a difference $\Delta Lb$ between the dimension Lb and the target dimension Lbr, a difference $\Delta Lc$ between the dimension Lc and the target dimension Lcr, a difference $\Delta Ld$ between the dimension Ld and the target dimension Ldr, a difference $\Delta Le$ between the dimension Le and the target dimension Ler, a difference $\Delta Lf$ between the dimension Lf and the target dimension Lfr, and a difference $\Delta Lg$ between the dimension Lg and the target dimension Lgr is equal to or greater than the threshold value LR. When it is determined that all of the difference ΔLa, the difference ΔLb, the difference ΔLc, the difference ΔLe, the difference ΔLf, and the difference ΔLg are less than the threshold value LR, the abnormality decision portion 16 determines that the rear body part Cb installed on the installation table 322 is not abnormal. In a case where it is determined that at least one of the difference ΔLa, the difference ΔLb, the difference ΔLc, the difference ΔLe, the difference ΔLf, and the difference ΔLg is equal to or greater than the threshold value LR, the abnormality decision portion 16 determines that the rear body part Cb installed on the installation table 322 is abnormal.

The holding position decision portion 15 determines the holding position HP of the rear body part Cb determined not to be abnormal based on the detection data of the detector 323. The holding position HP is a target position to be held by the holding member 61 and the holding member 62 on the cloth C.

Figure 17:
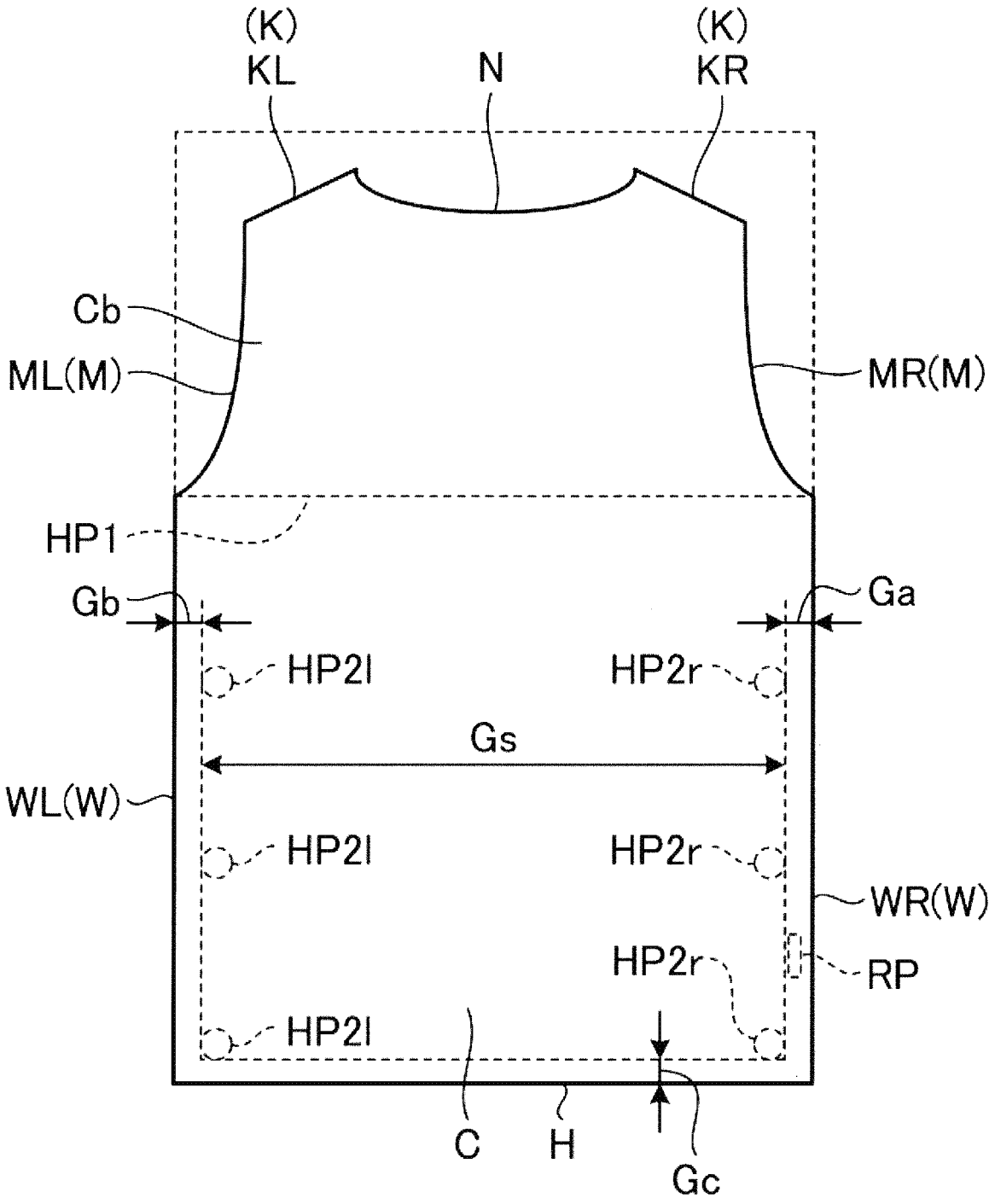
FIG. 17 is a view schematically illustrating holding positions of cloth according to the embodiment.

FIG. 17 is a view schematically illustrating the holding position HP of the rear body part Cb according to the embodiment. The holding position HP1 by the holding member 61 is defined in the upper portion of the cloth C including the shoulder part K, the neck part N, and the sleeve part M.

The holding position HP2 by the holding member 62 includes a holding position HP2*r* by the holding member 62 supported by the first member 60A, and a holding position HP2*l* by the holding member 62 supported by the second supporting member 66.

In the following description, the holding member 62 supported by the first member 60A is appropriately referred to as a reference holding member 62*r*, and the holding member 62 supported by the second supporting member 66 is appropriately referred to as a non-reference holding member 62*l*.

The reference holding member 62*r* supported by the first member 60A cannot be movable regarding the main body member 60. The non-reference holding member 62*l* supported by the second supporting member 66 is movable regarding the main body member 60. The position of the reference holding member 62*r* is adjusted by the robot 5. The position of the non-reference holding member 62*l* is adjusted by the robot 5 and the fine movement device 400.

In the following description, the holding position HP2*r* by the reference holding member 62*r* supported by the first member 60A is appropriately referred to as a reference holding position HP2*r*, and the holding position HP2*l* by the non-reference holding member 62*l* supported by the second supporting member 66 is appropriately referred to as a non-reference holding position HP2*l*.

The holding position HP2 by the holding member 62 is determined to be at a prescribed distance from the edge of the rear body part Cb. The reference holding position HP2*r* is determined to be at a first prescribed distance Ga from the right side part WR. The non-reference holding position HP2*l* is determined to be at a second prescribed distance Gb from the left side part WL. The first prescribed distance Ga is, for example, 5 mm. The second prescribed distance Gb is, for example, 5 mm. The first prescribed distance Ga and the second prescribed distance Gb are distances in a direction parallel to the hem part H. In the example illustrated in FIG. 17, the reference holding position HP2*r* and the non-reference holding position HP2*l* are separated from each other only by a distance Gs. The distance Gs is a distance in a direction parallel to the hem part H.

In the following description, the right side part WR among the edges of the rear body part Cb is appropriately referred to as a reference edge WR, and the left side part WL is appropriately referred to as a non-reference edge WL.

Three reference holding members 62*r* are provided, and the reference holding positions HP2*r* are defined at three locations. The first reference holding position HP2*r* that is the closest to the hem part H among the reference holding positions HP2*r* at three locations is determined to be at a third prescribed distance Gc from the hem part H. Three non-reference holding members 62*l* are provided, and the non-reference holding positions HP2*l* are defined at three locations. The first non-reference holding position HP2*l* that is the closest to the hem part H among the non-reference holding positions HP2*l* at three locations is determined to be at a third prescribed distance Gc from the hem part H. The third prescribed distance Gc is, for example, 5 mm. The third prescribed distance Gc is a distance in a direction orthogonal to the hem part H.

Each of the reference edge WR, the non-reference edge WL, and the hem part H has a shape of a straight line. The reference holding position HP2*r* is determined to be at a first prescribed distance Ga from the reference edge WR. The non-reference holding position HP2*l* is determined to be at a second prescribed distance Gb from the non-reference edge WL. The holding position decision portion 15 determines the reference holding positions HP2*r* at three positions such that a line that connects the first reference holding position HP2*r*, the second reference holding position HP2*r*, and the third reference holding position HP2*r* is parallel to the reference edge WR.

In the first sewing machine 21, the label L is stitched to the target part RP of the rear body part Cb. The reference holding position HP2*r* is determined to be a part of the periphery of the target part RP on the rear body part Cb. The target part RP is defined between the first reference holding position HP2*r* that is the closest to the hem part H among the reference holding positions HP2*r* at three locations, and the second reference holding position HP2*r* that is close to the hem part H next to the first reference holding position HP2*r*.

The conveyance control portion 17 controls the cloth conveyor 4 such that the holding member 62 holds the holding position HP2. The conveyance control portion 17 controls the robot 5 such that the reference holding member 62*r* holds the reference holding position HP2*r*. In other words, the conveyance control portion 17 controls the robot 5 and adjusts the position of the main body member 60 such that the reference holding member 62*r* and the reference holding position HP2*r* defined on the rear body part Cb installed on the installation table 322 match each other in the XY plane.

The conveyance control portion 17 controls the power generator 401 of the fine movement device 400 such that the non-reference holding member 62*l* holds the non-reference holding position HP2*l* in a state where the reference holding member 62*r* holds the reference holding position HP2*r*.

For example, there is a possibility that the dimension of the rear body part Cb in the direction parallel to the hem part H changes for each rear body part Cb due to, for example, expansion and contraction or cutting errors of the rear body part Cb. As described above, the reference holding position HP2*r* is determined to be at the first prescribed distance Ga from the reference edge WR, and the non-reference holding position HP2*l* is determined to be at the second prescribed distance Gb from the non-reference edge WL. In a case where the reference holding position HP2*r* and the non-reference holding position HP2*l* are determined based on the detection data of the detector 323, when the relative position between the reference holding member 62*r* and the non-reference holding member 62*l* is fixed, there is a possibility that the holding member 62 cannot hold the holding position HP2.

Figure 18:
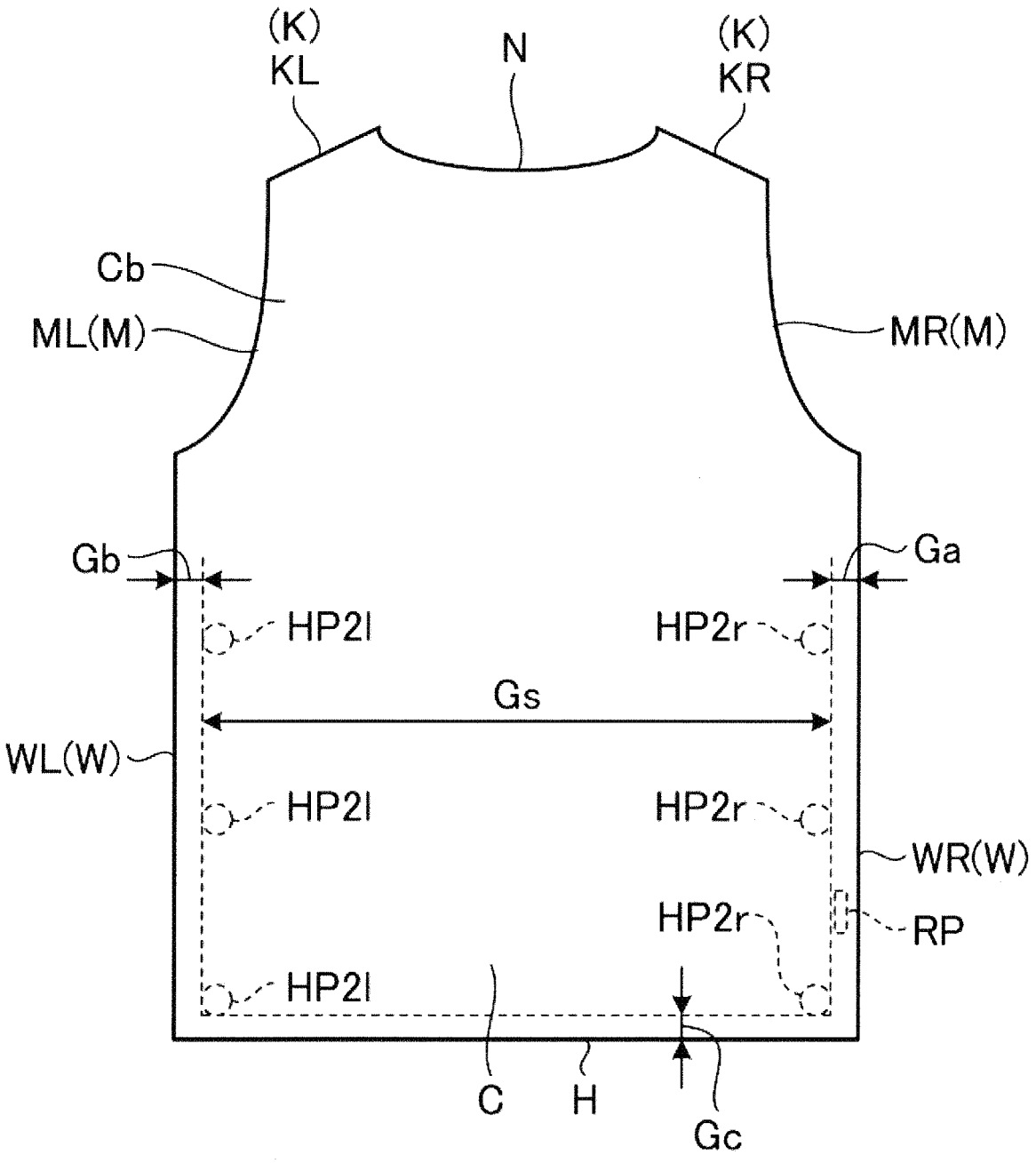
FIG. 18 is a view schematically illustrating the holding positions of the cloth according to the embodiment.

FIG. 18 is a view schematically illustrating the holding position HP of the rear body part Cb according to the embodiment. The dimension of the rear body part Cb in the direction parallel to the hem part H illustrated in FIG. 18 is greater than the dimension of the rear body part Cb in the direction parallel to the hem part H illustrated in FIG. 17. The abnormality decision portion 16 determines that there is no abnormality due to, for example, expansion and contraction or cutting errors of the rear body part Cb, but there is a possibility that the dimension of the rear body part Cb in the direction parallel to the hem part H slightly changes. As illustrated in FIG. 18, in a case where the reference holding position HP2*r* is determined to be at the first described distance Ga from the reference edge WR and the non-reference holding position HP2*l* is determined to be at the second described distance Gb from the non-reference edge WL, the distance Gs illustrated in FIG. 18 between the reference holding position HP2*r* and the non-reference holding position HP2*l* is longer than the distance Gs illustrated in FIG. 17 between the reference holding position HP2*r* and the non-reference holding position HP2*l*.

In each of the rear body part Cb illustrated in FIG. 17 and the rear body part Cb illustrated in FIG. 18, the conveyance control portion 17 controls the power generator 401 of the fine movement device 400 and moves the non-reference holding member HP2*l* in the direction parallel to the hem part H such that the reference holding member 62*r* holds the reference holding position HP2*r* and the non-reference holding member 62*l* holds the non-reference holding position HP2*l*. By changing the relative position between the reference holding member 62*r* and the non-reference holding member 62*l*, in a state where the reference holding member 62*r* holds the reference holding position HP2*r*, the non-reference holding member 62*l* can hold the non-reference holding position HP2*l*.

After the holding position HP1 and the holding position HP2 are determined, the conveyance control portion 17 controls the robot 5 and the power generator 401 of the fine movement device 400 such that the holding member 61 holds the holding position HP1, the reference holding member 62*r* holds the reference holding position HP2*r*, and the non-reference holding member 62*l* holds the non-reference holding position HP2*l*.

As illustrated in FIG. 15B, the conveyance control portion 17 moves the cloth conveyor 4 to the second feeding position PF2 that faces the rear body part Cb installed on the plate member 33 of the installation table 322. The supporter 34 supports the plate member 33 at a position where the supporter 34 can face the suction surface HS of the conveying member 6 of the cloth conveyor 4. After the cloth conveyor 4 is moved to the second feeding position PF2, the conveyance control portion 17 lowers the cloth conveyor 4 while performing the suction operation of the suction surface HS. Accordingly, the suction surface HS of the cloth conveyor 4 and the rear body part Cb installed on the upper surface of the plate member 33 come into contact with each other, and the rear body part Cb is vacuum-suctioned and held on the suction surface HS of the cloth conveyor 4. The cloth conveyor 4 vacuum-suctions and holds the rear body part Cb installed on the upper surface 33S of the plate member 33 from above. The cloth conveyor 4 vacuum-suctions and holds and conveys the front body part Ca from above.

The holes 37 are provided on the plate member 33. Accordingly, when the gas is suctioned from the suction hole of the suction surface HS of the cloth conveyor 4 in a state where the cloth conveyor 4 and the rear body part Cb installed on the plate member 33 approach or come into contact with each other, as indicated by an arrow F of FIG. 15B, the gas in the space on the lower surface 33T side of the plate member 33 flows into the space on the upper surface 33S side of the plate member 33 via the hole 37. Accordingly, the vacuum-suctioning and holding of the front body part Ca by the suction surface HS of the cloth conveyor 4 is stably performed.

The robot 5 is a horizontally articulated robot, and is movable in four directions of the X-axis direction, the Y-axis direction, the Z-axis direction, and the θZ direction. The suction surface HS of the cloth conveyor 4 is movable in the X-axis direction, in the Y-axis direction, in the Z-axis direction, and in the θZ direction. The supporter 34 has a floating function of supporting the plate member 33 to be capable of swinging. The plate member 33 is supported by the supporter 34 to be movable in at least one of the θX direction, the θY direction, and the Z-axis direction.

In other words, regarding the suction surface HS of the cloth conveyor 4 that is movable only in the XY plane and in the Z-axis direction, the plate member 33 that supports the front body part Ca can move in the θX direction, in the θY direction, and in the Z-axis direction. Therefore, even when the suction surface HS of the cloth conveyor 4 and the upper surface 33S of the plate member 33 are not parallel to each other, when the cloth conveyor 4 is lowered and the suction surface HS of the cloth conveyor 4 and the front body part Ca installed on the upper surface 33S of the plate member 33 are brought into contact with each other, the plate member 33 swings such that the suction surface HS of the cloth conveyor 4 and the upper surface 33S of the plate member 33 are parallel to each other. Accordingly, the suction surface HS of the cloth conveyor 4 and the upper surface 33S of the plate member 33 can sufficiently come in contact with each other, and the front body part Ca is stably vacuum-suctioned and held on the suction surface HS of the cloth conveyor 4.

With reference to FIG. 15, the operation in which the cloth conveyor 4 conveys out the rear body part Cb from the second cloth feeder 32 has been described. Since the operation in which the cloth conveyor 4 conveys out the front body part Ca from the first cloth feeder 31 is the same as the operation of conveying out the rear body part Cb from the second cloth feeder 32, the description thereof will be omitted.

Operation of Cloth Conveyor in First Sewing Machine

Figure 19:
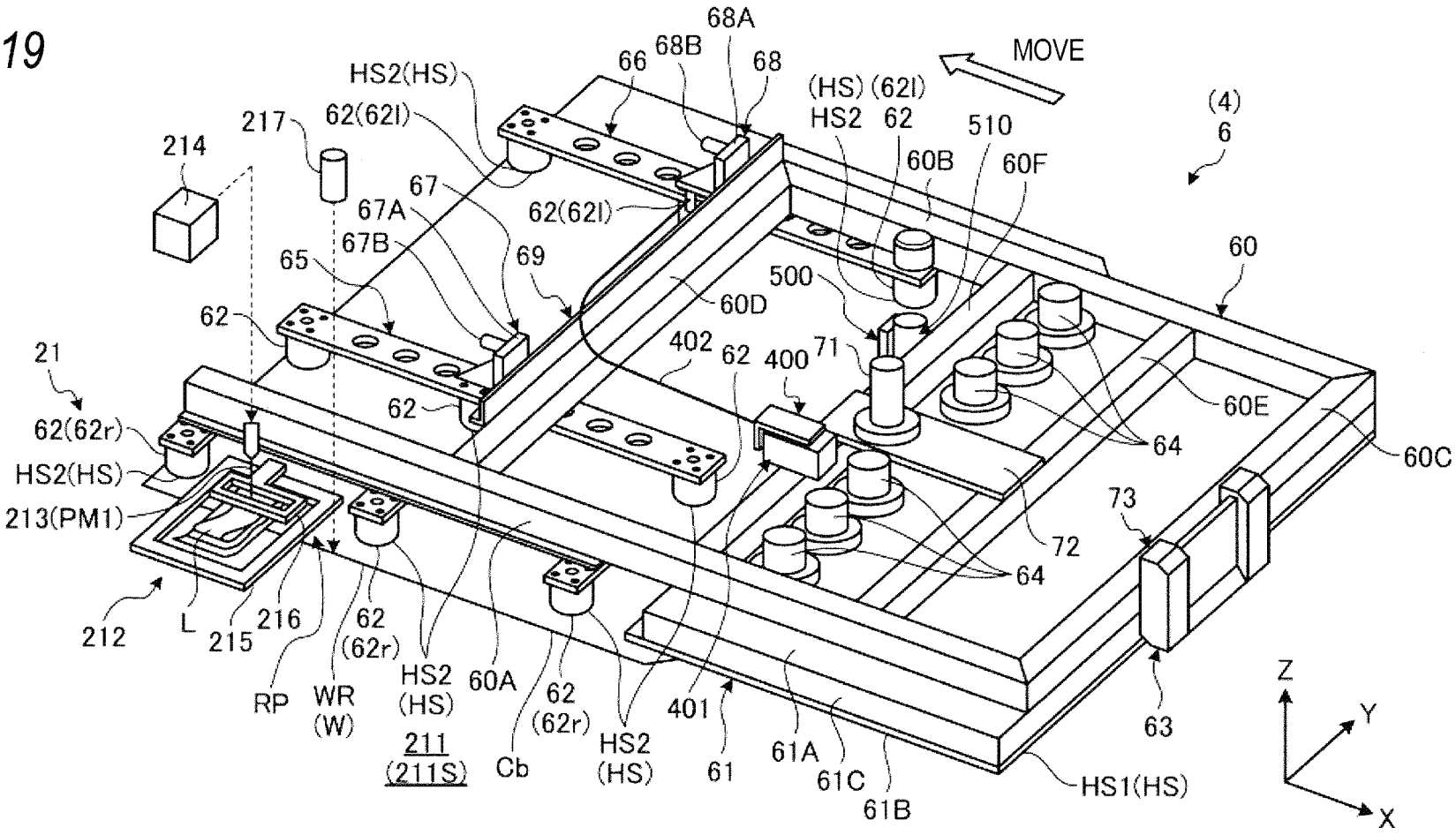
FIG. 19 is a perspective view schematically illustrating an operation of the cloth conveyor in a first sewing machine according to the embodiment.

FIG. 19 is a perspective view schematically illustrating the operation of the cloth conveyor 4 in the first sewing machine 21 according to the embodiment.

The first sewing machine 21 stitches up the rear body part Cb and the label L in cooperation with the cloth conveyor 4. As illustrated in FIG. 19, the first sewing machine 21 includes the table 211 including the installation surface 211S on which the rear body part Cb is installed and the head 212 that stitches up the rear body part Cb installed on the table 211 and the label L.

The head 212 includes: the driving mechanism 214 that moves the needle 213 in the vertical direction; the first pressing member 215 that presses the rear body part Cb installed on the table 211 from above; and the second pressing member 216 that presses the label L installed on the rear body part Cb from above.

The cloth conveyor 4 holds the rear body part Cb in the stitching of the rear body part Cb and the label L by the head 212. The conveyance control portion 17 moves the cloth conveyor 4 based on the detection data of the detector 313 such that the label L is stitched to the target part of the rear body part Cb. In the embodiment, the conveyance control portion 17 adjusts the position of the rear body part Cb held by the cloth conveyor 4 based on the detection data of the detector 313 such that the target part PR of the right side part WR of the rear body part Cb is disposed at the first stitch position PM1.

In the embodiment, a position sensor 217 for detecting the position of the right side part WR of the rear body part Cb is provided in the first sewing machine 21. The position sensor 217 optically detects the position of the right side portion WR by irradiating the edge of the rear body part Cb with the detection light. The conveyance control portion 17 adjusts the position of the cloth conveyor 4 that holds the rear body part Cb based on the detection data of the position sensor 217 such that the target part RP of the right side part WR of the rear body part Cb is disposed at the first stitch position PM1. In other words, in the embodiment, the conveyance control portion 17 adjusts the relative position between the target part PR of the right side part WR of the rear body part Cb and the first stitch position PM1 based on the detection data of the position sensor 217.

The head 212 stitches up the rear body part Cb and the label L while feeding the rear body part Cb and the label L in a sewing direction. The cloth conveyor 4 moves in the sewing direction while holding the rear body part Cb in synchronization with the stitching of the head 212. In the example illustrated in FIG. 19, the sewing direction is the X-axis direction.

The first control portion 13 controls the first sewing machine 21 such that the rear body part Cb and the label L are stitched up while being fed in a prescribed sewing direction. The first sewing machine 21 stitches up the rear body part Cb and the label L by moving the needle 213 in the vertical direction while feeding the rear body part Cb and the label L in the prescribed sewing direction. The conveyance control portion 17 moves the cloth conveyor 4 that holds the rear body part Cb in the prescribed sewing direction in synchronization with the feeding operation in the sewing direction of the rear body part Cb and the label L by the first sewing machine 21. The cloth conveyor 4 moves in the prescribed sewing direction in a state of holding the rear body part Cb in synchronization with the feeding operation in the sewing direction of the rear body part Cb and the label L by the first sewing machine 21. Accordingly, the stitching of the rear body part Cb and the label L by the first sewing machine 21 is performed smoothly.

In the embodiment, the cloth conveyor 4 presses the rear body part Cb against the table 211. The conveyance control portion 17 is moved in the prescribed sewing direction while pressing the cloth conveyor 4 against the table 211 such that a load greater than the weight of the cloth conveyor 4 acts on the table 211.

In the embodiment, the target part RP of the right side part WR of the rear body part Cb stitched with the label L is disposed between one pair of reference holding members 62*r* provided in the first member 60A. The target part RP of the right side part WR stitched with the label L is not covered with the conveying member 6. Accordingly, the first pressing member 215 and the second pressing member 216 can smoothly press the right side part WR of the rear body part Cb from above. Since the target part RP of the right side part WR sewn with the label L is not covered with the conveying member 6, the stitching by the needle 213 is performed smoothly.

Operation of Cloth Conveyor and Cloth Position Adjustment Device in Second Sewing Machine Next, an example of the operation of the cloth conveyor 4 and the cloth position adjustment device 250 in the second sewing machine 22 will be described. As described above, in the embodiment, the second sewing machine 22 is a shoulder matching sewing machine that stitches up the shoulder part K of the front body part Ca and the shoulder part K of the rear body part Cb.

Figure 20:
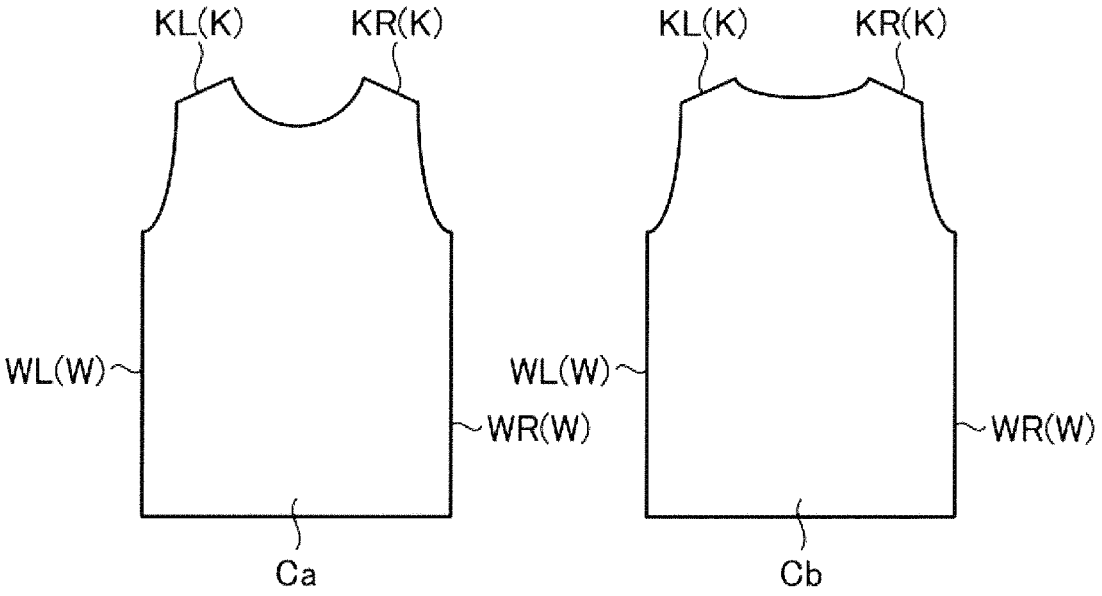
FIG. 20 is a view schematically illustrating each of the front body part and the rear body part according to the embodiment.

FIG. 20 is a view schematically illustrating each of the front body part Ca and the rear body part Cb according to the embodiment. As illustrated in FIG. 20, the front body part Ca includes two shoulder parts K and two side parts W. The rear body part Cb includes two shoulder parts K and two side parts. W. The two shoulder parts K include the left shoulder part KL which is one shoulder part K and the right shoulder part KR which is the other shoulder part K. The two side parts W include the left side part WL which is one side part W and the right side part KR which is the other side portion W. In the second sewing machine 22, the stitching of the left shoulder part KL of the front body part Ca and the left shoulder part KL of the rear body part Cb and the stitching of the right shoulder part KR of the front body part Ca and the right shoulder part KR of the rear body part Cb are performed.

Figure 21:
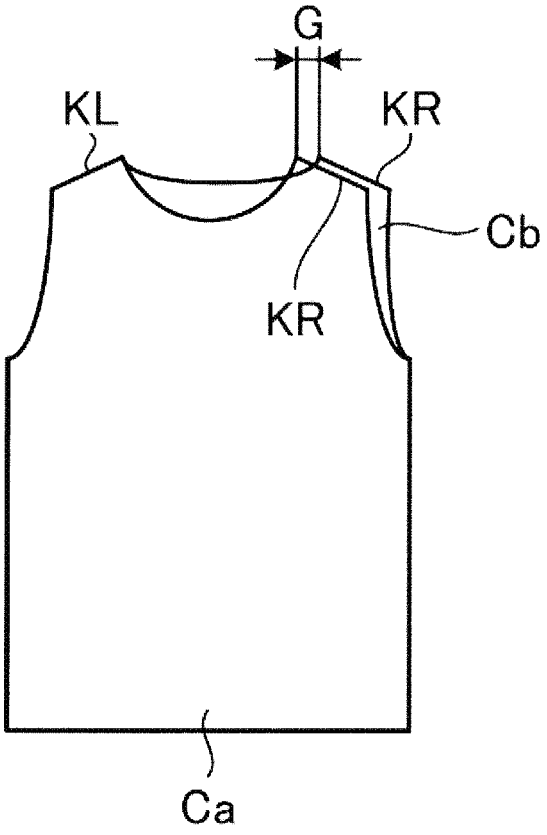
FIG. 21 is a view schematically illustrating a state where the front body part and the rear body part according to the embodiment overlap each other.

FIG. 21 is a view schematically illustrating a state where the front body part Ca and the rear body part Cb overlap each other according to the embodiment. As illustrated in FIG. 21, when the shoulder part K of the front body part Ca and the shoulder part K of the rear body part Cb are stitched up, in the second sewing machine 22, the front body part Ca and the rear body part Cb overlap each other. When the front body part Ca and the rear body part Cb overlap each other, there is a possibility that the position of the shoulder part K of the front body part Ca and the position of the shoulder part K of the rear body part Cb do not match each other. For example, as illustrated in FIG. 21, when the front body part Ca and the rear body part Cb overlap each other such that the position of the left shoulder part KL of the front body part Ca and the position of the left shoulder part KL of the rear body part Cb match each other, there is a possibility that the position of the right shoulder part KR of the front body part Ca and the position of the right shoulder part KR of the rear body part Cb are deviated from each other. The reason why the position of the shoulder part K of the front body part Ca and the position of the shoulder part K of the rear body part Cb do not match each other is, for example, elongation or cutting displacement of the cloth C.

In a state where the position of the shoulder part K of the front body part Ca and the position of the shoulder part K of the rear body part Cb do not match each other, when the shoulder part K of the front body part Ca and the shoulder part K of the rear body part Cb are not stitched up, defective clothing is manufactured.

The cloth position adjustment device 250 corrects the deviation between the position of the shoulder part K of the front body part Ca and the position of the shoulder part K of the rear body part Cb. When the front body part Ca and the rear body part Cb overlap each other such that the position of the left shoulder part KL of the front body part Ca and the position of the left shoulder part KL of the rear body part Cb match each other, the cloth position adjustment device 250 adjusts the position of the right shoulder part KR of the front body part Ca such that a deviation amount G between the position of the right shoulder part KR of the front body part Ca and the position of the right shoulder part KR of the rear body part Cb decreases.

Before the front body part Ca is conveyed to the second sewing machine 22, the position of the left shoulder part KL of the front body part Ca and the position of the right shoulder part KR of the front body part Ca in the XY plane are detected by the detector 313 disposed in the first cloth feeder 31. Before the rear body part Cb is conveyed to the second sewing machine 22, the position of the left shoulder part KL of the rear body part Cb and the position of the right shoulder part KR of the rear body part Cb in the XY plane are detected by the detector 323 disposed in the second cloth feeder 32.

The front body part position data acquisition portion 11 calculates the position data of the left shoulder part KL of the front body part Ca and the position data of the right shoulder part KR of the front body part Ca in the XY plane based on the image data acquired by the detector 313. The rear body part position data acquisition portion 12 calculates the position data of the left shoulder part KL of the rear body part Cb and the position data of the right shoulder part KR of the rear body part Cb in the XY plane based on the image data acquired by the detector 323.

The second control portion 14 calculates the deviation amount G between the position of the right shoulder part KR of the front body part Ca and the position of the right shoulder part KR of the rear body part Cb when the front body part Ca and the rear body part Cb overlap each other such that the position of the left shoulder part KL of the front body part Ca and the position of the left shoulder part KL of the rear body part Cb match each other, based on the position data of the left shoulder part KL of the front body part Ca and the position data of the right shoulder part KR of the front body part Ca which are calculated by the front body part position data acquisition portion 11, and the position data of the left shoulder part KL of the rear body part Cb and the position data of the right shoulder part KR of the rear body part Cb which are calculated by the rear body part position data acquisition portion 12. The deviation amount G calculated by the second control portion 14 is stored in the storage portion 18.

Figure 22:
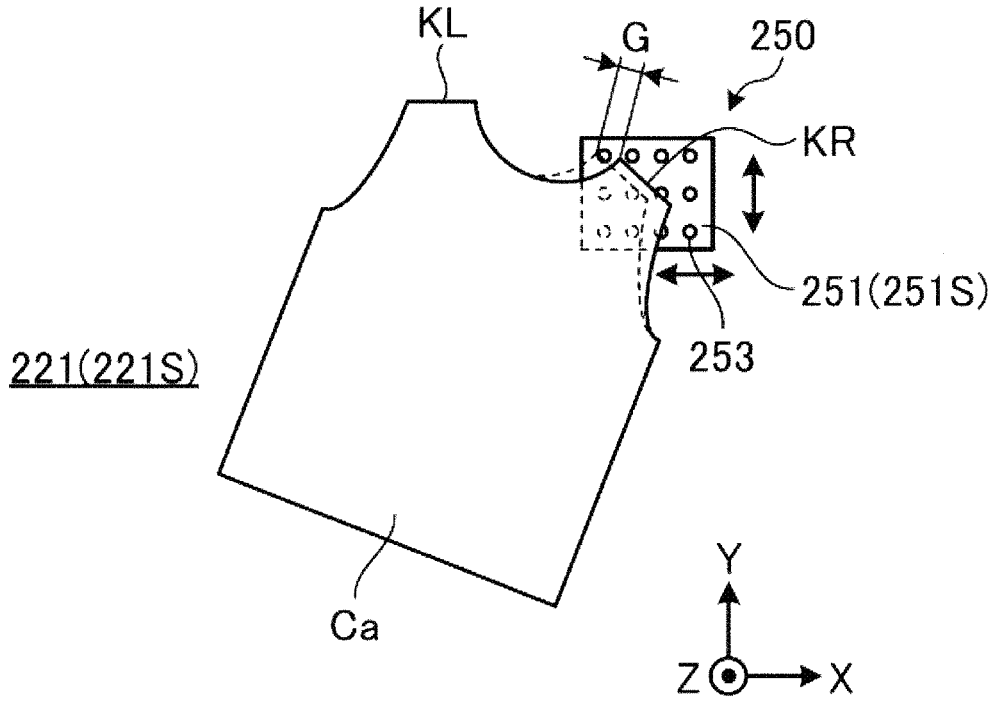
FIG. 22 is a plan view schematically illustrating an example of an operation of a cloth position adjustment device in a second sewing machine according to the embodiment.

FIG. 22 is a plan view schematically illustrating the operation of the cloth position adjustment device 250 in the second sewing machine according to the embodiment. FIG. 22 schematically illustrates the front body part Ca conveyed from the first cloth feeder 31 to the table 221 of the second sewing machine 22 by the cloth conveyor 4.

Based on the detection data of the detector 313, the cloth conveyor 4 conveys the front body part Ca to the table 221 such that the front body part Ca is installed at the target position defined in the second sewing machine 22. The cloth conveyor 4 conveys the front body part Ca to the table 221 such that the left shoulder part KL of the front body part Ca is installed on the installation surface 221S of the table 221, and the right shoulder part KR of the front body part Ca is installed on the holding surface 251S of the plate member 251 of the cloth position adjustment device 250.

After the front body part Ca is installed on the table 221, the cloth position adjustment device 250 performs a suction operation by the suction hole 253, and suctions and holds the right shoulder part KR of the front body part Ca by the holding surface 251S of the plate member 251. Accordingly, in a state where the left shoulder part KL of the front body part Ca is installed on the installation surface 221S of the table 221, the right shoulder part KR of the front body part Ca is held on the holding surface 251S of the plate member 251.

The second control portion 14 controls the actuator 252 of the cloth position adjustment device 250, moves the plate member 251 in the direction parallel to the installation surface 221S, and adjusts the position of the right shoulder part KR of the front body part Ca. The second control portion 14 moves the plate member 251 that suctions and holds the right shoulder part KR in the direction parallel to the installation surface 221 such that the deviation amount G calculated based on the detection data of the detector 313 and the detection data of the detector 323 and stored in the storage portion 18.

In other words, the second control portion 14 controls the actuator 252 and adjusts the movement amount of the plate member 251 that holds the right shoulder part KR of the front body part Ca such that the deviation amount G between the right shoulder part KR of the front body part Ca installed on the table 221 and the right shoulder part KR of the rear body part Cb conveyed to the table 221 later decreases.

Accordingly, as illustrated in FIG. 22, the position of the right shoulder part KR of the front body part Ca is adjusted from the position indicated by a dotted line to the position indicated by a solid line. Even when the right shoulder part KR of the front body part Ca moves due to the movement of the plate member 251, the left shoulder part KL of the front body part Ca is substantially stationary by the frictional force with the installation surface 221S of the table 221. The suction port connected to the vacuum system 70 may be provided on the installation surface 221S of the table 221, and the left shoulder part KL of the front body part Ca may be suctioned and held on the installation surface 221S of the table 221. As the left shoulder part KL of the front body part Ca is suctioned and held by the installation surface 221S of the table 221, even when the right shoulder part KR of the front body part Ca moves due to the movement of the plate member 251, the left shoulder part KL of the front body part Ca suctioned and held by the installation surface 221S of the table 221 is substantially stationary.

In a state where the left shoulder part KL of the front body part Ca is installed on the installation surface 221S of the table 221, by moving the plate member 251 that suctions and holds the right shoulder part KR of the front body part Ca in the XY plane, the cloth position adjustment device 250 can adjust the relative position between the right shoulder part KR of the front body part Ca held by the holding surface 251S and the left shoulder part KL of the front body part Ca installed on the installation surface 221S in the XY plane.

After the position of the right shoulder part KR of the front body part Ca installed on the table 221 is adjusted by the cloth position adjustment device 250, the rear body part Cb is conveyed to the table 221 of the second sewing machine 22 by the cloth conveyor 4. Based on the detection data of the detector 323, the conveyance control portion 17 controls the cloth conveyor 4 such that the rear body part Cb is disposed at the target position defined on the table 221, and adjusts the position of the rear body part Cb. The cloth conveyor 4 adjusts the position of the rear body part Cb relative to the front body part Ca installed on the table 221 such that the front body part Ca and the rear body part Cb which are installed on the table 221 of the second sewing machine 22 overlap each other.

Based on the detection data of the detector 313 and the detector 323, the conveyance control portion 17 controls the cloth conveyor 4 such that the left shoulder part KL of the front body part Ca installed on the installation surface 221S of the table 221 and the left shoulder part KL of the rear body part Cb conveyed to the table 221 by the cloth conveyor 4 match each other. Accordingly, the rear body part Cb on the front body part Ca installed on the table 221 is conveyed such that the position of the left shoulder part KL of the front body part Ca and the position of the left shoulder part KL of the rear body part Cb match each other on the installation surface 221S of the table 221. After the rear body part Cb is conveyed to the table 221 by the cloth conveyor 4, the conveyance control portion 17 releases the suctioned and held state of the rear body part Cb by the suction surface HS of the conveying member 6.

Figure 23:
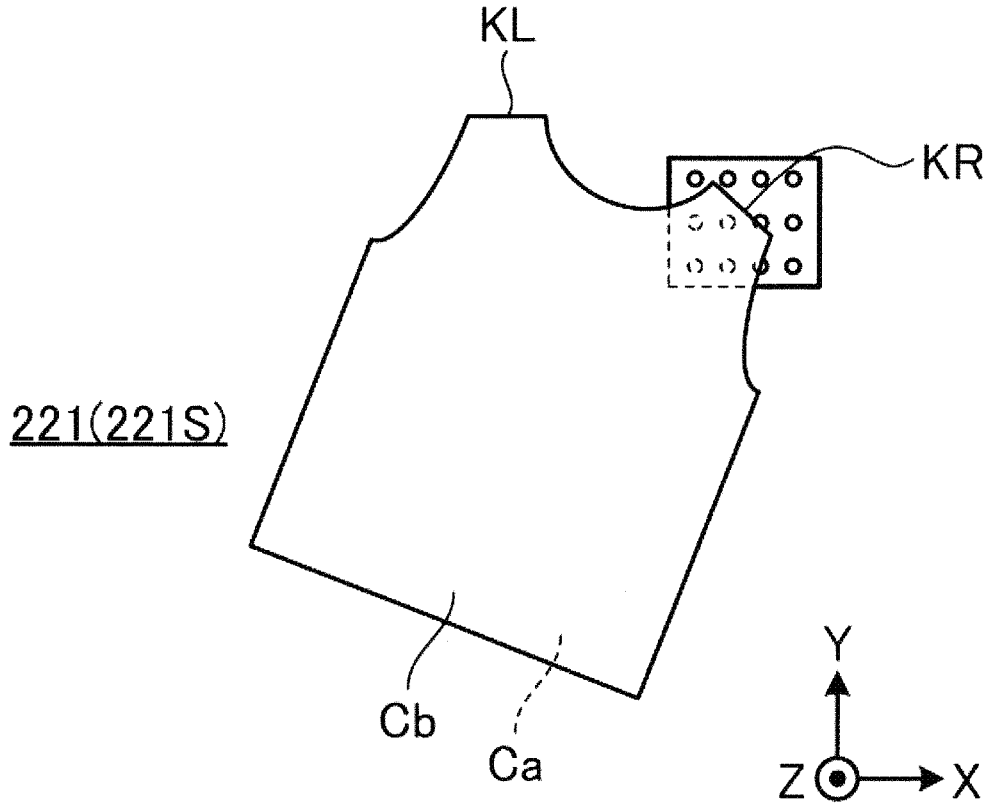
FIG. 23 is a plan view schematically illustrating the front body part and the rear body part in the second sewing machine according to the embodiment.

FIG. 23 is a plan view schematically illustrating the front body part Ca and the rear body part Cb in the second sewing machine 22 according to the embodiment. Before the rear body part Cb is conveyed to the table 221, the second control portion 14 controls the actuator 252 of the cloth position adjustment device 250 such that the deviation amount G decreases, and adjusts the relative position between the right shoulder part KR of the front body part Ca held by the holding surface 251S of the plate member 251 and the right shoulder part KR of the rear body part Cb conveyed by the cloth conveyor 4. The second control portion 14 controls the actuator 252 of the cloth position adjustment device 250, and moves the plate member 251 such that the position of the right shoulder part KR of the front body part Ca and the position of the right shoulder part KR of the rear body part Cb match each other on the holding surface 251S of the plate member 251. In other words, by the cloth position adjustment device 250, the relative position between the right shoulder part KR and the left shoulder part KL of the front body part Ca installed on the table 221 is adjusted to match the relative position between the right shoulder part KR and the left shoulder part KL of the rear body part Cb conveyed by the cloth conveyor 4. Therefore, by the cloth conveyor 4, as the rear body part Cb is conveyed onto the front body part Ca installed on the table 221, as illustrated in FIG. 23, on the table 221, the front body part Ca and the rear body part Cb overlap each other such that the position of the right shoulder part KR of the front body part Ca and the position of the right shoulder part KR of the rear body part Cb match each other and the position of the left shoulder part KL of the front body part Ca and the position of the left shoulder part KL of the rear body part Cb match each other.

Figure 24:
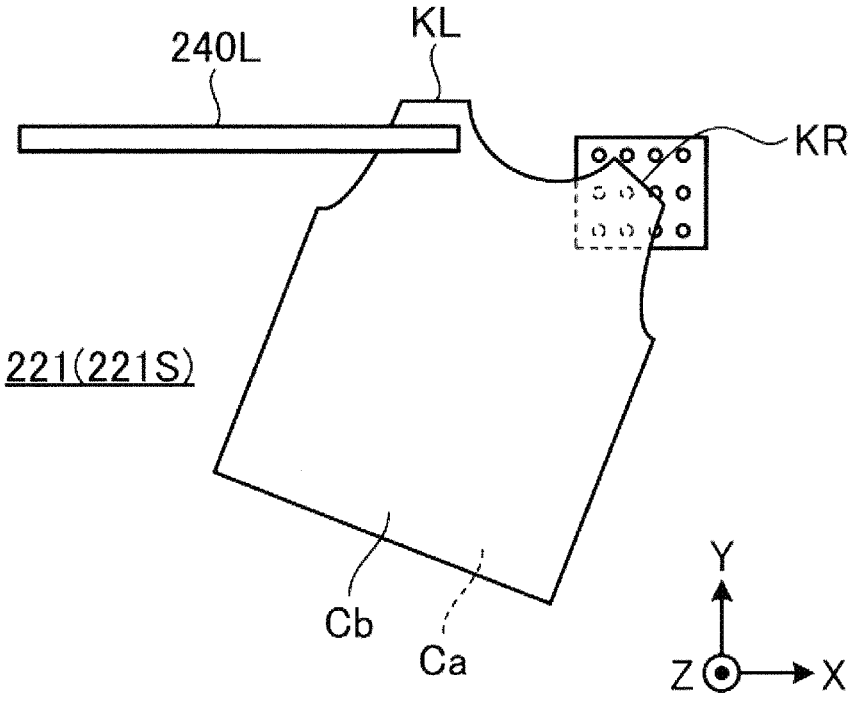
FIG. 24 is a plan view schematically illustrating an operation of the second sewing machine according to the embodiment.

FIG. 24 is a plan view schematically illustrating the operation of the second sewing machine according to the embodiment. After the front body part Ca and the rear body part Cb overlap each other such that the position of the right shoulder part KR of the front body part Ca and the position of the right shoulder part KR of the rear body part Cb match each other and the position of the left shoulder part KL of the front body part Ca and the position of the left shoulder part KL of the rear body part Cb match each other, as illustrated in FIG. 24, the second control portion 14 fixes the left shoulder part KL of the front body part Ca and the left shoulder part KL of the rear body part Cb to each other by the first cloth pressing member 240L. The left shoulder part KL of the front body part Ca and the left shoulder part KL of the rear body part Cb are fixed between the first cloth pressing member 240L and the table 221 by being pressed from above by the first cloth pressing member 240L.

Figure 25:
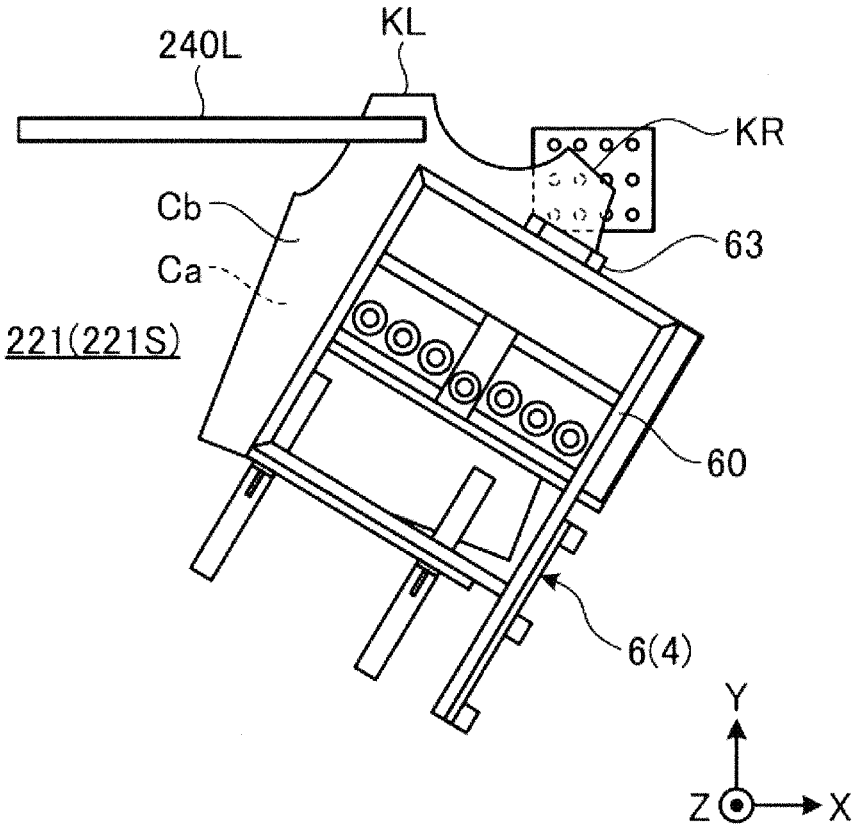
FIG. 25 is a plan view schematically illustrating an operation of the cloth conveyor in the second sewing machine according to the embodiment.
Figure 26:
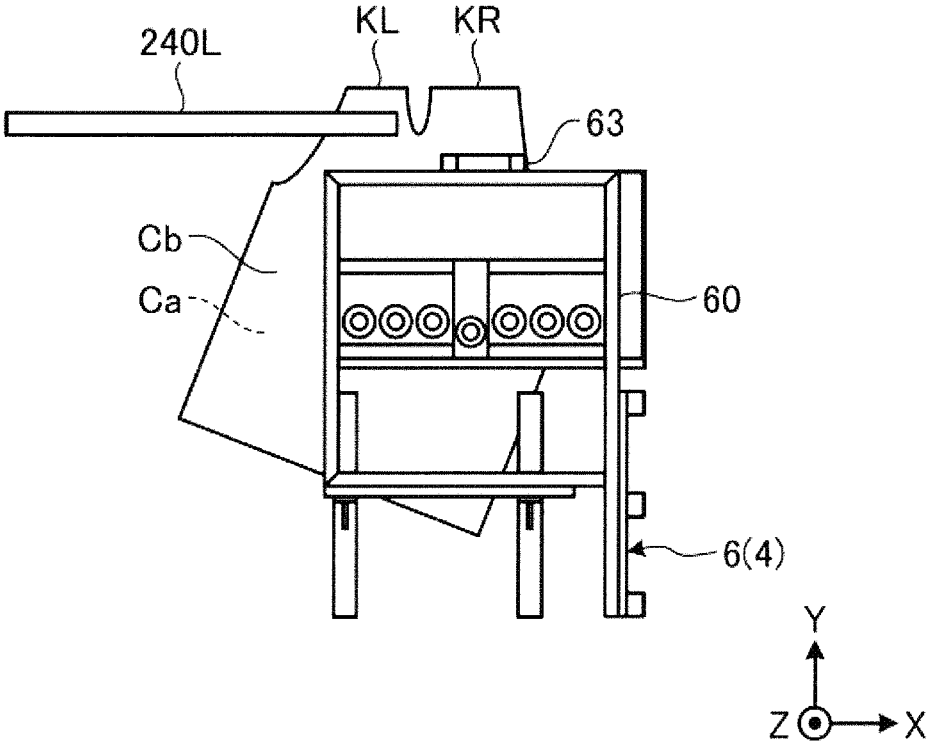
FIG. 26 is a plan view schematically illustrating an operation of the cloth conveyor in the second sewing machine according to the embodiment.

FIGS. 25 and 26 are plan views schematically illustrating the operation of the cloth conveyor 4 in the second sewing machine 22 according to the embodiment. After the left shoulder part KL of the front body part Ca and the left shoulder part KL of the rear body part Cb are fixed to each other by the first cloth pressing member 240L, as described with reference to FIG. 8B, the conveyance control portion 17 lowers the movable member 63 of the conveying member 6 such that the lower end portion of the movable member 63 is disposed below the suction surface HS.

The conveyance control portion 17 adjusts the position of the cloth conveyor 4, and brings the lower end portion of the movable member 63 into contact with the rear body part Cb. The conveyance control portion 17 controls the robot 5 in a state where at least a part of the rear body part Cb and the movable member 63 are in contact with each other, moves the movable member 63 that is in contact with at least a part of the rear body part Cb in the XY plane, and adjusts the position of the rear body part Cb and the position of the front body part Ca in the XY plane.

As illustrated in FIG. 25, in the embodiment, the conveyance control portion 17 moves the cloth conveyor 4 in the XY plane in a state where the vicinity of the right shoulder part KR of the cloth C and the movable member 63 are in contact with each other, and adjusts the position of the right shoulder part KR relative to the left shoulder part KL fixed to the first cloth pressing member 240L. As illustrated in FIG. 26, the conveyance control portion 17 adjusts the position of the right shoulder part KR relative to the left shoulder part KL such that the right shoulder part KR and the left shoulder part KL are disposed in a shape of a straight line.

Figure 27:
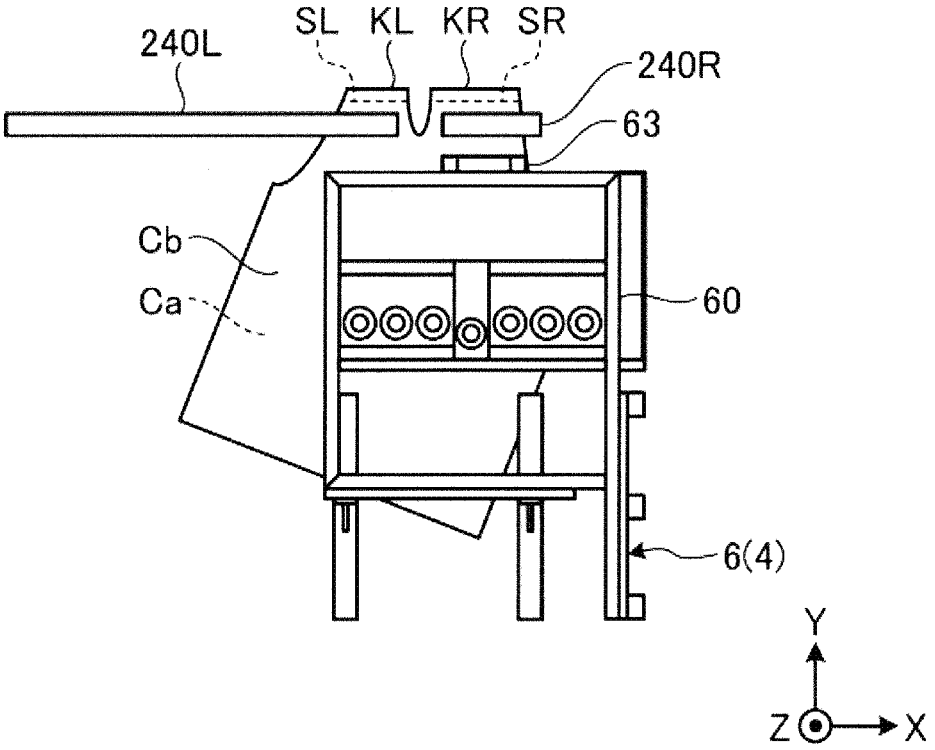
FIG. 27 is a plan view schematically illustrating an operation of the second sewing machine according to the embodiment.

FIG. 27 is a plan view schematically illustrating the operation of the second sewing machine 22 according to the embodiment. After the position of the right shoulder part KR relative to the left shoulder part KL is adjusted, as illustrated in FIG. 27, the second control portion 14 fixes the right shoulder part KR with the second cloth pressing member 240R. Accordingly, a seam line SL of the left shoulder part KL and a seam line SR of the right shoulder part KR are disposed on the same straight line.

Sewing Method

Figure 28:
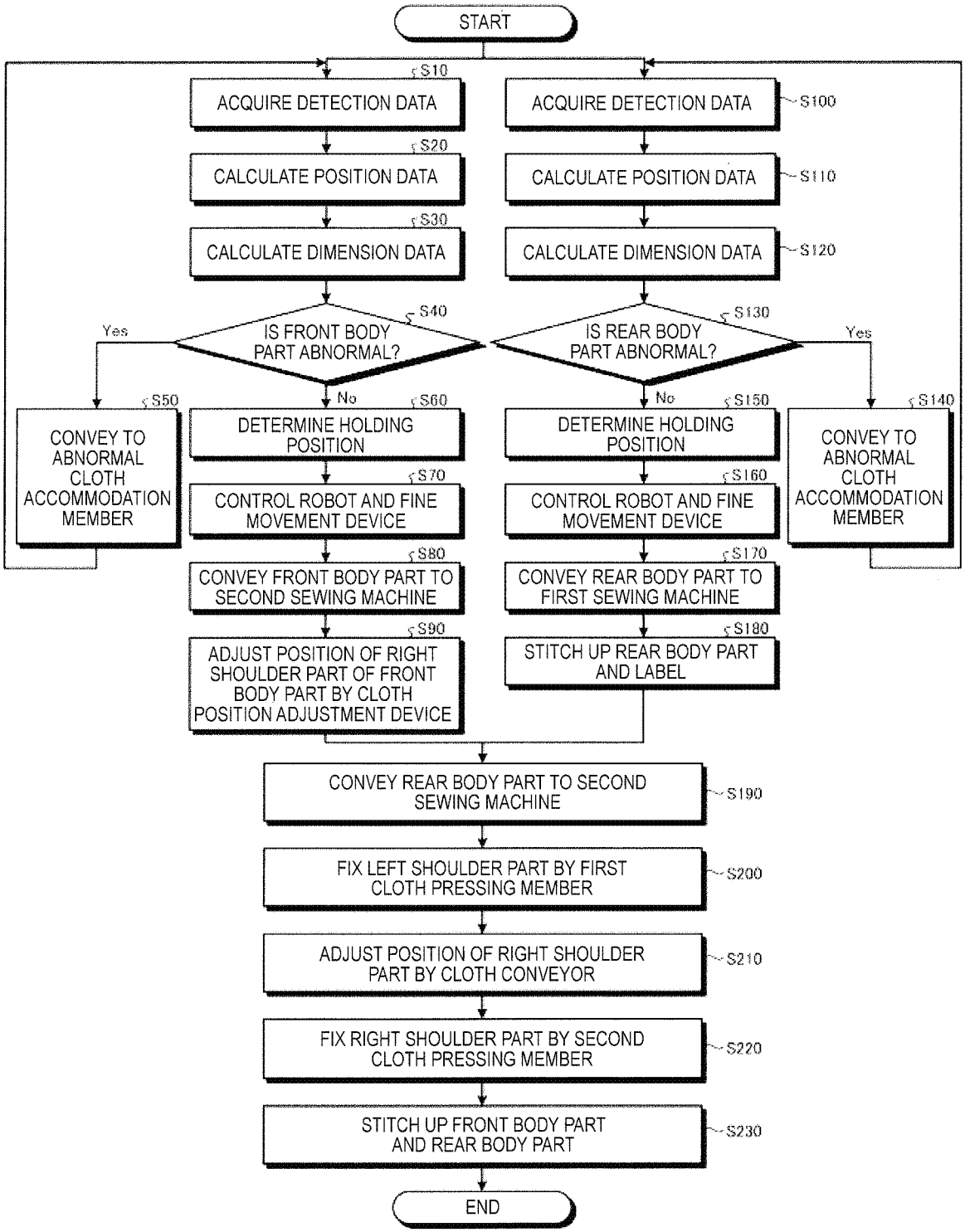
FIG. 28 is a flowchart illustrating a sewing method according to the embodiment.

FIG. 28 is a flowchart illustrating a sewing method according to the embodiment. One front body part Ca disposed at the top of the plurality of front body parts Ca stacked in the accommodator 311 of the first cloth feeder 31, is conveyed to the installation table 312 by the first pickup. The front body part Ca installed on the installation table 312 is detected by the detector 313. The front body part position data acquisition portion 11 acquires the detection data of the detector 313 (step S10).

The front body part position data acquisition portion 11 calculates the position data of the edge of the front body part Ca in the XY plane based on the detection data of the detector 323 (step S20).

As described with reference to FIG. 16, as the position data of the edge of the front body part Ca, the front body part position data acquisition portion 11 calculates the positions of the intersection Pa, the intersection Pb, the intersection Pc, the intersection Pd, the intersection Pe, the intersection Pf, the intersection Pg, and intersection Ph of the front body part Ca.

The front body part position data acquisition portion 11 calculates the dimension data of the front body part Ca based on the position data of the edge of the front body part Ca (step S30).

As described with reference to FIG. 16, as the dimension data of the front body part Ca, the front body part position data acquisition portion 11 calculates the dimension La, the dimension Lb, the dimension Lc, the dimension Ld, the dimension Le, the dimension Lf, and the dimension Lg.

The abnormality decision portion 16 determines whether the front body part Ca installed on the installation table 312 is abnormal by collating the dimension data of the front body part Ca with the correct data of the dimension of the front body part Ca stored in the storage portion 18 (step S40).

In step S40, in a case where it is determined that the front body part Ca is abnormal (step S40: Yes), the conveyance control portion 17 controls the cloth conveyor 4 such that the front body part Ca determined to be abnormal is conveyed from the installation table 312 to an abnormal cloth accommodation member 601 (step S50).

As illustrated in FIG. 1 and the like, the abnormal cloth accommodation member 601 is disposed at a position adjacent to the installation table 312. The conveyance control portion 17 controls the cloth conveyor 4 such that the front body part Ca determined to be abnormal is conveyed to the abnormal cloth accommodation member 601 in a state of being pinched by the gripper 500.

As illustrated in FIG. 11, in a case of gripping the front body part Ca installed on the installation table 312 by the gripper 500, the conveyance control portion 17 controls the actuator 510 such that the lower end portion of the gripping member 502 is disposed below the suction surface HS of the conveying member 6. The conveyance control portion 17 controls the actuator 503 and pinches a part of the front body part Ca determined to be abnormal and installed on the installation table 312 by the gripping member 502. After a part of the front body part Ca is pinched by the gripping member 502, the conveyance control portion 17 controls the robot 5 such that the front body part Ca pinched by the gripper 500 is conveyed from the installation table 312 to the abnormal cloth accommodation member 601. After the front body part Ca pinched by the gripper 500 is disposed above the abnormal cloth accommodation member 601, the conveyance control portion 17 controls the actuator 503 and releases the gripped state of the front body part Ca by the gripping member 502. Accordingly, the front body part Ca determined to be abnormal falls and is accommodated in the abnormal cloth accommodation member 601.

After the front body part Ca determined to be abnormal is conveyed to the abnormal cloth accommodation member 601, the new front body part Ca accommodated in the accommodator 311 is installed on the installation table 312. The controller 10 performs the processing from step S10 to step S40 regarding the front body part Ca installed on the installation table 312.

In step S40, in a case where it is determined that the front body part Ca is not abnormal (step S40: No), the conveyance control portion 17 controls the cloth conveyor 4 such that the front body part Ca determined not to be abnormal is conveyed from the installation table 312 to the second sewing machine 22.

The holding position decision portion 15 determines the holding position HP of the front body part Ca based on the detection data of the detector 313 (step S60).

The holding position HP includes the holding position HP1 and the holding position HP2. The holding position HP2 includes the reference holding position HP2*r* and the non-reference holding position HP2*l*. As described with reference to FIGS. 17 and 18, the holding position decision portion 15 determines the reference holding position HP2*r* to be at the first prescribed distance Ga from the reference edge WR, and the non-reference holding position HP2*l* to be at the second prescribed distance Gb from the non-reference edge WL.

After the holding position HP is determined, the conveyance control portion 17 controls the robot 5 and the power generator 401 of the fine movement device 400 such that the non-reference holding member 62*l* holds the non-reference holding position HP2*l* in a state where the reference holding member 62*r* holds the reference holding position HP2*r* (step S70).

In other words, after moving the cloth conveyor 4 to the first feeding position PF1 above the installation table 312, the conveyance control portion 17 controls the robot 5 and aligns the reference holding member 62*r* supported by the main body member 60 and the reference holding position HP2*r* defined in the front body part Ca installed on the installation table 312 in the XY plane. After the reference holding member 62*r* and the reference holding position HP2*r* are aligned in the XY plane, in a state where the relative position between the reference holding member 62*r* and the reference holding position HP2*r* is maintained, the conveyance control portion 17 controls the power generator 401 of the fine movement device 400 and aligns the non-reference holding member 62*l* supported by the second supporting member 66 and the non-reference holding position HP2*l* defined in the front body part Ca installed on the installation table 312 in the XY plane. The conveyance control portion 17 can hold the reference holding position HP2*r* by the reference holding member 62*r* and hold the non-reference holding position HP2*l* by the non-reference holding member 62*l* by lowering the cloth conveyor 4 in a state where the reference holding member 62*r* and the reference holding position HP2*r* are aligned in the XY plane and the non-reference holding member 62*l* and the non-reference holding position HP2*l* are aligned in the XY plane.

The position data of the front body part Ca includes position data of the circumferential edge part of the front body part Ca including the left shoulder part KL, the right shoulder part KR, the left side part WL, and the right side part WR of the front body part Ca in the XY plane. The position data of the rear body part Cb includes the position data of the circumferential edge part of the rear body part Cb including the left shoulder part KL, the right shoulder part KR, the left side part WL, and the right side part WR of the rear body part Cb in the XY plane. The second control portion 14 calculates the deviation amount G between the position of the right shoulder part KR of the front body part Ca and the position of the right shoulder part KR of the rear body part Cb when the front body part Ca and the rear body part Cb overlap each other such that the position of the left shoulder part KL of the front body part Ca and the position of the left shoulder part KL of the rear body part Cb match each other, based on the position data of the left shoulder part KL of the front body part Ca, the position data of the right shoulder part KR of the front body part Ca, the position data of the left shoulder part KL of the rear body part Cb, and the position data of the right shoulder part KR of the rear body part Cb which are calculated in step S10. The storage portion 18 stores the data indicating the calculated deviation amount G.

After the conveyance control portion 17 suctions and holds one front body part Ca installed on the installation table 312 on the suction surface HS of the cloth conveyor 4, the conveyance control portion 17 controls the robot 5 and conveys the front body part Ca held by the cloth conveyor 4 from the installation table 312 to the second sewing machine 22 (step S80).

The conveyance control portion 17 moves the cloth conveyor 4 that holds the front body part Ca to the second sewing machine position PH2. The conveyance control portion 17 adjusts the position of the front body part Ca held by the cloth conveyor 4 at the second sewing machine position PH2 such that the front body part Ca is conveyed to the target position defined on the table 221 of the second sewing machine 22.

In the embodiment, the conveyance control portion 17 conveys the front body part Ca to the table 221 by the cloth conveyor 4 such that the left shoulder part KL of the front body part Ca is installed on the installation surface 221S of the table 221 and the right shoulder part KR of the front body part Ca is installed on the holding surface 251S of the plate member 251 provided on the table 221.

The conveyance control portion 17 releases the suctioned and held state of the front body part Ca by the suction surface Hs of the cloth conveyor 4 after conveying the front body part Ca to the table 221 of the second sewing machine 22 by the cloth conveyor 4 and adjusting the position of the front body part Ca. Accordingly, the front body part Ca passes the table 221 of the second sewing machine 22. After the front body part Ca passes from the cloth conveyor 4 to the table 221 of the second sewing machine 22, the conveyance control portion 17 moves the cloth conveyor 4 to the second feeding position PF2.

The second control portion 14 controls the cloth position adjustment device 250 and adjusts the position of the right shoulder part KR of the front body part Ca installed on the table 221 (step S90).

As described with reference to FIG. 22, the right shoulder part KR of the front body part Ca is suctioned and held on the plate member 251. The left shoulder part KL of the front body part Ca is installed on the installation surface 221S of the table 221. The second control portion 14 controls the actuator 252 of the cloth position adjustment device 250, moves the plate member 251 in the direction parallel to the installation surface 221S, and moves the plate member 251 that suctions and holds the right shoulder part KR in the direction parallel to the installation surface 221S such that the deviation amount G stored in the storage portion 18 decreases.

In the second cloth feeder 32, one rear body part Cb disposed at the top of the plurality of rear body parts Cb stacked in the accommodator 321 of the second cloth feeder 32, is conveyed to the installation table 322 by the second pickup. The rear body part Cb installed on the installation table 322 is detected by the detector 323. The rear body part position data acquisition portion 12 acquires the detection data of the detector 323 (step S100).

The rear body part position data acquisition portion 12 calculates the position data of the edge of the rear body part Cb in the XY plane based on the detection data of the detector 323 (step S110).

As described with reference to FIG. 16, as the position data of the edge of the rear body part Cb, the rear body part position data acquisition portion 12 calculates the positions of the intersection Pa, the intersection Pb, the intersection Pc, the intersection Pd, the intersection Pe, the intersection Pf, the intersection Pg, and intersection Ph of the rear body part Cb.

The rear body part position data acquisition portion 12 calculates the dimension data of the rear body part Cb based on the position data of the edge of the rear body part Cb (step S120).

As described with reference to FIG. 16, as the dimension data of the rear body part Cb, the rear body part position data acquisition portion 12 calculates the dimension La, the dimension Lb, the dimension Lc, the dimension Ld, the dimension Le, the dimension Lf, and the dimension Lg.

The abnormality decision portion 16 determines whether the rear body part Cb installed on the installation table 322 is abnormal by collating the dimension data of the rear body part Cb with the correct data of the dimension of the rear body part Cb stored in the storage portion 18 (step S130).

In step S130, in a case where it is determined that the rear body part Cb is abnormal (step S130: Yes), the conveyance control portion 17 controls the cloth conveyor 4 such that the rear body part Cb determined to be abnormal is conveyed from the installation table 322 to an abnormal cloth accommodation member 602 (step S140).

As illustrated in FIG. 1 and the like, the abnormal cloth accommodation member 602 is disposed at a position adjacent to the installation table 322. The conveyance control portion 17 controls the cloth conveyor 4 such that the rear body part Cb determined to be abnormal is conveyed to the abnormal cloth accommodation member 602 in a state of being pinched by the gripper 500.

As illustrated in FIG. 11, in a case of gripping the rear body part Cb installed on the installation table 322 by the gripper 500, the conveyance control portion 17 controls the actuator 510 such that the lower end portion of the gripping member 502 is disposed below the suction surface HS of the conveying member 6. The conveyance control portion 17 controls the actuator 503 and pinches a part of the rear body part Cb determined to be abnormal and installed on the installation table 322 by the gripping member 502. After a part of the rear body part Cb is pinched by the gripping member 502, the conveyance control portion 17 controls the robot 5 such that the rear body part Cb pinched by the gripper 500 is conveyed from the installation table 322 to the abnormal cloth accommodation member 602. After the rear body part Cb pinched by the gripper 500 is disposed above the abnormal cloth accommodation member 602, the conveyance control portion 17 controls the actuator 503 and releases the gripped state of the rear body part Cb by the gripping member 502. Accordingly, the rear body part Cb determined to be abnormal falls and is accommodated in the abnormal cloth accommodation member 602.

After the rear body part Cb determined to be abnormal is conveyed to the abnormal cloth accommodation member 602, the new rear body part Cb accommodated in the accommodator 321 is installed on the installation table 322. The controller 10 performs the processing from step S100 to step S130 regarding the rear body part Cb installed on the installation table 322.

In step S40, in a case where it is determined that the rear body part Cb is not abnormal (step S13: No), the conveyance control portion 17 controls the cloth conveyor 4 such that the rear body part Cb determined not to be abnormal is conveyed from the installation table 322 to the first sewing machine 21.

The holding position decision portion 15 determines the holding position HP of the rear body part Cb based on the detection data of the detector 323 (step S150).

The holding position HP includes the holding position HP1 and the holding position HP2. The holding position HP2 includes the reference holding position HP2*r* and the non-reference holding position HP2*l*. As described with reference to FIGS. 17 and 18, the holding position decision portion 15 determines the reference holding position HP2*r* to be at the first prescribed distance Ga from the reference edge WR, and the non-reference holding position HP2*l* to be at the second prescribed distance Gb from the non-reference edge WL. On the rear body part Cb, the reference holding position HP2*r* is determined to be a part on the periphery of the target part RP to which the label L is stitched.

After the holding position HP is determined, the conveyance control portion 17 controls the robot 5 and the power generator 401 of the fine movement device 400 such that the non-reference holding member 62*l* holds the non-reference holding position HP2*l* in a state where the reference holding member 62*r* holds the reference holding position HP2*r* (step S160).

In other words, after moving the cloth conveyor 4 to the second feeding position PF2 above the installation table 322, the conveyance control portion 17 controls the robot 5 and aligns the reference holding member 62*r* supported by the main body member 60 and the reference holding position HP2*r* defined in the rear body part Cb installed on the installation table 312 in the XY plane. After the reference holding member 62*r* and the reference holding position HP2*r* are aligned in the XY plane, in a state where the relative position between the reference holding member 62*r* and the reference holding position HP2*r* is maintained, the conveyance control portion 17 controls the power generator 401 of the fine movement device 400 and aligns the non-reference holding member 62*l* supported by the second supporting member 66 and the non-reference holding position HP2*l* defined in the rear body part Cb installed on the installation table 322 in the XY plane. The conveyance control portion 17 can hold the reference holding position HP2*r* by the reference holding member 62*r* and hold the non-reference holding position Hp2*l* by the non-reference holding member 62*l* by lowering the cloth conveyor 4 in a state where the reference holding member 62*r* and the reference holding position HP2*r* are aligned in the XY plane and the non-reference holding member 62*l* and the non-reference holding position HP2*l* are aligned in the XY plane.

After the conveyance control portion 17 suctions and holds one rear body part Cb installed on the installation table 322 on the suction surface HS of the cloth conveyor 4, the conveyance control portion 17 controls the robot 5 and conveys the rear body part Cb held by the cloth conveyor 4 from the installation table 322 to the first sewing machine 21 (step S170).

The processing of conveying the rear body part Cb from the installation table 322 to the first sewing machine 21 is performed in parallel with at least a part of the processing of adjusting the position of the right shoulder part KR of the front body part Ca by the cloth position adjustment device 250.

The conveyance control portion 17 moves the cloth conveyor 4 that holds the rear body part Cb to the first sewing machine position PH1. The conveyance control portion 17 adjusts the position of the rear body part Cb held by the cloth conveyor 4 at the first sewing machine position PH1 such that the rear body part Cb is conveyed to the target position defined on the table 221 of the first sewing machine 21.

As described with reference to FIG. 19, the conveyance control portion 17 adjusts the position of the rear body part Cb held by the cloth conveyor 4 such that the target part PR of the right side part WR of the rear body part Cb is disposed at the first stitch position PM1. Based on the detection data of the position sensor 217, the conveyance control portion 17 finely adjusts the relative position between the rear body part Cb held by the cloth conveyor 4 and the first stitch position PM1, at the first sewing machine position PH1.

The first control portion 13 controls the first sewing machine 21, and stitches up the rear body part Cb suctioned and held by the suction surface HS of the cloth conveyor 4 and the label L fed from the label feeder 8 (step S180).

The head 212 stitches up the rear body part Cb and the label L while feeding the rear body part Cb and the label L in the sewing direction. The conveyance control portion 17 moves the cloth conveyor 4 that holds the rear body part Cb in the sewing direction in synchronization with the stitching of the rear body part Cb and the label L by the head 212 of the first sewing machine 21. The conveyance control portion 17 moves the cloth conveyor 4 in the sewing direction while pressing the rear body part Cb against the table 211 with the cloth conveyor 4.

After the stitching of the rear body part Cb and the label L in the first sewing machine 21 is completed, the conveyance control portion 17 controls the cloth conveyor 4, and conveys the rear body part Cb from the first sewing machine 21 to the second sewing machine 22 (step S190).

The conveyance control portion 17 moves the cloth conveyor 4 that holds the rear body part Cb to the second sewing machine position PH2. The conveyance control portion 17 adjusts the position of the rear body part Cb held by the cloth conveyor 4 at the second sewing machine position PH2 such that the rear body part Cb is conveyed to the target position defined on the table 221 of the second sewing machine 22. The conveyance control portion 17 controls the rear cloth conveyor 4 and adjusts the position of the rear body part Cb relative to the front body part Ca installed on the table 221 of the second sewing machine 22.

The conveyance control portion 17 adjusts the position of the cloth conveyor 4 such that the front body part Ca installed on the table 221 and the rear body part Cb held by the cloth conveyor 4 overlap each other on the table 221. Before the rear body part Cb is conveyed to the table 221 by the cloth conveyor 4, in step S90, the position of the right shoulder part KR of the front body part Ca is adjusted. Therefore, as the conveyance control portion 17 controls the cloth conveyor 4 such that the left shoulder part KL of the front body part Ca installed on the installation surface 221S of the table 221 and the left shoulder part KL of the rear body part Cb conveyed to the table 221 by the cloth conveyor 4 match each other, as described with reference to FIG. 23, on the table 221, the front body part Ca and the rear body part Cb can overlap each other such that the position of the right shoulder part KR of the front body part Ca and the position of the right shoulder part KR of the rear body part Cb match each other and the position of the left shoulder part KL of the front body part Ca and the position of the left shoulder part KL of the rear body part Cb match each other.

The conveyance control portion 17 controls the cloth conveyor 4, and releases the suctioned and held state of the rear body part Cb by the suction surface Hs of the cloth conveyor 4 after conveying the rear body part Cb held by the cloth conveyor 4 to the table 221 of the second sewing machine 22 and adjusting the position of the rear body part Cb. Accordingly, the rear body part Cb passes the table 221 of the second sewing machine 22 and overlaps the front body part Ca. The front body part Ca and the rear body part Cb overlap each other such that the position of the right shoulder part KR of the front body part Ca and the position of the right shoulder part KR of the rear body part Cb match each other and the position of the left shoulder part KL of the front body part Ca and the position of the left shoulder part KL of the rear body part Cb match each other.

After the front body part Ca and the rear body part Cb are installed on the table 221 of the second sewing machine 22 and the suctioned and held state of the rear body part Cb is released by the cloth conveyor 4, as described with reference to FIG. 24, the second control portion 14 fixes the left shoulder part KL of the front body part Ca and the left shoulder part KL of the rear body part Cb to each other by the first cloth pressing member 240L (step S200).

After the left shoulder part KL of the front body part Ca and the left shoulder part KL of the rear body part Cb are fixed to each other by the first cloth pressing member 240L, as described with reference to FIG. 8B, the conveyance control portion 17 lowers the movable member 63 of the conveying member 6 such that the lower end portion of the movable member 63 is disposed below the suction surface HS.

The conveyance control portion 17 adjusts the position of the cloth conveyor 4, and brings the lower end portion of the movable member 63 into contact with the rear body part Cb separated from the suction surface HS of the cloth conveyor 4. In a state where the movable member 63 and the rear body part Cb are in contact with each other, the conveyance control portion 17 controls the robot 5, moves the movable member 63 in the XY plane, adjusts the positions of the rear body part Cb and the front body part Ca.

As described with reference to FIG. 25, the conveyance control portion 17 moves the cloth conveyor 4 in the XY plane in a state where the vicinity of the right shoulder part KR of the cloth C and the movable member 63 are in contact with each other, and adjusts the position of the right shoulder part KR relative to the left shoulder part KL fixed to the first cloth pressing member 240L.

As described with reference to FIG. 26, the conveyance control portion 17 adjusts the position of the right shoulder part KR relative to the left shoulder part KL such that the right shoulder part KR and the left shoulder part KL are disposed in a shape of a straight line. As described with reference to FIG. 27, the conveyance control portion 17 adjusts the position of the right shoulder part KR relative to the left shoulder part KL such that the seam line SL of the left shoulder part KL and the seam line SR of the right shoulder part KR are disposed on the same straight line (step S210).

By adjusting the position of the right shoulder part KR relative to the left shoulder part KL such that the right shoulder part KR and the left shoulder part KL are disposed in a shape of a straight line, there is a possibility that wrinkles are generated at least at a part of the cloth C between the right shoulder part KR and the left shoulder part KL. The conveyance control portion 17 can smooth the wrinkles by moving the robot 5 in the XY plane in a state where the movable member 63 and the cloth C are in contact with each other.

After the position of the right shoulder part KR is adjusted by the movable member 63 of the cloth conveyor 4, as described with reference to FIG. 27, the second control portion 14 fixes the right shoulder part KR of the front body part Ca and the right shoulder part KR of the rear body part Cb by the second cloth pressing member 240R (step S70).

After the front body part Ca and the rear body part Cb are fixed to each other by the first cloth pressing member 240L and the second cloth pressing member 240R, the second control portion 14 controls the cloth pressing conveyor 230, and holds the front body part Ca and the rear body part Cb by the cloth pressing conveyor 230. The second control portion 14 controls the head 222, and stitches up the front body part Ca and the rear body part Cb along the seam line SL and the seam line SR (step S230). The front body part Ca and the rear body part Cb are stitched up by the head 222 while being moved in the sewing direction parallel to the X-axis direction.

Effects

As described above, according to the embodiment, the sewing system 1 includes the cloth conveyor 4 that holds the cloth C fed from the cloth feeder 3 and conveys the cloth C to the sewing machine 2. By providing the cloth conveyor 4 including the robot 5, the cloth C is fed to the sewing machine 2 quickly and accurately. Therefore, deterioration in productivity of clothing is prevented.

According to the embodiment, the holding position HP1 and the holding position HP2 of the cloth C are determined based on the detection data of the edge of the cloth C, and the cloth conveyor 4 is controlled such that the holding member 61 holds the holding position HP1 and the holding member 62 holds the holding position HP2. Accordingly, the cloth conveyor 4 can hold the appropriate holding position HP of the cloth C. By detecting the position data of the edge of the entire cloth C, for example, even when the processing of teaching the holding position HP to the cloth conveyor 4 is not performed before the sewing processing, the cloth C can be fed to the sewing machine 2 quickly and accurately.

According to the embodiment, the holding position HP2 is determined to be at a prescribed distance from the edge of the cloth C. For example, in a case where the holding position HP2 is set to a position where the distance from the edge is long on the cloth C, or the holding position HP2 is set to a center portion of the cloth C, the cloth conveyor 4 conveys the cloth C in a state where a part of the cloth C on the outer side of the holding position HP2 held by the holding member 62 hangs down. When the part that hangs down in the cloth C is large, there is a possibility that the part comes into contact with a member on the periphery during the conveyance of the cloth C or the holding by the holding member 62 becomes unstable. When the holding position HP2 is extremely close to or extremely far from the edge of the cloth C, there is a high possibility that a holding failure (suction error) of the cloth C by the holding member 62 occurs. By determining the holding position HP2 to be at a prescribed distance from the edge at which the holding member 62 can stably hold the cloth C, the cloth conveyor 4 can stably convey the cloth C.

In the embodiment, the reference holding position HP2*r* is determined to be at the first prescribed distance Ga from the reference edge WR. The reference holding position HP2*r* is held by the reference holding member 62*r* of which the relative position to the main body member 60 is fixed. The non-reference holding position HP2*l* is held by the reference holding member 62*r* of which the relative position to the main body member 60 is fixed. By controlling the robot 5, the conveyance control portion 17 can align the non-reference holding position HP2*l* and the reference holding member 62*r* with high accuracy.

The reference holding position HP2*r* is determined to be a part on the periphery of the target part RP to which the label L is stitched on the rear body part Cb. Since the non-reference holding position HP2*l* and the reference holding member 62*r* are aligned with high accuracy, when the cloth conveyor 4 conveys the rear body part Cb to the first sewing machine 21, the conveyance control portion 17 can control the robot 5 and align the first stitch position PM1 and the target part RP in the first sewing machine 21 with high accuracy. Accordingly, it is possible to stitch the label L to a correct position of the rear body part Cb.

The non-reference holding position HP2*l* is defined to be at the second prescribed distance Gb from the non-reference edge WL. The non-reference holding position HP2*l* is held by the non-reference holding member 62*l* that can change the relative position between the main body member 60 and the reference holding member 62*r*. Accordingly, even when the dimension of the cloth C changes due to the expansion and contraction or cutting errors of the cloth C, the non-reference holding member 62*l* moves regarding the reference holding member 62*r*, and accordingly, in a state where the reference holding member 62*r* holds the reference holding position HP2*r*, it is possible to hold the non-reference holding position HP2*l* at the second prescribed distance Gb from the non-reference edge WL. Since the fine movement device 400 for finely moving the non-reference holding member 62*l* regarding the main body member 60 is provided, the position of the non-reference holding member 62*l* can be accurately aligned regarding the non-reference holding position HP2*l*.

In the embodiment, in the XY plane, the distance between the connecting member 71 and the power generator 401 is shorter than the distance between the connecting member 71 and the holding member 62. In other words, the power generator 401 of the fine movement device 400 is disposed in the vicinity of the connecting member 71 connected to the robot 5. Accordingly, even when the weight of the power generator 401 is large, the moment that acts on the main body member 60 is reduced. Therefore, the main body member 60 can move in a state of being held by the robot 5 with an excellent weight balance. The robot 5 can move the main body member 60 having an excellent weight balance with high position accuracy.

Even when the power generator 401 and the second supporting member 66 are separated from each other, the power generated by the power generator 401 is transmitted to the second supporting member 66 that supports the non-reference holding member 62*l* via the power transmission mechanism 402.

The reference edge WR has a shape of a straight line and the holding position decision portion 15 defines the plurality of reference holding positions HP2*r* such that a line that connects the first reference holding position 62*r* and the second reference holding position 62*r* to each other becomes parallel to the reference edge WR. In a case where the target part RP to which the label L is stitched is defined between the first reference holding position 62*r* and the second reference holding position 62*r*, as the line that connects the first reference holding position 62*r* and the second reference holding position 62*r* to each other is parallel to the reference edge WR, in the first sewing machine 21, in a state where each of the two reference holding positions HP2*r* is held by the reference holding member 62*r*, the label L can be smoothly stitched to the target part RP. In the conveyance of the cloth C, the cloth C does not hang down.

In the embodiment, it is possible to easily determine whether there is an abnormality in the cloth C by collating the detection data of the edge of the cloth C with the reference data. By conveying the cloth C determined to be abnormal to the abnormal cloth accommodation members 601 and 602, it is possible to prevent continuation of the sewing processing of the abnormal cloth C. Accordingly, deterioration in efficiency of the sewing processing is prevented.

In a state of being pinched by the gripper 500, the cloth C determined to be abnormal is conveyed to the abnormal cloth accommodation members 601 and 602. There is a high possibility that the holding member 61 and the holding member 62 do not suction and hold the abnormal cloth C. Even in a case of the abnormal cloth C, by pinching a part of the cloth C, the gripper 500 can smoothly convey the cloth C to the abnormal cloth accommodation members 601 and 602.

In the embodiment, the cloth conveyor 4 holds the cloth C from above. Accordingly, the cloth conveyor 4 can move above each of the first feeding position PF1, the second feeding position PF2, the first sewing machine position PH1, and the second sewing machine position PH2, and quickly convey the cloth C by holding the cloth C from above or releasing the held state.

In the embodiment, the first sewing machine 21 includes the table 211 and the head 212 that stitches the rear body part Cb installed on the table 211, and the cloth conveyor 4 conveys the rear body part Cb to the table 211. Accordingly, the first sewing machine 21 can quickly perform the stitching up of the rear body part Cb conveyed to the table 211 and the label L. The second sewing machine 22 includes the table 211 and the head 212 that stitches up the front body part Ca and the rear body part Cb which are installed on the table 221, and the cloth conveyor 4 conveys the front body part Ca and the rear body part Cb to the table 211. Accordingly, the second sewing machine 22 can quickly perform the stitching of the front body part Cb and the rear body part Cb which are conveyed to the table 212.

In the embodiment, the cloth conveyor 4 holds the rear body part Cb in the stitching of the head 212. For example, when the held state of the rear body part Cb by the cloth conveyor 4 is released before the stitching in the head 212, there is a possibility that it is necessary to additionally provide a position adjustment mechanism for adjusting the relative position between the first stitch position PM1 and the rear body part Cb. There is a possibility that it is necessary to ensure the time required for the position adjustment by the position adjustment mechanism. As a result, there is a possibility that the equipment costs increase or productivity of clothing deteriorates. In the embodiment, the rear body part Cb is stitched with the label L in the first sewing machine 21 in a state of being held by the cloth conveyor 4. Therefore, the increase in equipment costs and deterioration in productivity are prevented.

In the embodiment, the head 212 stitches the rear body part Cb while feeding the rear body part Cb in the sewing direction, and the cloth conveyor 4 holds and moves the rear body part Cb in the sewing direction in synchronization with the stitching by the head 212. Accordingly, the sewing in the head 212 is performed smoothly.

In the embodiment, the cloth conveyor 4 presses the rear body part Cb against the table 211. Accordingly, the stitching in the first sewing machine 21 is performed smoothly.

In the embodiment, the cloth conveyor 4 conveys the rear body part Cb against the second sewing machine 22 from the first sewing machine 21. Accordingly, even in a case where clothing is manufactured through the plurality of processes by the plurality of sewing machines 2, the cloth C is fed to each of the plurality of sewing machines 2 quickly and accurately. Therefore, the deterioration in productivity of clothing is prevented.

In the embodiment, the cloth conveyor 4 continues to hold the rear body part Cb in the conveyance of the rear body part Cb from the first cloth feeder 31 to the first sewing machine 21, the stitching of the rear body part Cb by the first sewing machine 21, and the conveyance of the rear body part Cb from the first sewing machine 21 to the second sewing machine 22. When the cloth conveyor 4 frequently repeats the holding and releasing and the holding of the rear body part Cb, it is necessary for the cloth conveyor 4 to ensure the time required for releasing the held state of the rear body part Cb and time required for holding the rear body part Cb. Every time the holding and releasing and the holding of the rear body part Cb are repeatedly performed, it is necessary to perform the position adjustment of the rear body part Cb by the separately provided position adjustment mechanism. As a result, there is a possibility that the equipment costs increase and productivity of clothing deteriorates. In the embodiment, since the cloth conveyor 4 continues to hold the rear body part Cb, it is possible to eliminate the time required for the cloth conveyor 4 to release the held state of the rear body part Cb and the time required for the cloth conveyor 4 to hold the rear body part Cb. Therefore, deterioration in productivity of clothing is prevented.

In the embodiment, the cloth conveyor 4 adjusts the position of the cloth C in a state where the cloth C is held in each of the first sewing machine 21 and the second sewing machine 22. Accordingly, in each of the first sewing machine 21 and the second sewing machine 22, the cloth C is accurately conveyed to the target position.

In the embodiment, the cloth conveyor 4 includes a movable member 63 which is a contact member that can come into contact with the cloth C, and by moving the cloth conveyor 4 in a state where at least a part of the cloth C and the lower end portion of the movable member 63 are in contact with each other, the position of the cloth C is adjusted. Accordingly, it is possible to adjust the position of the cloth C with high accuracy by using high positioning accuracy of the cloth conveyor 4 including the robot 5.

In the embodiment, the detector 313 that detects the position of the front body part Ca and the detector 323 that detects the position of the rear body part Cb are provided, and the cloth conveyor 4 adjusts the position of the front body part Ca and the position of the rear body part Cb based on the detection data of the detector 313 and the detection data of the detector 323. Accordingly, the cloth conveyor 4 can convey the cloth C to the target position with high accuracy in a coordinate system defined in the sewing system 1.

In the embodiment, the detector 313 is disposed in the first cloth feeder 31, and the detector 323 is disposed in the second cloth feeder 32. Since the position of the front body part Ca is detected in the first cloth feeder 31 that serves as a starting point of the conveyance of the front body part Ca, the cloth conveyor 4 can adjust the position of front body part Ca with high accuracy based on the detection data of the detector 313 from the first cloth feeder 31 that serves as a starting point of the conveyance of the front body part Ca to the second sewing machine 22 that serves as an end point of the conveyance. Similarly, since the position of the rear body part Cb is detected in the second cloth feeder 32 that serves as a starting point of the conveyance of the rear body part Cb, the cloth conveyor 4 can adjust the position of the rear body part Cb with high accuracy based on the detection data of the detector 323 from the second cloth feeder 32 that serves as a starting point of the conveyance of the rear body part Cb to the second sewing machine 22 that serves as an end point of the conveyance.

In the embodiment, the adjustment of the position of the cloth C by the cloth conveyor 4 includes the adjustment of the position of the cloth C regarding the target position defined by the first sewing machine 21, and the adjustment of the position of the cloth C regarding the target position defined by the second sewing machine 22. By the cloth conveyor 4, since the cloth C is disposed with high accuracy at the target position defined by the sewing machine 2, the target part of the cloth C is sewn excellently. Therefore, manufacturing defects of clothing are prevented.

In the embodiment, the second sewing machine 22 includes the first cloth pressing member 240L that fixes the left shoulder part KL of the cloth C, and the adjustment of the position of the cloth C by the cloth conveyor 4 includes the adjustment of the position of the right shoulder part KR of the cloth C regarding the left shoulder part KL. Accordingly, as described with reference to FIGS. 18 and 19, the seam line SL and the seam line SR can be accurately disposed on the same straight line using the cloth conveyor 4.

In the embodiment, the cloth conveyor 4 includes the conveying member 6 including the suction surface HS for suctioning and holding the cloth C from above, and the movable member 63 supported to be movable by the conveying member 6. After the left shoulder part KL of the cloth C is released from the suctioned and held state of the conveying member 6, the left shoulder part KL is fixed to the first cloth pressing member 240L, the cloth conveyor 4 moves in the XY plane in a state where the cloth C separated from the suction surface HS and the lower end portion of the movable member 63 are in contact with each other, and adjusts the position of the right shoulder part KR of the cloth C. Accordingly, the relative position between the left shoulder part KL and the right shoulder part KR in the XY plane is smoothly adjusted.

In the embodiment, the adjustment of the position of the cloth C by the cloth conveyor 4 includes the adjustment of the position of the rear body part Cb regarding the front body part Ca installed on the table 221 of the second sewing machine 22. Accordingly, on the table 221 of the second sewing machine 22, the rear body part Cb can accurately overlap the front body part Ca.

In the embodiment, after conveying the front body part Ca from the first cloth feeder 31 to the second sewing machine 22 and adjusting the position of the front body part Ca, the cloth conveyor 4 conveys the rear body part Cb from the second cloth feeder 32 to the second sewing machine 22 and adjusts the position of the rear body part Cb regarding the front body part Ca installed in the second sewing machine 22. In the embodiment, the front body part Ca and the rear body part Cb are sequentially conveyed to the second sewing machine 22 by the cloth conveyor 4 including the integrated robot 5 and the conveying member 6, and the position of the front body part Ca and the position of the rear body part Cb can be accurately adjusted.

In the embodiment, the first cloth feeder 31 includes the installation table 312 on which the front body part Ca is installed, and the cloth conveyor 4 conveys the front body parts Ca one by one from the installation table 312. The second cloth feeder 32 includes the installation table 322 on which the rear body part Cb is installed, and the cloth conveyor 4 conveys the rear body parts Cb one by one from the installation table 322. Accordingly, in the sewing machine 2, since the front body parts Ca and the rear body parts Cb are stitched one by one, manufacturing defects of clothing are prevented.

Another Embodiment

In the above-described embodiment, the imaging region of the detector 313 has a sufficient size to fit the entire front body part Ca installed on the installation table 312. In other words, one detector 313 can collectively acquire the image data of the entire front body part Ca. In the first cloth feeder 31, the plurality of detectors 313 for acquiring the image data of the front body part Ca installed on the installation table 312 may be provided. For example, the first detector 313 may acquire the image data of the upper portion of the front body part Ca including the shoulder part K, the neck part N, and the sleeve part M out of the front body part Ca installed on the installation table 312, and the second detector 313 may acquire the image data of the lower portion of the front body part Ca including the side part W and the hem part H. After acquiring the image data of a plurality of different parts of the front body part Ca by each of the plurality of detectors 313, the image data of the entire front body part Ca may be acquired by combining the image data of the plurality of parts. The same is also applied to the detector 323 for acquiring the image data of the rear body part Cb installed on the installation table 322.

In the above-described embodiment, the sewing system 1 manufactures a T-shirt as clothing. Clothing manufactured by the sewing system 1 is not limited to a T-shirt, and may be, for example, a long-sleeved shirt or pants.

In the above-described embodiment, the sewing system 1 manufactures clothing as a sewn product. The sewn product manufactured by the sewing system 1 is not limited to clothing, and may be a component manufactured by sewing a plurality of cloths, such as pouches, bags, and shoes. The sewn product manufactured by the sewing system 1 is not limited to a finished product, and may be an intermediate product or a part product.

The invention claimed is:

1. A sewing system comprising:

a detector for detecting an edge of a cloth installed on an installation table;

a cloth conveyor for conveying the cloth from the installation table to a sewing machine; and a controller, wherein the cloth conveyor includes a holding member configured to hold the cloth by suctioning the cloth, the controller includes a holding position decision portion configured to determine a holding position of the cloth based on detection data of the detector, and a conveyance control portion configured to control the cloth conveyor such that the holding member holds the holding position of the cloth, the edge of the cloth includes a reference edge and a non-reference edge, the holding position includes a reference holding position determined to be at a first prescribed distance from the reference edge, and a non-reference holding position determined to be at a second prescribed distance from the non-reference edge, the holding member includes a reference holding member and a non-reference holding member, the cloth conveyor includes a main body member that supports the reference holding member and supports the non-reference holding member to be movable, a robot adapted to move the main body member, and a power generator that is supported by the main body member, and is adapted to generate power for moving the non-reference holding member regarding the main body member, and the conveyance control portion is configured to control the robot and the power generator such that the non-reference holding member holds the non-reference holding position in a state where the reference holding member holds the reference holding position.

2. The sewing system according to claim 1, wherein the main body member is connected to the robot via a connecting member, a distance between the connecting member and the power generator is shorter than a distance between the connecting member and the holding member, and the cloth conveyor includes a power transmission mechanism for transmitting the power generated by the power generator to the holding member.

3. The sewing system according to claim 1, wherein the reference edge of the cloth is a straight line, the reference holding position includes a first reference holding position and a second reference holding position, and the holding position decision portion is configured to determine the first reference holding position and the second reference holding position such that a line that connects the first reference holding position and the second reference holding position to each other becomes parallel to the reference edge.

4. The sewing system according to claim 1, wherein the sewing machine includes a first sewing machine for stitching a label to a target part of the cloth, and the target part of the cloth is within the first prescribed distance from the reference edge.

5. The sewing system according to claim 4, wherein the cloth conveyor is adapted to hold the cloth during stitching of the label.

6. The sewing system according to claim 1, wherein the controller includes a storage portion configured to store reference data related to the cloth, and an abnormality decision portion configured to determine whether the cloth installed on the installation table is abnormal by collating the detection data of the detector with the reference data, and in response to the abnormality decision portion determining that the cloth installed on the installation table is not abnormal, the conveyance control portion is configured to control the cloth conveyor such that the cloth determined not to be abnormal is conveyed from the installation table to the sewing machine, and in response to the abnormality decision portion determining that the cloth installed on the installation table is abnormal, the conveyance control portion is configured to control the cloth conveyor such that the cloth determined to be abnormal is conveyed from the installation table to an abnormal cloth accommodation member.

7. The sewing system according to claim 6, wherein the cloth conveyor includes a gripper that is movable in a direction orthogonal to an upper surface of the installation table on which the cloth is installed, and is adapted to pinch the cloth, and the conveyance control portion is configured to control the cloth conveyor to convey the cloth determined to be abnormal to the abnormal cloth accommodation member in a state where the cloth is pinched by the gripper.

* * * * *